US006530654B2

(12) United States Patent
Kitabatake et al.

(10) Patent No.: US 6,530,654 B2
(45) **Date of Patent: *Mar. 11, 2003**

(54) INK CONTAINER, VALVE UNIT FOR INK CONTAINER, INK JET HEAD CARTRIDGE HAVING INK CONTAINER AND INK JET RECORDING APPARATUS

(75) Inventors: Kenji Kitabatake, Kawasaki (JP); Shozo Hattori, Tokyo (JP); Hajime Yamamoto, Yokohama (JP); Eiichiro Shimizu, Yokohama (JP); Hiroshi Koshikawa, Kawaski (JP); Hiroki Hayashi, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/559,390

(22) Filed: Apr. 27, 2000

(65) Prior Publication Data

US 2003/0001934 A1 Jan. 2, 2003

(30) Foreign Application Priority Data

| | | |
|---|---|---|
| Apr. 27, 1999 | (JP) | 11-120802 |
| Jun. 24, 1999 | (JP) | 11-178569 |
| Jun. 24, 1999 | (JP) | 11-179048 |
| Jun. 24, 1999 | (JP) | 11-179076 |
| Apr. 18, 2000 | (JP) | 2000-116778 |

(51) Int. Cl.[7] ..... B41J 2/175
(52) U.S. Cl. ..... 347/86; 347/87
(58) Field of Search ..... 347/84, 85, 86, 347/87; 137/614.05, 68.3; 257/149.2

(56) References Cited

U.S. PATENT DOCUMENTS

| | | | | |
|---|---|---|---|---|
| 4,228,820 A | | 10/1980 | Deminski | 137/514 |
| 5,162,818 A | | 11/1992 | Kurita et al. | 347/50 |
| 5,691,753 A | * | 11/1997 | Hilton | 347/85 |
| 5,730,336 A | | 3/1998 | Lerner | 222/490 |
| 5,745,138 A | | 4/1998 | Ostermeier | 347/85 |
| 5,767,882 A | | 6/1998 | Kaplinski et al. | 347/87 |
| 6,345,888 B1 | | 2/2002 | Matsumoto et al. | 347/86 |

FOREIGN PATENT DOCUMENTS

| | | | | |
|---|---|---|---|---|
| DE | 3837678 | | 5/1989 | |
| DE | 3932501 | | 1/1991 | |
| EP | 560398 | | 9/1993 | |
| EP | 580433 | | 1/1994 | |
| EP | 581531 | | 2/1994 | |
| EP | 818314 | | 1/1998 | |
| EP | 8220853 | | 2/1998 | |
| EP | 861733 | | 9/1998 | |
| EP | 11058772 | * | 2/1999 | B41J/2/175 |
| EP | 0925935 | A2 * | 6/1999 | B41J/2/175 |
| FR | 2765330 | | 12/1998 | |
| GB | 2299786 | | 10/1996 | |
| JP | 7-52399 | * | 2/1995 | B41J/3/04 |
| JP | 11-58772 | | 3/1999 | |
| KR | 0006029 | | 4/1991 | |

OTHER PUBLICATIONS

U.S. Application No. 09/559,389, filed Apr. 27, 2000.
U.S. Application No. 09/559,383, filed Apr. 27, 2000.
U.S. Application No. 09/599,754, filed Apr. 27, 2000.
U.S. Application No. 09/559,382, filed Apr. 27, 2000.
U.S. Application No. 09/559,381, filed Apr. 27, 2000.

* cited by examiner

*Primary Examiner*—Anh T.N. Vo
(74) *Attorney, Agent, or Firm*—Fitzpatrick, Cella, Harper & Scinto

(57) ABSTRACT

A liquid container for containing recording liquid to the supplied to a ink jet recording mechanism to which the liquid container is detachably mountable, the liquid container includes a main body; a liquid supply opening formed in the main body and connectable with the ink jet recording mechanism to supply the recording liquid out; wherein the liquid supply opening has an elongated circle configuration.

29 Claims, 31 Drawing Sheets

INK CONTAINER, VALVE UNIT FOR INK CONTAINER, INK JET HEAD CARTRIDGE HAVING INK CONTAINER AND INK JET RECORDING APPARATUS

FIELD OF THE INVENTION AND RELATED ART

The present invention relates to an ink container usable with an ink jet recording apparatus or the like, a valve unit for an ink container, an ink jet head cartridge provided with the ink container and an ink jet recording apparatus, more particularly an ink container manufactured through a blow molding process, a valve unit for the ink container, an ink jet head cartridge having the ink container and an ink jet recording apparatus.

In a field of a liquid supplying system for supplying the ink to the recording head for ejecting the ink for effecting recording, an ink container capable of providing a negative pressure has been opposed and can be integrated with the recording head (ink jet head cartridge), and this system has been put into practice. The types of the ink jet head cartridge are classified into a type wherein the recording head and the ink container (ink accommodating portion) are normally integral, and a type wherein the recording head and the ink accommodating portion are separation members, and each of them is removable from the recording device, although they are integral in use.

As an easiest method of providing the negative pressure in such a liquid supply system, is to utilize capillary force produced by porous material or fiber members. The ink container used in such a method, the structure includes a porous material or a fiber member such as in compressed sponge accommodated in the entirety of the inside of the ink container and an air vent capable of introducing air into the ink accommodating portion to make the ink supply smooth during recording operation.

However, the system using the porous material or fiber member as an ink holding member, involves a problem that ink accommodation efficiency per unit volume is low. In order to provide a solution to the problem, EP0580433 which has been assigned to the assignee of the present application has proposed an ink container comprising a negative pressure producing member accommodating chamber in fluid communication with the ambience and an ink accommodating chamber which is substantially hermetically sealed, wherein said negative pressure producing member accommodating chamber and said ink accommodating chamber are made integral, and are in fluid communication with each other only through a communicating portion (dual-chamber type).

With such a dual-chamber type ink container, the ink supply to the negative pressure producing member accommodating chamber from the ink accommodating chamber is effected with a gas-liquid exchanging operation in which the gas is introduced and accommodated in the ink accommodating chamber together with the ink supply from the ink accommodating chamber into negative pressure producing member accommodating chamber, so that ink can be supplied under a substantially constant negative pressure during the gas-liquid exchanging operation.

EP0581531 proposes a structure in which a container constituting the ink accommodating chamber is detachably mountable relative to the container constituting the negative pressure producing member accommodating chamber. With this proposal, when the ink is used up, only the ink accommodating chamber is exchanged, and therefore, the amount of the waste can be reduced, which is advantageous in terms of environmental health. In the structure in which the ink accommodating chamber (container) is mounted to or demounted from the part to be supplied with the liquid, such as a negative pressure producing member accommodating chamber or a recording head, the care should be taken to effect sealing at the connection opening to prevent ink leakage until the firm connection is established with the ink receiving part. As for them sealing means for the connection opening, a film seal, for example, is known. When the ink accommodating container and the ink receiving part are connected, a member such as a joint pipe provided in the ink receiving part pieces the film, and the joint pipe enters the connection opening of the ink accommodating container to establish fluid communication between the ink accommodating container and the ink receiving part. However, when the ink accommodating container and the liquid receiving part are detachably mountable relative to each other, it is desirable that following conditions are simultaneously satisfied. First, when the liquid receiving portion and the ink accommodating container are connected with each other, or when they are separated from each other, the ink does not leak from the supply portion of the ink accommodating container irrespective of the position or orientation of the ink accommodating container. Second, when the connection is carried out therebetween, the ink supply path is assuredly opened, and after the connection is completed, the ink is stately supplied out.

Third, some uses may connect and remove repeatedly the ink accommodating container, and therefore, the above-described conditions are satisfied each time the ink accommodating container is mounted and demounted.

In the case of the sealing using the film seal, when the ink accommodating container is removed when the ink in the ink accommodating container is not completely consumed, the ink leaks out since the connection opening (supply port) of the ink accommodating container is unsealably kept open.

It has been proposed that valve structure is provided at the supply port portion of the ink accommodating container. However, in the case of the dual-chamber type ink container of the ink accommodating container exchangeable type, the valve structure is provided in the position where the gas-liquid exchange occurs, and therefore, the valve structure is required to have the reliable opening and closing mechanism which is peculiar to the function of the valve and in addition to have a productive of smooth movement of the gas without stagnation and/or accumulation of the gas in the communicating portion and corresponding smooth supply of the liquid (ink). Japanese Laid-open Patent Application No. HEI 11-58772 discloses a structure relating to exchange of the ink accommodating chamber. In this proposal, there are provided a main container portion connected with a recording head and an exchangeable sub-container portion, and a valve mechanism is provided for each of the supply portion of the main container portion and the supply port of the sub-container portion. The valve mechanism is such that valve mechanisms for the supply portion and the supply port are pressed toward each other by the valve mechanisms, by which the valve mechanisms are opened to enable ink supply. Therefore, desirable opening operation cannot be accomplished without balance in the forces of the valve urging members constituting the valve mechanisms.

However, when the exchange of the sub-container portion is repeated, the valve urging member in the supply portion side is deteriorated with the result of imbalance in the forces provided by the valve urging members. For example, when the urging force of the valve urging member of the main container portion becomes small due to the repeated mounting and demounting, it becomes not possible to release the valve mechanism of the sub-container portion, and therefore, the opening and closing operation is not reliable. If the urging force of the valve urging member in the sub-container portion is made weak as a countermeasure against the above- described problem, the ink leakage may occur during transportation.

The valve member in the sub-container portion comprises a flange portion sealing the opening of the supply port, a rod-like projection projected outwardly from the flange portion, wherein the rod-like projection is brought into compact with the valve of the main container portion so that valves are mutually pressed and opened. In this structure, the positions must be controlled such that valve mechanism in the main container portion and the rod-like projection are assuredly pressed against each other to assure a linear motion of the sub-container portion, since otherwise the valve is not opened in the desirable manner. In order to carried out a safe valve opening operation, it is required that sub-container portion is translated (parallel movement) in the mounting operation. Otherwise (for example, using a rotational motion for the purpose of saving space required for the mounting operation), when the abutment of the valves, for example, when the rod-like projection is abutted to a frame of the supply portion before it is abutted to the valve mechanism of the main container portion, with the result that before the intended connection is completed, the valve of the sub-container portion is opened, and therefore, the ink leaks. Then, the intended opening using the urging force is not properly effected, and the valve may clog so that fluid communication is not assured. In addition, a large area is required for the mounting of the sub-container portion. Furthermore, the gas-liquid exchanging operation might be not reliable. Therefore, the valve structure disclosed in Japanese Laid-open Patent Application No. HEI 11-58772 involves a problem to be solved in order to effect the desirable opening and closing of the valve.

On the other hand, in an apparatus effecting full-color recording a plurality of ink accommodating containers are juxtaposed. In this case, a thin (or small with) ink container structure has been proposed in consideration of saving of the foot print of the ink container. In order to assure the proper ink supply from the thin ink accommodating container, the area of the opening for the supply is desirably large. Particularly, when the container is a thin dual-chamber type valve in which the ink accommodating container is exchangeable, the valve structure is very significant in order to assure the reliability of the gas-liquid exchange.

Furthermore, an example of the container is of a dual-chamber type which is provided with the negative pressure producing member accommodating container and the ink accommodating container, and in which the ink accommodating container is exchangeable, the ink accommodating container comprises a hollow rectangular parallelepiped casing and a deformable inner bladder for containing ink therein, in the casing. The inner bladder constitutes a deformable ink accommodating portion or chamber. The casing and the inner bladder are connected with each other around the openings thereof. Except the connecting portion minute retained casing and the inner bladder, namely, the wall portions of the casing and the inner bladder are separable. The feature of such an ink supplying system using the ink container of this type is that inner bladder which directly accommodates the ink deforms with the consumption of the ink therein so as to reduce the inside volume of inner bladder.

When the ink is consumed from the inner bladder, the inner bladder deforms, and at a certain stage, the maximum area surfaces of the inner bladder are contacted to each other. When the inner bladder deforms in this manner, the bottom surface of the inner bladder separates from the casing depending on the position of the supply port, and by the deformation of the portion of the inner bladder adjacent the supply port, the ink flow path in the inner bladder and the bubble path for permitting the bubble to rise during the gas-liquid exchanging operation relative to the outside of the inner bladder are narrowed. Accordingly, when the inner bladder deforms, the flowability of the ink in the inner bladder lowers, and therefore, the ink supply performance may be insufficient when the further high speed printing is desired.

SUMMARY OF THE INVENTION

The valve mechanism is desired to have the above-described properties with high reliability. Accordingly, it is a principal object of the present invention to provide a novel valve structure, an ink container using the valve structure, an ink jet head cartridge having the provision, and an ink jet recording apparatus having the same.

It is an object of the present invention to provide a valve structure, an ink container using the valve structure, an ink jet head cartridge having the provision, and an ink jet recording apparatus having the same, wherein a cross-sectional area of an opening of an ink supply port can be assured even when the ink supply port is formed in a side having a small width, so that ink can be assuredly supplied from the ink container into the ink jet head or the like through the ink supply port, and in addition, a sealing property of a valve structure provided in the ink supply port can be maintained. It is a further object of the present invention to provide a valve structure, an ink container using the valve structure, an ink jet head cartridge having the provision, and an ink jet recording apparatus having the same wherein bubbles do not stagnate or accumulated in the communicating portion to assure a stabilized supply of the liquid. It is a further object of the present invention to provide a valve structure, an ink container using the valve structure, an ink jet head cartridge having the provision, and an ink jet recording apparatus having the same wherein the latitude of the motion of the bubbles are assured, and/or motion of the ink from the ink accommodating chamber to the negative pressure producing member accommodating chamber is promoted.

It is a further object of the present invention to provide a valve structure, an ink container using the valve structure, an ink jet head cartridge having the provision, and an ink jet recording apparatus having the same wherein a valve member having sealed the connection opening of an ink accommodating container is pressed by a joint pipe of an ink receiving part, by which the connection opening is unsealed, and when the connection opening is separated from the from, the valve member returns to seal the connection opening, and wherein even when the joint pipe portion clogs in the connection opening portion by an external force to the ink accommodating container, the sealing and the stabilization ink supply are both assured.

It is a further object of the present invention to provide a valve structure, an ink container using the valve structure, an ink jet head cartridge having the provision, and an ink jet recording apparatus having the same wherein a liquid container provided with a frame for a piston guide in the form of a tube or a cylinder is detachably mountable to a liquid receiving portion to which the liquid is to be supplied, and the piston of the valve mechanism of the container is movable, and the piston is moved for the liquid supply (by abutting an inserting member), and wherein the rigidity of the frame supporting the piston is higher than the rigidity of the inserting member to avoid a problem of mechanical strength relation between the frame supporting the piston and the inserting member in view of the strength of the inserting member per se to permit motion of the piston. It is a further object of the present invention to provide a valve structure, an ink container using the valve structure, an ink jet head cartridge having the provision, and an ink jet recording apparatus having the same wherein the valve member is prevented from clogging when the ink accommodating container is connected to and disconnected to the liquid receiving portion or when the connection and the disconnection are repeated, thus simultaneously accomplishing assured sealing and stabilized ink supply. It is a further object of the present invention to provide a valve structure, an ink container using the valve structure, an ink jet head cartridge having the provision, and an ink jet recording apparatus having the same wherein a liquid containing portion of the liquid supply container is deformable, and even when the liquid containing portion deforms in response to consumption of the liquid therefrom, the deterioration of the flowability of the liquid in the liquid containing portion due to the narrowing of the passage adjacent the supply port in the liquid containing portion, so that high speed liquid supply is always assured. According to an aspect of the present invention, there is provided a liquid container for containing recording liquid to the supplied to a ink jet recording mechanism to which the liquid container is detachably mountable, the liquid container comprising: a main body; a liquid supply opening formed in the main body and connectable with the ink jet recording mechanism to supply the recording liquid out; wherein the liquid supply opening has an elongated circle configuration.

According to another aspect of the present invention, there is provided a valve mechanism comprising: a cylindrical frame; a valve member which is slidable in the frame; a shaft portion provided in the valve member and extended in a slide direction of the valve member; a cap member connecting with one end of the frame and having a bearing opening for supporting the shaft portion; an urging member for urged the valve member away from the cap member; a contact member provided along an inner surface of the frame contactable to a free end of the valve member urged the urging member; an opening, formed in a side of the frame, for disabling, when a free end of the valve member is contacted to the contact member, fluid communication with an opening provided at the other end of the frame and enabling, when the free end is away therefrom, fluid committees with the opening provided at the other end; wherein a configuration of the opening of the frame is elongated circle configuration.

According to a further aspect of the present invention, there is provided a liquid container for containing recording liquid to be supplied to a recording mechanism to which liquid container is detachably mountable, the liquid container comprising: a liquid supply portion constituting a connecting portion for supplying the recording liquid to the recording mechanism; a valve mechanism, provided in the liquid supply portion, for permitting supply of the recording liquid by insertion of a hollow pipe provided in the recording mechanism to function as a liquid receiving portion and preventing supply of the recording liquid by removing the hollow pipe; and the liquid supply portion has an elongated opening configuration.

According to a further aspect of the present invention, there is provided a liquid supply container comprising: a supply port, a liquid containing portion sealed except for the supply port, wherein the liquid containing portion is deformable while providing a negative pressure with discharge of the liquid contained therein; a regulating member for regulating a deformation of a portion adjacent the supply port, the regulating member being provided in the liquid containing portion.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiments of the present invention will be described with reference to the appended drawings.

In the following description of the embodiments of the present invention, "hardness" of a capillary force generating portion means the "hardness" of the capillary force generating portion when the capillary force generating member is in the liquid container. It is defined by the inclination of the amount of resiliency of the capillary force generating member relative to the amount of deformation. As for the difference in hardness between two capillary force generating members, a capillary force generating member which is greater in the inclination in the amount of resiliency relative to the amount of deformation is considered to be "harder capillary force generating member".

<General Structure>

Figure 1:
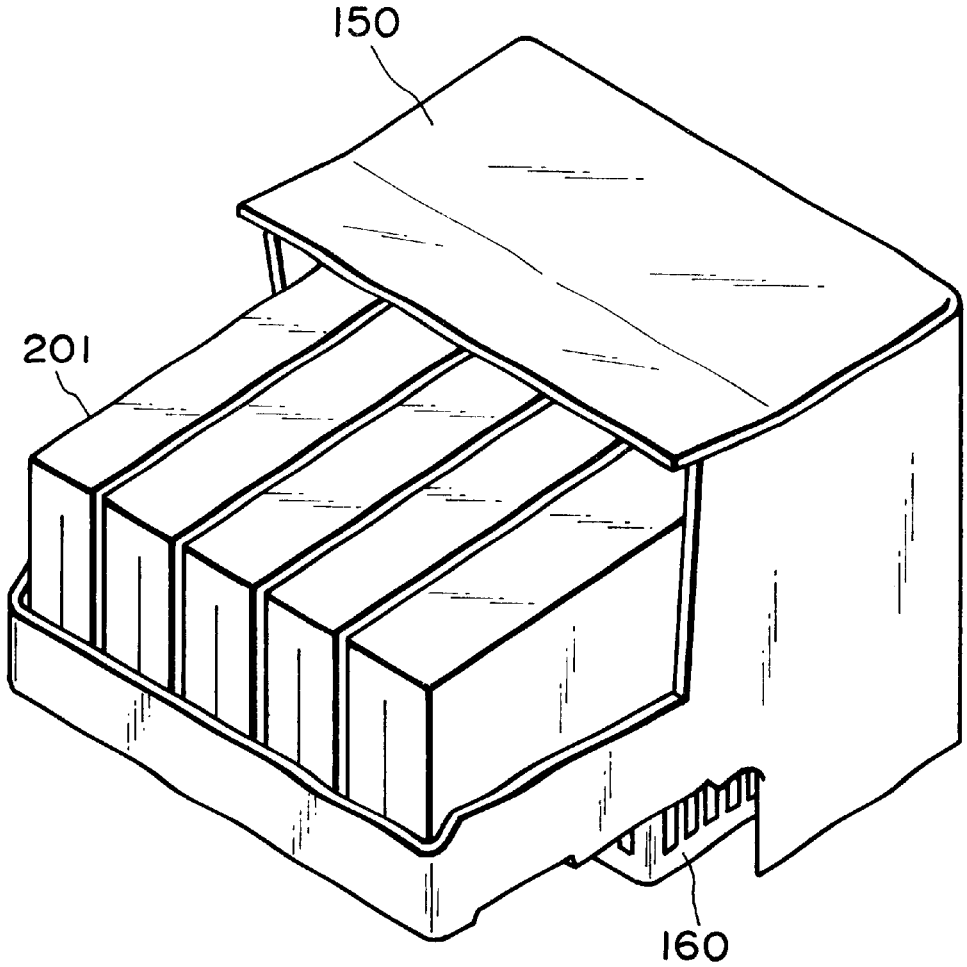
FIG. 1 is a perspective view of the ink jet head cartridge in one of the embodiments of the present invention.
Figure 2:
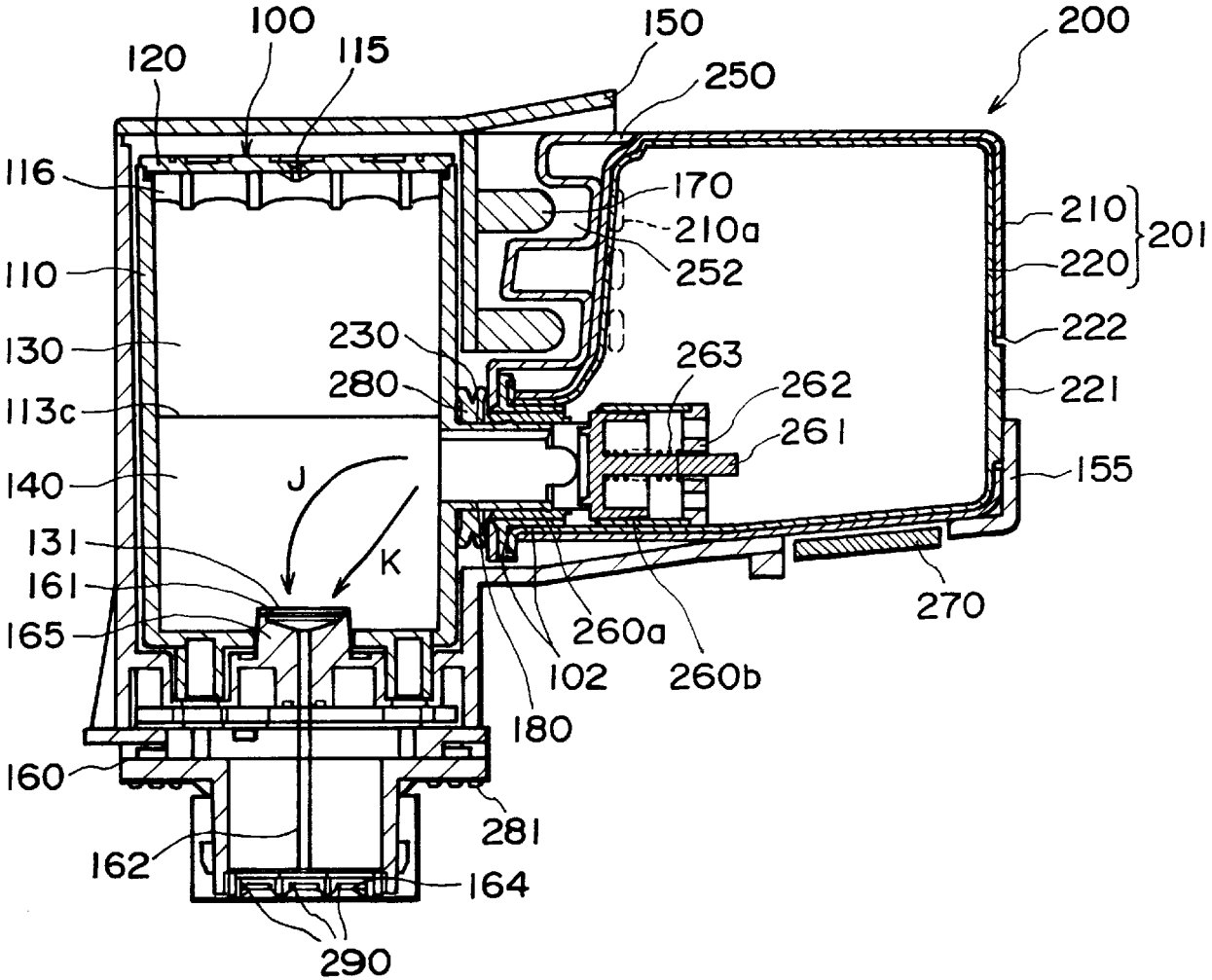
FIG. 2 is a sectional view of the cartridge in FIG. 1.

FIG. 1 is a perspective view of the ink jet head cartridge in the first of the embodiments of the present invention, and FIG. 2 is a sectional view of the same ink jet head cartridge.

In this embodiment, each of the structural components of the ink jet head cartridge in accordance with the present invention, and the relationship among these components, will be described. Since the ink jet head cartridge in this embodiment was structured so that a number of innovative technologies, which were developed during the making of the present invention, could be applied to the ink jet cartridge which was being invented, the innovative structures will also be described as the overall description of this ink jet head cartridge is given.

Referring to FIGS. 1 and 2, the ink jet head cartridge in this embodiment comprises an ink jet head unit 160, a holder 150, a negative pressure controlling chamber unit 100, an ink container unit 200, and the like. The negative pressure controlling chamber unit 100 is fixed to the inward side of the holder 150. Below the negative pressure controlling chamber unit 100, the ink jet head is attached to the outward side of the bottom wall portion of the holder 150. Using screws or interlocking structures, for ease of disassembly, to fix the negative pressure controlling chamber unit 100 and ink jet head unit 160 to the holder 150 is desirable in terms of recycling, and also is effective for reducing the cost increase which is incurred by the structural modification or the like. Further, since the various components are different in the length of service life, the aforementioned ease of disassembly is also desirable because it makes it easier to replace only the components which need to be replaced. It is obvious, however, that they may be permanently connected to each other by welding, thermal crimping, or the like. The negative pressure controlling chamber unit 100 comprises: a negative pressure controlling chamber shell 110, which is open at the top; a negative pressure controlling chamber cover 120 which is attached to the top portion of the negative pressure controlling chamber shell 110 to cover the opening of the negative pressure controlling chamber shell 110; two pieces of absorbent material 130 and 140 which are placed in the negative pressure controlling chamber shell 110 to hold ink by impregnation. The absorbent material pieces 130 and 140 are filled in vertical layers in the negative pressure controlling chamber shell 110, with the absorbent material piece 130 being on top of the absorbent material piece 140, so that when the ink jet head cartridge is in use, the absorbent material pieces 130 and 140 remain in contact with each other with no gap between them. The capillary force generated by the absorbent material piece 140, which is at the bottom, is greater than the capillary force generated by the absorbent material piece 130 which is at the top, and therefore, the absorbent material piece 140 which is at the bottom is greater in ink retainment. To the ink jet head unit 160, the ink within the negative pressure controlling chamber unit 100 is supplied through an ink supply tube 165.

The opening 131 of the ink supply tube 160, on the absorbent material piece 140 side, is provided with a filter 161, which is in contact with the absorbent material piece 140, being under the pressure from the elastic member. The ink container unit 200 is structured so that it can be removably mounted in the holder 150. A joint pipe 180, which is a portion of the negative pressure controlling chamber shell 110 and is located on the ink container unit 200 side, is connected to the joint opening 230 of the ink container unit 200 by being inserted thereinto. The negative pressure controlling chamber unit 100 and ink container unit 200 are structured so that the ink within the ink container unit 200 is supplied into the negative pressure controlling chamber unit 100 through the joint portion between the joint pipe 180 and joint opening 230. Above the joint pipe 180 of the negative pressure controlling chamber shell 110, on the ink container unit 200 side, there is an ID member 170 for preventing the ink container unit 200 from being incorrectly installed, which projects from the surface of the holder 150, on the ink container unit 200 side.

The negative pressure controlling chamber cover 120 is provided with an air vent 115 through which the internal space of the negative pressure controlling chamber shell 110 is connected to the outside; more precisely, the absorbent material piece 130 filled in the negative pressure controlling chamber shell 110 is exposed to the outside air. Within the negative pressure controlling chamber shell 110 and adjacent to the air vent, there is a buffering space 116, which comprises an empty space formed by a plurality of ribs projecting inwardly from the inward surface of the negative pressure controlling chamber cover 120, on the absorbent material piece 130 side, and a portion of the absorbent material piece 130, in which no ink (liquid) is present.

On the inward side of the joint opening 230, a valve mechanism is provided, which comprises a first valve body (or frame) 260*a*, a second valve body 260*b*, valve plug (or member) 261, a valve cover (or cap) 262, and a resilient member 263. The valve plug 261 is held within the second valve body 260*b*, being allowed to slide within the second valve body 260*b* and also being kept under the pressure generated toward the first valve body 260*a* by the resilient member 263. Thus, unless the joint pipe 180 is inserted through the joint opening 230, the edge of the first valve plug 261, on the first valve body 260*a* side, is kept pressed against the first valve body 260*a* by the pressure generated by the resilient member 263, and therefore, the ink container unit 200 remains airtightly sealed.

As the joint pipe 180 is inserted into the ink container unit 200 through the joint opening 230, the valve plug 261 is moved by the joint pipe 180 in the direction to separate it from the first valve body 260*a*. As a result, the internal space of the joint pipe 180 is connected to the internal space of the ink container unit 200 through the opening provided in the side wall of the second valve body 260*b*, breaking the airtightness of the ink container unit 200. Consequently, the ink container unit 200 begins to be supplied into the negative pressure controlling chamber unit 100 through the joint opening 230 and joint pipe 180. In other words, as the valve on the inward side of the joint opening 230 opens, the internal space of the ink holding portion of the ink container unit 200, which remained airtightly sealed, becomes connected to the negative pressure controlling chamber unit 100 only through the aforementioned opening.

It should be noted here that fixing the ink jet head unit 160 and negative pressure controlling chamber unit 100 to the holder 150 with the use of easily reversible means, such as screws, as is done in this embodiment, is desirable because the two units 160 and 100 can be easily replaced as their service lives end.

More specifically, in the case of the ink jet head cartridge in this embodiment, the provision of an ID member on each ink container makes it rare that an ink container for containing one type of ink is connected to a negative pressure controlling chamber for an ink container for containing another type of ink. Further, should the ID member provided on the negative pressure controlling chamber unit 100 be damaged, or should a user deliberately connect an ink container to a wrong negative pressure controlling chamber unit 100, all that is necessary is to replace only the negative pressure control chamber unit 100 as long as it is immediately after the incident. Further, if the holder 150 is damaged by falling or the like, it is possible to replace only the holder 150.

It is desirable that the points, at which the ink container unit 200, negative pressure controlling chamber unit 100, holder 150, and ink jet head unit 160, are interlocked to each other, are chosen to prevent ink from leaking from any of these units when they are disassembled from each other.

In this embodiment, the ink container unit 200 is held to the negative pressure controlling chamber unit 100 by the ink container retaining portion 155 of the holder 150. Therefore, it does not occur that only the negative pressure controlling chamber unit 100 becomes disengaged from the other units, inclusive of the negative pressure controlling chamber unit 100, interlocked among them. In other words, the above components are structured so that unless at least the ink container unit 200 is removed from the holder 150, it is difficult to remove the negative pressure controlling chamber unit 100 from the holder 150. As described above, the negative pressure controlling chamber unit 100 is structured so that it can be easily removed only after the ink container unit 200 is removed from the holder 150. Therefore, there is no possibility that the ink container unit 200 will inadvertently separate from the negative pressure controlling chamber unit 100 and ink leak from the joint portion.

The end portion of the ink supply tube 165 of the ink jet head unit 160 is provided with the filter 161, and therefore, even after the negative pressure controlling chamber unit 100 is removed, there is no possibility that the ink within the ink jet head unit 160 will leak out. In addition, the negative pressure controlling chamber unit 100 is provided with the buffering space 116 (inclusive of the portions of the absorbent material piece 130 and the portions of the absorbent material piece 140, in which no ink is present), and also, the negative pressure controlling chamber unit 100 is designed so that when the attitude of the negative pressure controlling chamber unit 100 is such an attitude that is assumed when the printer is being used, the interface 113*c* between the two absorbent material pieces 130 and 140, which are different in the amount of the capillary force, is positioned higher than the joint pipe 180 (preferably, the capillary force generated at the interface 113*c* and its adjacencies becomes greater than the capillary force in the other portions of the absorbent material pieces 130 and 140). Therefore, even if the structural conglomeration comprising the holder 150, negative pressure controlling chamber unit 100, and ink container unit 200, changes in attitude, there is very little possibility of ink leakage. Thus in this embodiment, the portion of the ink jet head unit 160, by which the ink jet head unit 160 is attached to the holder 150, is located on the bottom side, that is, the side where the electric terminals of the holder 150 are located, so that the ink jet head unit 160 can be easily removed even when the ink container unit 200 is in the holder 150.

Depending upon the shape of the holder 150, the negative pressure controlling chamber unit 100 or ink jet head unit 160 may be integral with, that is, inseparable from, the holder 150. As for a method for integration, they may be integrally formed from the beginning of manufacture, or may be separately formed, and integrated thereafter by thermal crimping or the like so that they become inseparable.

Figures 3A, 3B:
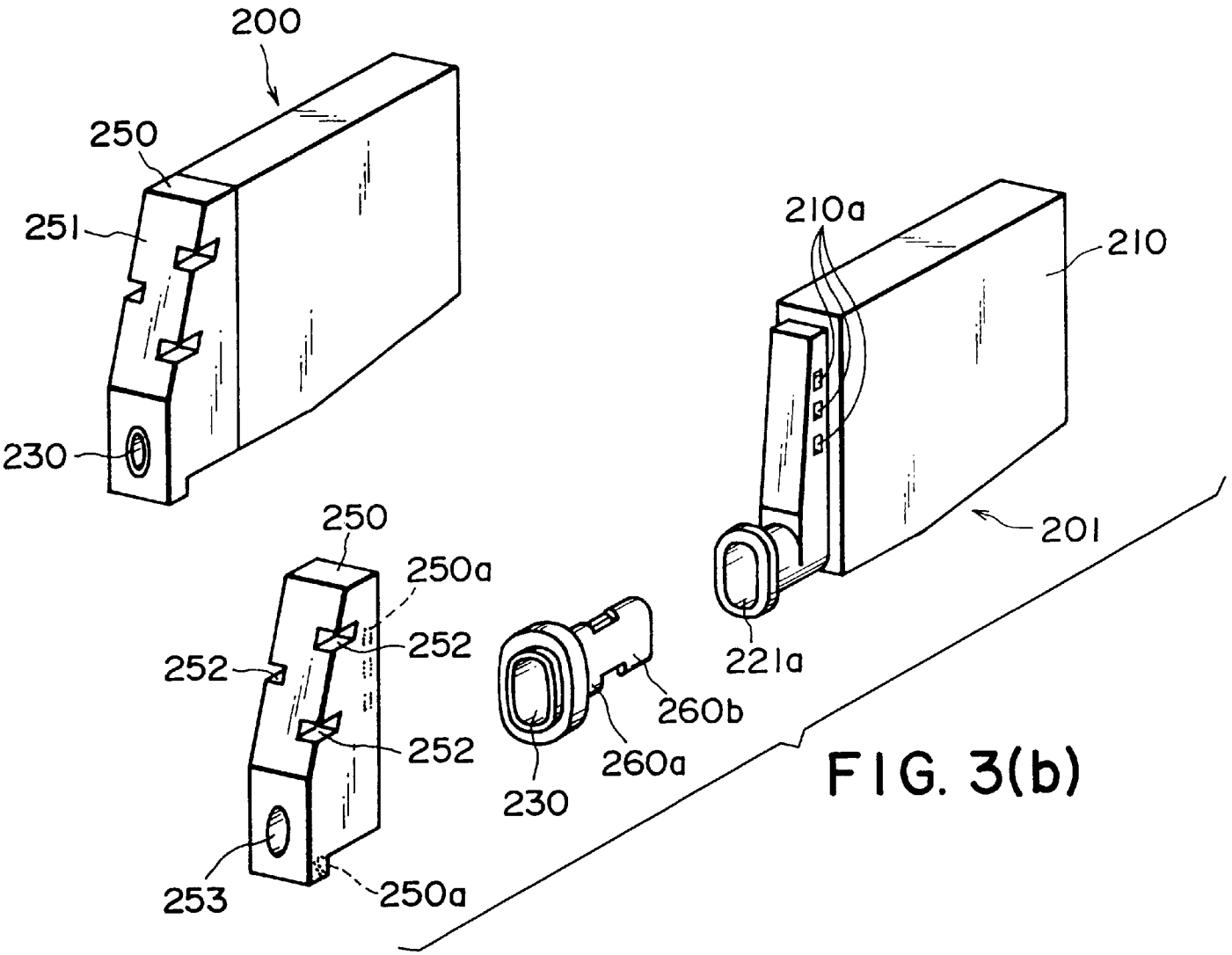
FIGS. 3A and 3B are perspective drawings for depicting the ink container unit illustrated in FIG. 2.

Referring to FIGS. 2, 3A, and 3B, the ink container unit 200 comprises an ink storing or accommodating container or reservoir 201, the valve mechanism comprising the first and second valve bodies 260*a* and 260*b*, and the ID member 250. The ID member 250 is a member for preventing installation mistakes which occur during the joining of ink container unit 200 to negative pressure controlling chamber unit 100.

The valve mechanism is a mechanism for controlling the ink flow through the joint opening 230, and is opened, or closed, as it is engaged with, or disengaged from, the joint pipe 180 of the negative pressure controlling chamber unit 100, respectively. The misalignment, or twisting, of the valve plug, which tends to occur during the installation or removal of the ink container unit 200, is prevented with the provision of an innovative valve structure, which will be described later, or the provision of an ID member 170 and an ID member slots 252, which limit the rotational range of the ink container unit 200.

<Ink Container Unit>

FIGS. 3A and 3B are perspective drawings for depicting the ink container unit 200 illustrated in FIG. 2. FIG. 3A is a perspective view of the ink container unit 200 in the assembled form, and FIG. 3B is a perspective view of the ink container unit 200 in the disassembled form.

The front side of the ID member 250, that is, the side which faces the negative pressure controlling chamber unit 100, is slanted backward from the point slightly above the supply outlet hole 253, forming a slanted (or tapered) surface 251. More specifically, the bottom end, that is, the supply outlet hole 253 side, of the slanted surface 251 is the front side, and the top end, that is, the ink storing container 201 side, of the slanted surface 251 is the rear side. The slanted surface 251 is provided with a plurality of ID slots 252 (three in the case of FIG. 3) for preventing the wrong installation of the ink container unit 200. Also in this embodiment, the ID member 250 is positioned on the front surface (surface with the supply outlet), that is, the surface which faces the negative pressure controlling chamber unit 100, of the ink storing container 201.

The ink storing container 201 is a hollow container in the form of an approximately polygonal prism, and is enabled to generate negative pressure. It comprises the external shell 210, or the outer layer, and the internal bladder 220, or the inner layer (FIG. 2), which are separable from each other. The internal bladder 220 is flexible, and is capable of changing in shape as the ink held therein is drawn out. Also, the internal bladder 220 is provided with a pinch-off portion (welding seam portion) 221, at which the internal bladder 220 is attached to the external shell 210; the internal bladder 220 is supported by the external shell 210. Adjacent to the pinch-off portion 221, the air vent 222 of the external shell 210 is located, through which the outside air can be introduced into the space between the internal bladder 220 and external shell 210.

Figure 19:
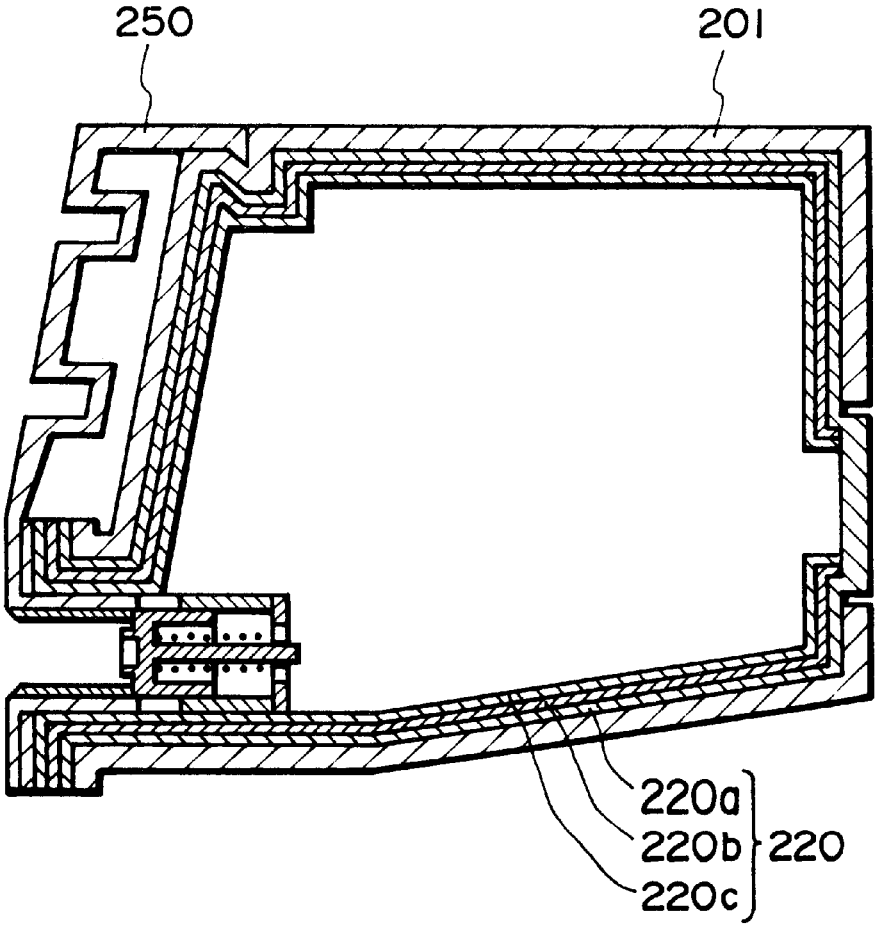
FIG. 19 is a sectional view of the ink storing container illustrated in FIG. 2, for depicting an example of the internal structure of the ink container.

Referring to FIG. 19, the internal bladder 220 is a laminar bladder, having three layers different in function: a liquid contact layer 220*c*, or the layer which makes contact with the liquid; an elastic modulus controlling layer 220*b*; and a gas barrier layer 220*a* superior in blocking gas permeation. The elastic modulus of the elastic modulus controlling layer 220*b* remains virtually stable within the temperature range in which the ink storing container 201 is used; in other words, the elastic modulus of the internal bladder 220 is kept virtually stable by the elastic modulus controlling layer 220*b* within the temperature range in which the ink storing container 201 is used. The middle and outermost layers of the internal bladder 220 may be switched in position; the elastic modulus controlling layer 220*b* and gas barrier layer 220*a* may be the outermost layer and middle layer, respectively.

Structuring the internal bladder 220 as described above makes it possible for the internal bladder 220 to synergistically display each of the individual functions of the ink-resistant layer 220*c*, elastic modulus controlling layer 220*b*, and gas barrier layer 220*a*, while using only a small number of layers. Thus, the temperature sensitive properties, for example, the elastic modulus, of the internal bladder 220 is less likely to be affected by the temperature change. In other words, the elastic modulus of the internal bladder 220 can be kept within the proper range for controlling the negative pressure in the ink storing container 201, within the temperature range in which the ink storing container 201 is used. Therefore, the internal bladder 220 is enabled to function as the buffer for the ink within the ink storing container 201 and negative pressure controlling chamber shell 110 (details will be given later). Consequently, it becomes possible to reduce the size of the buffering chamber, that is, the portion of the internal space of the negative pressure controlling chamber shell 110, which is not filled with ink absorbing material, inclusive of the portion of the absorbent material piece 130, in which ink is not present, and the portion of the absorbent material piece 140, in which ink is not present. Therefore, it is possible to reduce the size of the negative pressure controlling chamber unit 100, which in turn makes it possible to realize an ink jet head cartridge 70 which is superior in operational efficiency.

In this embodiment, polypropylene is used as the material for the liquid contact layer 220*c*, or the innermost layer, of the internal bladder 220, and cyclic olefin copolymer is used as the material for the elastic modulus controlling layer 220*b*, or the middle layer. As for the material for the gas barrier layer 220*a*, or the outermost layer, EVOH (ethylene-vinyl acetate copolymer: EVA resin) is used. It is desired that functional adhesive resin is mixed in the elastic modulus controlling layer 220*b*, because such a mixture eliminates the need for an adhesive layer between the adjacent functional layers, reducing the thickness of the wall of the internal bladder 220.

As for the material for the external shell 210, polypropylene is used, as it is used for the material for the innermost layer of the internal bladder 220. Polypropylene is also used as the material for the first valve body 260*a*.

The ID member 250 is provided with a plurality of ID member slots 252, which are arranged at the left and right edges of the front surface, corresponding to the plurality of ID members 170 for the prevention of the incorrect installation of the ink container unit 200.

The installation mistake preventing function is provided by the installation mistake prevention mechanism, which comprises the plurality of ID members 170 provided on the negative pressure controlling chamber unit 100 side, and the ID member slots 252 provided by the ID member 250 corresponding to the positions of the ID members 170. Therefore, a large number of ink container unit installation areas can be made identifiable by changing the shapes and positions of the ID members 170 and ID member slots 252.

The ID member slots 252 of the ID member 250, and the joint opening 230 of the first valve body 260*a*, are located in the front surface of the ink container unit 200, that is, the front side in terms of the direction in which the ink container unit 200 is installed or removed. They are parts of the ID member 250 and first valve body 260*a*, respectively.

The ink storing container 201 is formed by blow molding, and the ID member 250 and first valve body 260*a* are formed by injection molding. Giving the ink container unit 200 a three piece structure makes it possible to precisely form the valve body and ID member slots 252.

If the ID member slots 252 are directly formed as the portions of the wall of the ink storing container 201 by blow molding, the shape of the internal space of the ink containing portion becomes complicated, affecting the separation of the internal bladder 100 wall, or the inner layer of the ink storing container 201, which sometimes affects the negative pressure generated by the ink container unit 200. Separately forming the ID member 250 and ink container portion 201, and then attaching the ID member 250 to the ink containing portion 202, as the ink container unit 200 in this embodiment is structured, eliminates the aforementioned effect, making it possible to generate and maintain stable negative pressure in the ink storing container 201.

The first valve body 260*a* is attached to at least the internal bladder 220 of the ink storing container 201. More specifically, the first valve body 260*a* is attached by welding the exposed portion 221*a*, that is, the ink outlet portion of the ink storing container 201, to the surface of the joint opening 230 corresponding to the exposed portion 221*a*. Since both the external shell 210 and the innermost layer of the internal bladder 220 are formed of the same material, that is, polypropylene, the first valve body 260*a* can be welded to the external shell 210 also at the periphery of the joint opening 230.

The above described welding method increases accuracy in the positional relationship among the mutually welded components, while perfectly sealing the supply outlet portion of the ink storing container 201, and therefore, preventing ink leakage or the like which tends to occur at the seal portion between the first valve body 260*a* and the ink storing container 201 when the ink container unit 200 is installed, removed, or the like motion. When the first valve body 260*a* is attached to the ink storing container 201 by welding as in the case of the ink container unit 200 in this embodiment, it is desired for the sake of better sealing that the material for the internal bladder 220 layer, which provides the bonding surface, is the same as the material for the first valve body 260*a*.

As for the attachment of the ID member 250 to the external shell 210, in order to firmly join them, the shell surface which faces the sealing surface 102 of the first valve body 260*a*, which is bonded to the ink containing portion 210, is joined, by interlocking, to the click portions 250*a* of the ID member 250, which is located at the bottom portion of the ID member 250, and the engagement portion 210*a* of the external shell 210, which is located on the side walls of the external shell 210, are interlocked with the other click portions 250*a* of the ID member 250.

Regarding the word "interlocking", the mutually interlockable portions of these components are structured in the form of a projection or an indentation which fit with each other in an easily disengageable manner. Interlocking the ID member 250 with the ink storing container 201 allows both components to move slightly against each other. Therefore, the force generated by the contact between the ID members 170 and the ID member slots 252 during the installation or removal of these components can be absorbed to prevent the ink container unit 200 and negative pressure controlling chamber unit 100 from being damaged during the installation or removal of these components.

Also, interlocking the ID member 250 with the ink storing container 201 using only a limited number of the portions of the possible contact area makes it easier to disassemble the ink container unit 200, which is beneficial in consideration of its recycling. Providing indentations as the engagement portions 210*a* in the side walls of the external shell 210 makes the structure of the ink storing container 201 simpler to form by blow molding, and therefore, makes the mold pieces simpler. In addition, it makes it easier to control the film thickness.

Also regarding the joining of the ID member 250 to the external shell 210, the ID member 250 is joined to the external shell 210 after the first valve body 260*a* is welded to the external shell 210. Since the click portions 250*a* are interlocked with the engagement portions 210*a*, in the state in which the peripheral portion of the first valve body 260*a* is tightly surrounded at the periphery of the joint opening 230 by the inward surface of the ID member 250, the joint portion becomes stronger against the force which applies to the joint portion when the ink container unit 200 is installed or removed.

The shape of the ink storing container 201 is such that the portion to be covered by the ID member 250 is recessed, and the supply outlet portion protrudes. However, the protruding shape of the front side of the ink container unit 200 is hidden from view by the fixation of the ID member 250 to the ink storing container 201. Further, the welding seam between the first valve body 260*a* and ink storing portion 201 is covered by the ID member 250, being thereby protected. The relationship between the engagement portions 210*a* of the external shell 210 and the corresponding click portions 250*a* of the ID member 250, with regard to which side is projecting and which side is recessed, may be reversal to their relationship in this embodiment.

As described before, it is assured by the joint pipe 180 and valve mechanism that ink does not leak when the ink container unit 200 is installed. In this embodiment, a rubber joint portion 280 is fitted around the base portion of the joint pipe 180 of the negative pressure controlling chamber unit 100 to deal with unpredictable ink leakage. The rubber joint portion 280 seals between the ID member 250 and ink container unit 200, improving the degree of airtightness between the negative pressure controlling chamber unit 100 and ink container unit 200. When removing the ink container unit 200, this airtightness could function as resistance. However, in the case of this embodiment, the ID member 250 and ink storing container 201 are interlocked with the presence of a small amount of gap, allowing air to be introduced between the rubber joint portion 280 and ID member 250, and therefore, although ink is prevented from leaking, the force necessary to be applied for removing the ink container unit 200 is not as large as it otherwise would be, because of the provision of the rubber joint portion 280.

Further, the positions of the ink storing container 201 and IC member 250 can be controlled in terms of both the lengthwise and widthwise directions. The method for joining the ink storing container 201 with the ID member 250 does not need to be limited to a method such as the one described above; different joining points and different joining means may be employed.

Figure 22:
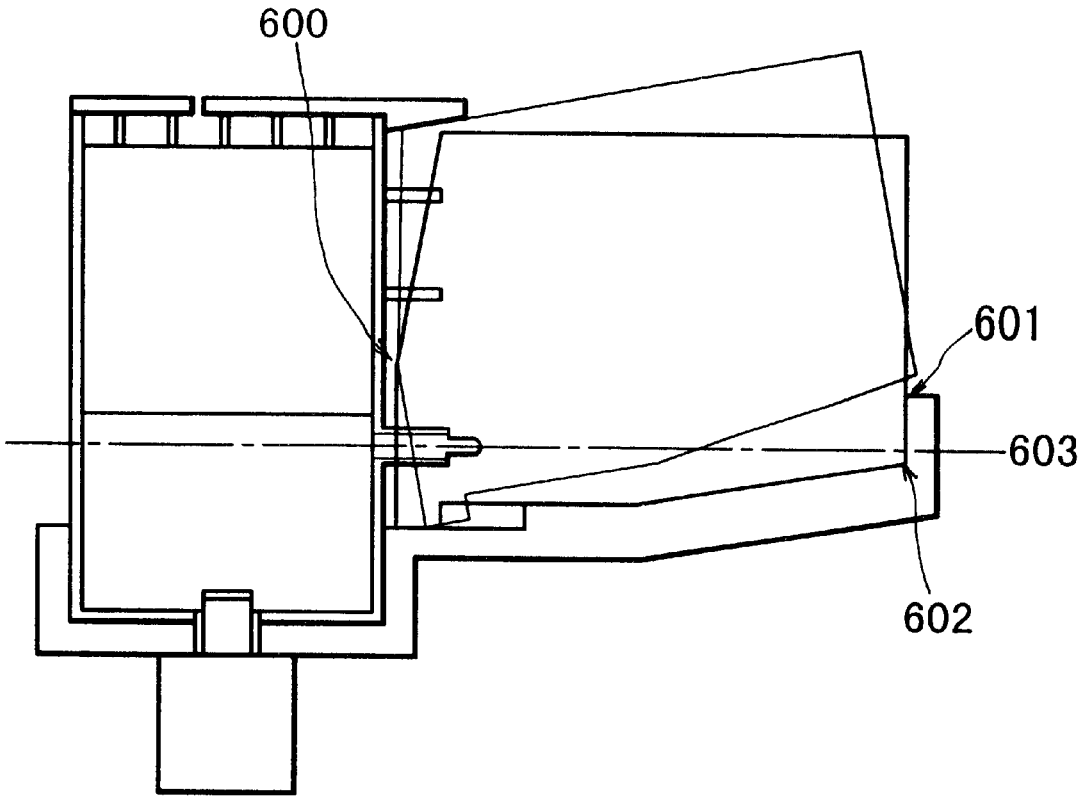
FIG. 22 is a schematic drawing for depicting the rotation of the ink container unit illustrated in FIG. 2, which is caused when the ink container unit is installed or removed.

Referring to FIGS. 2 and 22, the bottom wall of the ink storing container 201 is slanted upward toward the rear, and is engaged with the ink containing unit engagement portion 155 of the holder 150, by the bottom rear portion, that is, the portion opposite to the ink outlet side. The holder 150 and ink container unit 200 are structured so that when removing the ink container unit 200 from the holder 150, the portion of the ink storing container 201, which is in contact with the ink containing portion engagement portion 155, can be moved upward. In other words, when the ink container unit 200 is removed, the ink container unit 200 is rotated by a small angle. In this embodiment, the center of this rotation virtually coincides with the supply outlet opening (joint opening 230). However, strictly speaking, the position of this rotational center shifts as will be described later. In the case of the above described structural arrangement, which requires the ink container unit 200 to be rotationally moved to be disengaged from the holder 150, the greater the difference by which the distance (A) from the rotational center of the ink container unit 200 to the bottom rear corner of the ink container unit 200 corresponding to the ink containing unit engagement portion 155, is longer than the distance (B) from the same rotational center to the ink containing unit engagement portion 155, the more frictionally do the bottom rear corner of the ink container unit 200 and the image containing unit engagement portion 155 rub against each other, requiring a substantially greater amount of force to install the ink container unit 200, which sometimes causes problems such as deformation of the contact areas on both the ink container unit 200 side and holder 150 side.

Slanting the bottom wall of the ink storing container 201 so that the position of the ink containing portion engagement portion 155 side of the bottom wall of the ink storing container 201 becomes higher than that of the front end of the ink storing container 201, as in this embodiment, prevents the ink container unit 200 from heavily rubbing against the holder 150 during its rotational motion. Therefore, the ink container unit 200 can be smoothly installed or removed.

In this embodiment, the joint opening 230 of the ink jet head cartridge is located in the bottom portion of the sidewall of the ink storing container 201, on the negative pressure controlling chamber unit side, and the bottom portion of another wall of the ink storing container 201, that is, the wall opposite to the wall in which the joint opening 230 is located is engaged with the ink container engagement portion 155; in other words, the bottom rear portion of the ink storing container 201 is engaged with the ink storing container engagement portion 155. Also, the ink storing container engagement portion 155 extends upward from the bottom wall of the holder 150, so that the position of the top portion of the ink storing container engagement portion 155 becomes approximately the same as the position 603 of the horizontal center line of the joint opening 230, in terms of the vertical direction. With this arrangement, it is assured that the horizontal movement of the joint opening 230 is regulated by the ink storing container engagement portion 155 to keep the joint opening 230 correctly connected with the joint pipe 180. In this embodiment, in order to assure that the joint opening 230 is correctly connected with the joint pipe 180 during the installation of the ink container unit 200, the top end of the ink storing container engagement portion 155 is positioned at approximately the same height as the upper portion of the joint opening 230, and the ink container unit 200 is removably installed into the holder 150 by rotating the ink container unit 200 about a portion of the front surface of the ink container unit 200 on the joint opening 230 side. During the removal of the ink container unit 200, the portion of the ink container unit 200 which remains in contact with the negative pressure controlling chamber unit 100 functions as the rotational center for the ink container unit 200. As is evident from the above description, making the bottom wall of the ink storing container 201 of the ink jet head cartridge slanted upward toward its bottom rear portion as described above reduces the difference between the distance from the rotational center 600 to the top end of the ink storing container engagement portion, and the distance from the rotational center 600 to the bottom end of the ink storing container engagement portion. Therefore, the portions of the ink container unit 200, which make contact with the holder 150, and the portions of the holder 150, which make contact with the ink container unit 200, are prevented from strongly rubbing against each other. Therefore, the ink container unit 200 can be smoothly installed or removed.

By shaping the ink storing container 201 and holder 150 as described above, it is possible to keep relatively small the size of the portion of the bottom rear portion of the ink storing container 201, which rubs against the ink storing container engagement portion 155 during the installation or removal of the ink container unit 200, and the size of the portion of the ink storing container engagement portion 155, which rubs against the bottom rear portion of the ink storing container 201, even if the joint opening 230 is enlarged to deliver ink at a greater volumetric rate. Therefore, the ink container unit 200 is prevented from uselessly rubbing against the ink storing container engagement portion 155 during the installation of the ink container unit 200 into the holder 150, and yet, it is assured that the ink container unit 200 remains firmly attached to the holder 150.

Next, referring to FIG. 22, the movement of the ink container unit 200 during its installation or removal will be described in detail. When the distance from the rotational center 600, about which the ink container unit 200 rotates during its installation or removal, to the bottom end 602 of the ink container engagement portion, is greater than the distance from the same rotational center 600 to the top end 601 of the ink container engagement portion, by an excessive margin, the force necessary for the installation or removal of the ink container unit 200 is excessively large, and therefore, it sometimes occurs that the top end 601 of the ink container engagement portion is shaved, or the ink storing container 201 deforms.

Thus, the difference between the distance from the rotational center 600, about which the ink container unit 200 rotates during its installation or removal, to the bottom end 602 of the ink container engagement portion, and the distance from the same rotational center 600 to the top end 601 of the ink container engagement portion, should be as small as possible within a range in which the ink container unit 200 is retained in the holder 150 with a proper degree of firmness while affording smooth installation or removal of the ink container unit 200.

If the position of the rotational center 600 of the ink container unit 200 is made lower than the position of the center of the joint opening 230, the distance from the rotational center 600, about which the ink container unit 200 rotates during its installation or removal, to the top end 601 of the ink container engagement portion, becomes longer than the distance from the same rotational center 600 to the bottom end 602 of the ink container engagement portion. Therefore, it becomes difficult to accurately hold the ink storing container 201 at a point which is at the same height as the center of the joint opening 230. Thus, in order to accurately position the vertical center of the joint portion 230, it is desired that the position of the rotational center 600 of the ink container unit 200 is higher than the position of the vertical center of the joint opening 230.

If the structure of the ink container unit 200 is changed so that the position of the rotational center 600 of ink container unit 200 becomes higher than the position 603 of the vertical center of the joint opening 230, the portion of the ink container unit 200, which corresponds to the ink container engagement portion 155, becomes thicker, requiring the height of the ink storing container engagement portion 155 to be increased. As a result, there will be an increased possibility that the ink container unit 200 and holder 150 will be damaged. Thus, it is desired, in view of the smoothness of the installation or removal of the ink container unit 200, that the position of the rotational center 600 of the ink container unit 200 is close to the vertical center of the joint opening 230. The height of the ink container engagement portion 155 of the holder 150 has to be properly determined based only on the ease of the installation or removal of the ink container unit 200. However, if the height of the ink container engagement portion 155 is increased so that the position of its top end becomes higher than that of the rotational center 600, the length by which the ink container unit 200 contacts the ink container engagement portion 155 of the holder 150 becomes greater, which in turn increases the sizes of the portions on both sides, which rub against each other. Therefore, in consideration of the deterioration of the ink container unit 200 and holder 150, the height of the ink container engagement portion 155 is such that the position of its top end is lower than that of the rotational center 600.

In the ink jet head cartridge in this embodiment, the elastic force for keeping the position of the ink storing container 201 fixed in terms of the horizontal direction is a combination of the force generated by the resilient member 263 for pressing the valve plug 261, and the force generated by the resiliency of the rubber joint portion 280 (FIG. 4). However, the configuration for generating the above resiliency does not need to be limited to the one in this embodiment; the bottom rear end, or the engagement portion, of the ink storing container 201, the surface of the ink storing container engagement portion 155, on the ink storing container side, the negative pressure controlling chamber unit 100, or the like, may be provided with an elastic force generating means for keeping the position of the ink storing container 201 fixed in terms of the horizontal direction. When the ink storing container is in connection with the negative pressure controlling chamber, the rubber joint portion 280 remains compressed between the walls of the negative pressure controlling chamber and ink storing container, assuring that the joint portion (peripheral portion of the joint pipe) is airtightly sealed (it is not necessary to maintain perfect airtightness as long as the size of the area exposed to the outside air can be minimized). Also, the rubber joint portion 280 plays an auxiliary role in coordination with a sealing projection, which will be described later.

Next, the internal structure of the negative pressure controlling chamber unit 100 will be described.

In the negative pressure controlling chamber unit 100, the absorbent material pieces 130 and 140 are disposed in layers as members for generating negative pressure, the former being on top of the latter. Thus, the absorbent material piece 130 is exposed to the outside air through the air vent 115, whereas the absorbent material piece 140 is airtightly in contact with the absorbent material piece 130, at its top surface, and also is airtightly in contact with the filter 161 at its bottom surface. The position of the interface between the absorbent material pieces 130 and 140 is such that when the ink jet head cartridge is placed in the same attitude as the ink jet head cartridge is in use, it is higher than the position of the uppermost portion of the joint pipe 180 as a liquid passage.

The absorbent material pieces 130 and 140 are formed of fibrous material, and are held in the negative pressure controlling chamber shell 110, so that in the state in which the ink jet head cartridge 70 has been properly installed into the printer, its fibers extend in substantially the same, or primary, direction, being angled (preferably, in the virtually horizontal direction as they are in this embodiment) relative to the vertical direction.

As for the material for the absorbent material pieces 130 and 140, the fibers of which are arranged in virtually the same direction, short (approximately 60 mm) crimped mixed strands of fiber formed of thermoplastic resin (polypropylene, polyethylene, and the like) are used. In production, a wad of such strands is put through a carding machine to parallel the strands, is heated (heating temperature is desired to be set higher than the melting point of polyethylene, which is relatively low, and lower than the molding point of polypropylene, which is relatively high), and then, is cut to a desired length. The fiber strands of the absorbent material pieces in this embodiment are greater in the degree of alignment in the surface portion than in the center portion, and therefore, the capillary force generated by the absorbent members is greater in the surface portion than in the center portion. However, the surfaces of the absorbent material pieces are not as flat as a mirror surface. In other words, they have a certain amount of unevenness which results mainly when the slivers are bundled; they are three dimensional, and the intersections of the slivers, at which they are welded to each other, are exposed from the surfaces of the absorbent material pieces. Thus, in strict terms, the interface 113*c* between the absorbent material pieces 130 and 140 is an interface between the two uneven surfaces, allowing ink to flow by a proper amount in the horizontal direction along the interface 113*c* and also through the adjacencies of the interface 113*c*. In other words, it does not occur that ink is allowed to flow far more freely along the interface 113*c* than through its adjacencies, and therefore, an ink path is formed through the gaps between the walls of the negative pressure controlling chamber shell 110 and absorbent material pieces 130 and 140, and along the interface 113*c*. Thus, by making a structural arrangement so that the interface 113*c* between the absorbent material pieces 130 and 140 is above the uppermost portion of the joint pipe 180, preferably, above and close to the uppermost portion of the joint pipe 180 as in this embodiment, when the ink jet head cartridge is positioned in the same attitude as it is when in use, the position of the interface between the ink and gas in the absorbent material pieces 130 and 140 during the gas-liquid exchange, which will be described later, can be made to coincide with the position of the interface 113*c*. As a result, the negative pressure in the head portion during the ink supplying operation can be stabilized.

Figure 20:
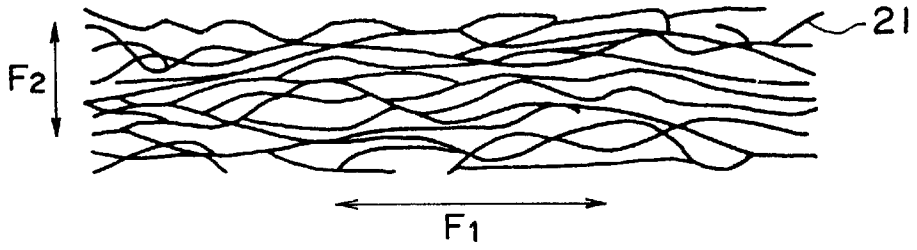
FIG. 20 is a schematic drawing for depicting the absorbent material in the negative pressure controlling chamber shell illustrated in FIG. 2.

Referring to FIG. 20, if attention is paid to the directionality of the strands of fiber in any portion of the fibrous absorbent material piece, it is evident that plural strands of fiber are extended in a direction F1, or the longitudinal direction of the absorbent material piece, in which the strands have been arranged by a carding machine. In terms of the direction F2 perpendicular to the direction F1, the strands are connected to each other by being fused to each other at their intersections during the aforementioned heating process. Therefore, the fiber strands in the absorbent material pieces 130 and 140 are not likely to be separated from each other when the absorbent material pieces 130 or 140 is stretched in the direction F1. However, the fiber strands which are not likely to separate when pulled in the direction F1 can be easily separated at the intersections at which they have been fused with each other if the absorbent material piece 130 or 140 is stretched in the direction F2.

Since the absorbent material pieces 130 and 140 formed of the fiber strands possess the above described directionality in terms of the strand arrangement, the primary fiber direction, that is, the fiber direction F1 is different from the fiber direction F2 perpendicular to the direction F1 in terms of how ink flows through the absorbent pieces, and also in terms of how ink is statically held therein.

Figure 21A:
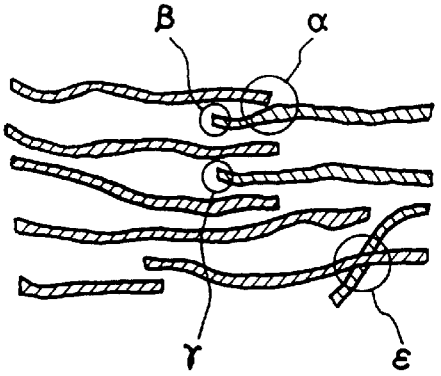
FIGS. 21A and 21B are also schematic drawings for depicting the absorbent material in the negative pressure controlling chamber shell illustrated in FIG. 2.
Figure 21B:
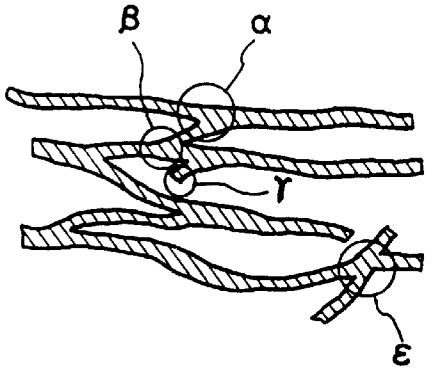

To look at the internal structures of the absorbent material pieces 130 and 140 in more detail, the state of a wad of short strands of fiber crimped and carded as shown in FIG. 21A changes to the state shown in FIG. 21B as it is heated. More specifically, in a region a in which plural short strands of crimped fiber extend in an overlapping manner, more or less in the same direction, the fiber strands are likely to be fused to each other at their intersections, becoming connected as shown in FIG. 21B and therefore, difficult to separate in the direction F1 in FIG. 20. On the other hand, the 21 tips of the short strands of crimped fiber (tips β and γ in FIG. 21A) are likely to three-dimensionally fuse with other strands like the tip β in FIG. 21B or remain unattached like the tip γ in FIG. 21B. However, all the strands do extend in the same direction. In other words, some strands extend in the nonconforming direction and intersect with the adjacent strands (region ϵ in FIG. 21A) even before heat is applied, and as heat is applied, they fuse with the adjacent strands in the position they are in, (region ϵ in FIG. 21B.) Thus, compared to a conventional absorbent piece constituted of a bundle of unidirectionally arranged strands of fiber, the absorbent members in this embodiment are also far more difficult to split in the direction F2.

Further, in this embodiment, the absorbent pieces 130 and 140 are disposed so that the primary fiber strand direction F1 in the absorbent pieces 130 and 140 becomes nearly parallel to the horizontal direction and the line which connects the joint portion and the ink supply outlet. Therefore, after the connection of ink storing container 201, the gas-liquid interface L (interface between ink and gas) in the absorbent piece 140 becomes nearly horizontal, that is, virtually parallel to the primary fiber strand direction F1, remaining virtually horizontal even if ambient changes occur, and as the ambience settles, the gas-liquid interface L returns to its original position. Thus, the position of the gas-liquid interface in terms of the gravitational direction is not affected by the number of the cycles of the ambient change.

Thus, even when the ink container unit 200 is replaced with a fresh one because the ink storing container 201 has run out of ink, the gas-liquid interface remains virtually horizontal, and therefore, the size of the buffering space 116 does not decrease no matter how many times the ink container unit 200 is replaced.

All that is necessary in order to keep the position of the gas-liquid interface stable in spite of the ambient changes during the gas-liquid exchange is that the fiber strands in the region immediately above the joint between the negative pressure controlling chamber unit 100 and ink container unit 200 (in the case of this embodiment, above the position of the joint pipe 180), preferably inclusive of the adjacencies of the region immediately above the joint, are extended in the more or less horizontal direction. From a different viewpoint, all that is necessary is that the above described region is between the ink delivery interface and the joint between the negative pressure controlling chamber unit 100 and ink container unit 200. From another viewpoint, all that is necessary is that the position of this region is above the gas-liquid interface while gas-liquid exchange is occurring. To analyze the latter viewpoint with reference to the functionality of this region in which the fiber strands posses the above described directionality, this region contributes to keeping horizontal the gas-liquid interface in the absorbent piece 140 while the liquid is supplied through the gas-liquid exchange; in other words, the region contributes to regulate the changes which occur in the vertical direction in the absorbent material piece 140 in response to the movement of the liquid into the absorbent material piece 140 from the ink storing container 201.

The provision of the above described region or layer in the absorbent material piece 140 makes it possible to reduce the unevenness of the gas-liquid interface L in terms of the gravity direction. Further, it is desired that the fiber strands in the aforementioned region or layer be arranged so that they appear to extend in parallel in the aforementioned primary direction even when they are seen from the direction perpendicular to the horizontal direction of the absorbent material piece 140, because such an arrangement enhances the effect of the directional arrangement of the fiber strands in the more or less parallel manner in the primary direction.

Regarding the direction in which the fiber strands are extended, theoretically, when the general direction in which the fiber strands are extended is angled relative to the vertical direction, the above described effect can be provided, although the amount of effect may be small if the angle is small. In practical terms, as long as the above described angle was in a range of ±30° relative to the horizontal direction, the effect was clearly confirmed. Thus, the term "more or less" in the phrase "more or less horizontal" in this specification includes the above range.

Figure 6:
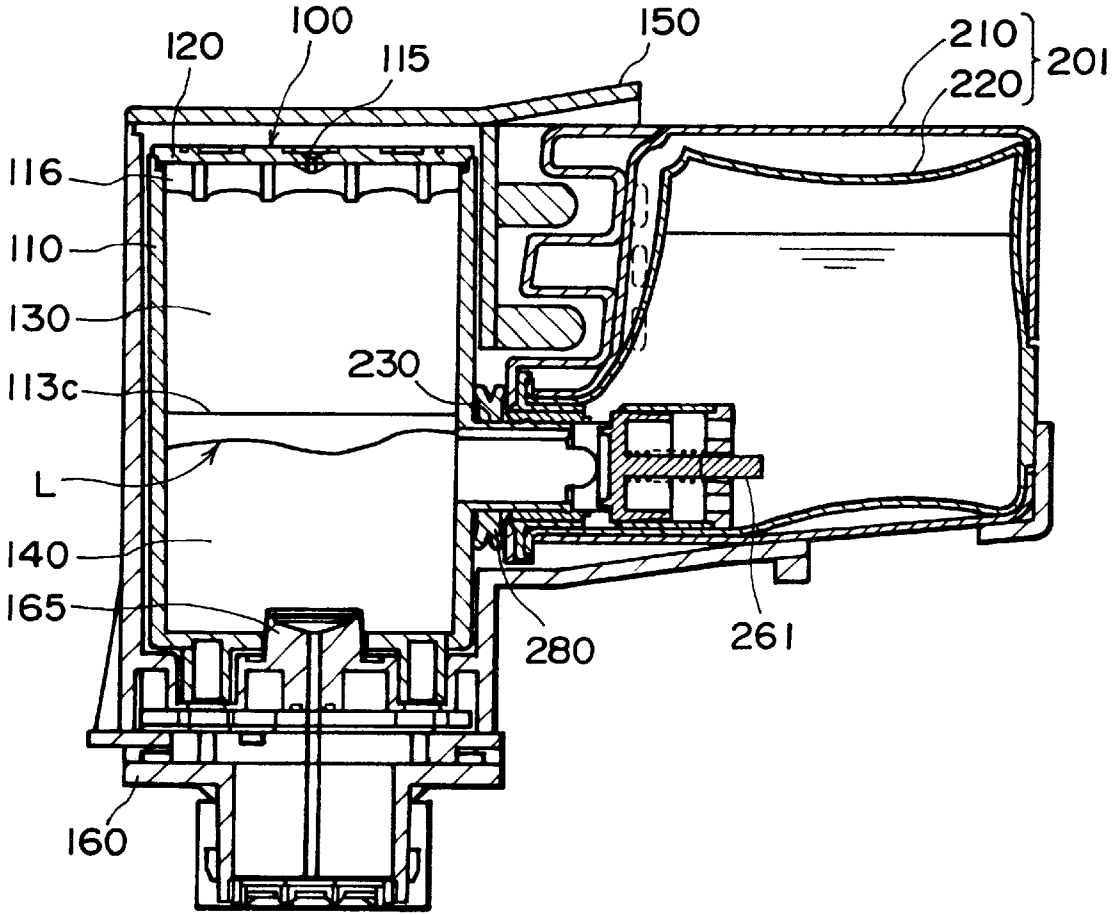
FIG. 6 is a sectional drawing for depicting the operation for supplying the ink jet head cartridge illustrated in FIG. 2, with ink.

In this embodiment, the fiber strands in the absorbent material piece 140 are extended more or less in parallel in the primary direction also in the region below and adjacent to the joint portion, preventing therefore the gas-liquid interface L from becoming unpredictably uneven in the region below the uppermost portion of the joint portion, as shown in FIG. 6, during the gas-liquid exchange. Therefore, it does not occur that the ink jet head cartridge fails to be supplied with a proper amount of ink due to the interruption of ink delivery.

More specifically, during the gas-liquid exchange, the outside air introduced through the air vent 115 reaches the gas-liquid interface L. As it reaches the interface L, it is dispersed along the fiber strands. As a result, the interface L is kept more or less horizontal during the gas-liquid exchange; it remains stable, assuring that the ink is supplied while a stable amount of negative pressure is maintained. Since the primary direction in which the fiber strands are extended in this embodiment is more or less horizontal, the ink is consumed through the gas-liquid exchange in such a manner that the top surface of the ink remains more or less horizontal, making it possible to provide an ink supplying system which minimizes the amount of the ink left unused, even the amount of the ink left unused in the negative pressure controlling chamber shell 110. Therefore, in the case of an ink supplying system such as the system in this embodiment which allows the ink containing unit 200, in which liquid is directly stored, to be replaced, it is easier to provide the absorbent material pieces 130 and 140 with regions in which ink is not retained. In other words, it is easier to increase the buffering space ratio, to provide an ink supplying system which is substantially more resistant to the ambient changes than a conventional ink supplying system.

When the ink jet head cartridge in this embodiment is the type of cartridge mountable in a serial type printer, it is mounted on a carriage which is shuttled. As this carriage is shuttled, the ink in the ink jet head cartridge is subjected to the force generated by the movement of the carriage, more specifically, the component of the force in the direction of the carriage movement. In order to minimize the adverse effects of this force upon the ink delivery from the ink container unit 200 to ink jet head unit 160, the direction of the fiber strands in the absorbent material pieces 130 and 140 and the direction in which the ink container unit 200 and negative pressure controlling chamber unit 100 are connected, are desired to coincide with the direction of the line which connects the joint opening 230 of the ink container unit 200 and the ink outlet 131 of the negative pressure controlling chamber shell 110.

<Operation for Installing Ink Containing Unit>

Next, referring to FIGS. 4A to 4D, the operation for installing the ink containing unit 200 into the integral combination of the negative pressure controlling chamber unit 100 and holder 150 will be described.

FIGS. 4A to 4D are sectional drawings for depicting the operation for installing the ink container unit 200 into the holder 150 to which the negative pressure controlling chamber unit 100 has been attached. The ink container unit 200 is installed into the holder 150 by being moved in the direction F as well as the direction G, while being slightly rotated by being guided by the unillustrated lateral guides, the bottom wall of the holder 150, the guiding portions 121 with which the negative pressure controlling chamber cover 120 of the negative pressure controlling chamber unit 100, the ink container engagement portion 155, that is, the rear end portion of the holder 150.

More specifically, the installation of the ink container unit 200 occurs as follows. First, the ink container unit 200 is moved to a point indicated in FIG. 4A that is, the point at which the slanted surface 251 of the ink container unit 200 comes into contact with the ID members 170 with which the negative pressure controlling chamber unit 100 is provided to prevent the wrong installation of the ink container unit 200. The holder 150 and ink container unit 200 are structured so that at the point in time when the above described contact occurs, the joint pipe 180 has yet to enter the joint opening 230. If a wrong ink container unit 200 is inserted, the slanted surface 251 of the wrong ink container unit 200 collides with the ID members 170 at this point in time, preventing the wrong ink container unit 200 from being inserted further. With this structural arrangement of the ink jet head cartridge 70, the joint opening 230 of the wrong ink container unit 200 does not make contact with joint pipe 180. Therefore, the problems which occur at the joint portion as a wrong ink container unit 200 is inserted, for example, the mixture of inks with different color, and the solidification of ink in the absorbent material pieces 130 and 140 (anions in one type of ink react with cations in another type of ink), which might cause the negative pressure controlling chamber unit 100 to stop functioning, can be prevented, and therefore, it will never occurs that the head and ink containing portion of an apparatus, the ink containing portions of which are replaceable, needs to be replaced due to the occurrence of such problems. Further, since the ID portions of the ID member 250 are provided on the slanted surface of the ID member, the plurality of ID members 170 can be almost simultaneously fitted into the correspondent ID slots to confirm that a correct ink container unit 200 is being inserted; a reliable installation mistake prevention mechanism is provided.

Figure 4A:
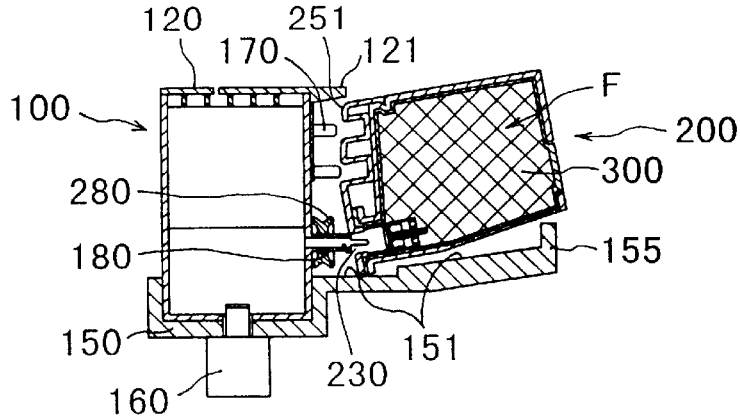
FIGS. 4A to 4D are sectional drawings for depicting the operation for attaching the ink container unit to a holder to which the negative pressure controlling chamber unit illustrated in FIG. 2 has been attached.
Figure 4B:
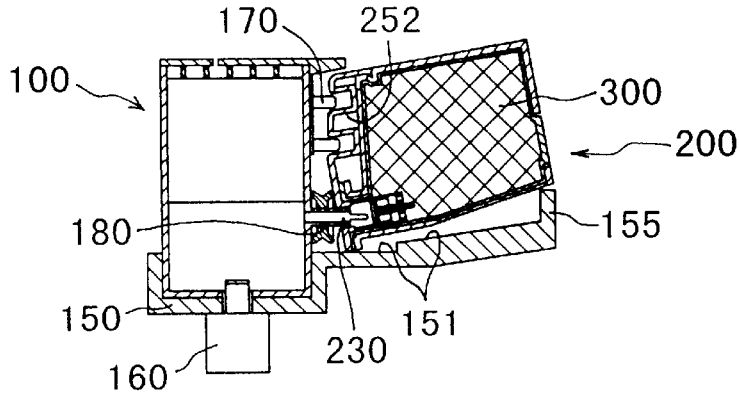
Figure 4C:
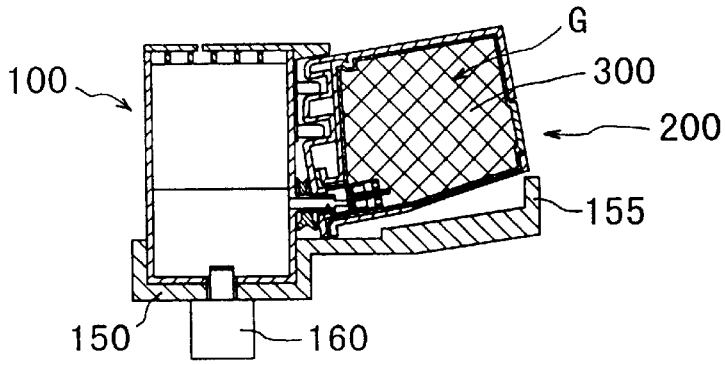

In the next step, the ink container unit 200 is moved toward the negative pressure controlling chamber unit 100 so that the ID members 170 and joint pipe 180 are inserted into the ID member slots 252 and joint opening 230, respectively, at the same time, as shown in FIG. 4B until the leading end of the ink container unit 200 reaches the negative pressure controlling chamber unit 100 as shown in FIG. 4C. Next, the ink container unit 200 is rotationally moved in the direction indicated by an arrow mark G. During the rotational movement of the ink container unit 200, the tip of the joint pipe 180 comes into contact with the valve plug 261 and pushes it. At a result, the valve mechanism opens, allowing the internal space of the ink container unit 200 to be connected to the internal space of the negative pressure controlling chamber unit 100, in other words, enabling the ink 300 in the ink container unit 200 to be supplied into the negative pressure controlling chamber unit 100. The detailed description of the opening or closing movement of this valve mechanism will be given later.

Next, the ink container unit 200 is further rotated in the direction of the arrow mark G, until the ink container unit 200 settles as shown in FIG. 2. As a result, the bottom rear end portion of the ink container unit 200 becomes engaged with the ink container engagement portion 155 of the holder 150; in other words, the ink container unit 200 is correctly placed in the predetermined space for the ink container unit 200. During this second rotational movement of the ink container unit 200, the ID members 170 slightly come out of the ID member slots 252. The rearward force for correctly retaining the ink container unit 200 in the ink container unit space is generated toward the ink container engagement portion 155 of the holder 150 by the resilient member 263 in the ink container unit 200 and the rubber joint portion 280 fitted around the joint pipe 180.

Since the ID member slots 252 are provided in the slanted front wall of the ink container unit 200 which is rotationally installed or removed, and also, the bottom wall of the ink container unit 200 is slanted, it is possible to minimize the space necessary to assure that the ink container unit 200 is installed or removed without making mistakes or mixing inks of different color.

Figure 4D:
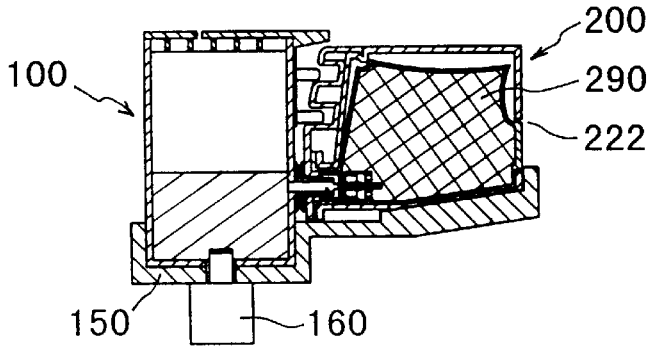

As soon as the ink container unit 200 is connected with the negative pressure controlling chamber unit 100 as described above, the ink moves until the internal pressure of the negative pressure controlling chamber unit 100 and the internal pressure of the ink storing container 201 equalize to realize the equilibrium state illustrated in FIG. 4D in which the internal pressure of the joint pipe 180 and joint opening 230 remains negative (this state is called "initial state of usage").

At this time, the ink movement which results in the aforementioned equilibrium will be described in detail.

The valve mechanism provided in the joint opening 230 of the ink storing container 201 is opened by the installation of the ink container unit 200. Even after the opening of the valve mechanism, the ink holding portion of the ink storing container 201 remains virtually sealed except for the small passage through the joint pipe 230. As a result, the ink in the ink storing container 201 flows into the joint opening 230, forming an ink path between the internal space of the ink storing container 201 and the absorbent material piece 140 in the negative pressure controlling chamber unit 100. As the ink path is formed, the ink begins to move from the ink storing container 201 into the absorbent material piece 140 because of the capillary force of the absorbent material piece 140. As a result, the ink-gas interface in the absorbent material piece 140 rises. Meanwhile, the internal bladder 220 begins to deform, starting from the center portion of the largest wall, in the direction to reduce the internal volume.

The external shell 210 functions to impede the displacement of the corner portions of the internal bladder 220, countering the deformation of the internal bladder 220 caused by the ink consumption. In other words, it works to preserve the pre-installation state of the internal bladder 220 (initial state illustrated in FIGS. 4A to 4C). Therefore, the internal bladder 220 produces and maintains a proper amount of negative pressure correspondent to the amount of deformation, without suddenly deforming. Since the space between the external shell 210 and internal bladder 220 is connected to the outside through the air vent 222, air is introduced into the space between the external shell 210 and internal bladder 220 in response to the aforementioned deformation.

Even if air is present in the joint opening 230 and joint pipe 180, this air easily moves into the internal bladder 220 because the internal bladder 220 deforms as the ink in the internal bladder 220 is drawn out through the ink path formed as the ink from the ink storing container 201 comes into contact with the absorbent material piece 140.

The ink movement continues until the amount of the static negative pressure in the joint opening 230 of the ink storing container 201 becomes the same as the amount of the static negative pressure in the joint pipe 180 of the negative pressure controlling chamber unit 100.

As described above, the ink movement from the ink storing container 201 into the negative pressure controlling chamber unit 100, which is triggered by the connection of the ink storing container 201 with the negative pressure controlling chamber unit 100, continues without the introduction of gas into the ink storing container 201 through the absorbent material pieces 130 and 140. What is important to this process is to configure the ink storing container 201 and negative pressure controlling chamber unit 100 according to the type of a liquid jet recording means to which the ink container unit 200 is connected, so that the static negative pressures in the ink storing container 201 and negative pressure controlling chamber unit 100 reach proper values for preventing ink from leaking from the liquid jet recording means such as the ink jet head unit 160 which is connected to the ink outlet of the negative pressure controlling chamber unit 100.

The amount of the ink held in the absorbent material piece 130 prior to the connection varies. Therefore, some regions in the absorbent piece 140 remain unfilled with ink. These regions can be used as the buffering regions.

On the other hand, sometimes the internal pressures of the joint pipe 180 and joint opening 230 are caused to become positive due to the aforementioned variation. When there is such a possibility, a small amount of ink may be flowed out by performing a recovery operation with a suction-based recovering means, with which the main assembly of a liquid jet recording apparatus is provided, to deal with the possibility. This recovery means will be described later.

As described before, the ink container unit 200 in this embodiment is installed into the holder 150 through a movement which involves a slight rotation; it is inserted at an angle while resting on the ink container engagement portion 155 of the holder 150, by its bottom wall, and after the bottom rear end of the ink container unit 200 goes over the ink container engagement portion 155, it is pushed downward into the holder 150. When the ink container unit 200 is removed from the holder 150, the above described steps are reversely taken. The valve mechanism with which the ink container unit 200 is provided is opened or closed as the ink container unit 200 is installed or removed, respectively.

<Opening or Closing of Valve Mechanism>

Figure 5A:
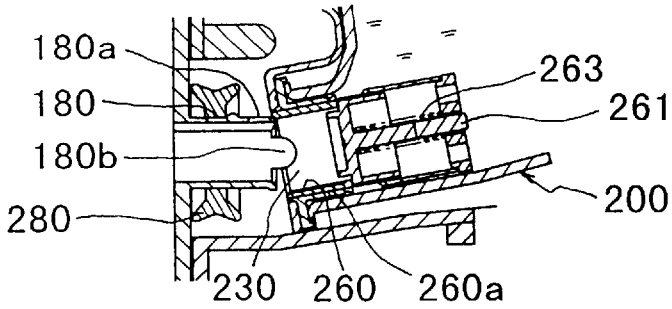
FIGS. 5A to 5E are sectional drawings for depicting the opening and closing operations of the valve mechanism to which the present invention is applicable.
Figure 5B:
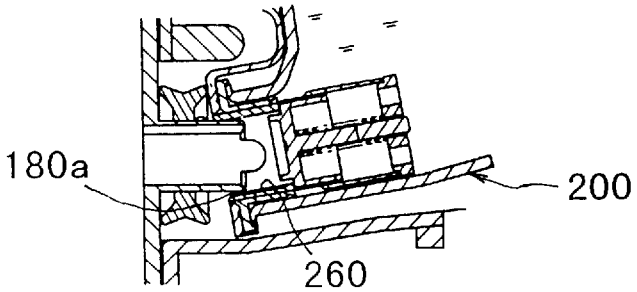

Hereinafter, referring to FIGS. 5A to 5E, the operation for opening or closing the valve mechanism will be described. FIG. 5A shows the states of the joint pipe 180 and its adjacencies, and the joint opening 230 and its adjacencies, immediately before the joint pipe 180 is inserted into the joint opening 230, but after the ink container unit 200 was inserted into the holder 150 at an angle so that the joint opening 230 tilts slightly downward.

The joint pipe 180 is provided with a sealing projection 180*a*, which is integrally formed with the joint pipe 180, and extends on the peripheral surface of the joint pipe 180, encircling the peripheral surface of the joint pipe 180. It is also provided with a valve activation projection 180*b*, which forms the tip of the joint pipe 180. The sealing projection 180*a* comes into contact with the joint sealing surface 260 of the joint opening 230 as the joint pipe 180 is inserted into the joint opening 230. The sealing projection 180*a* extends around the joint pipe 180 at an angle so that the distance from the uppermost portion of the sealing projection 180*a* to the joint sealing surface 260 becomes greater than the distance from the bottommost portion of the sealing projection 180*a* to the joint sealing surface 260.

When the ink container unit 200 is installed or removed, the joint sealing surface rubs against the sealing projection 180*a*, as will be described later. Therefore, the material for the sealing projection 180*a* is desired to be such material that is slippery and yet capable of sealing between itself and an object it contacts. The configuration of the resilient member 263 for keeping the valve plug 26*a* pressed upon or toward the first valve body 260*a* does not need to be limited to a particular one; a springy member such as a coil spring or a plate spring, or a resilient member formed of rubber or the like, may be employed. However, in consideration of recycling, a resilient member formed of resin is preferable.

In the state depicted in FIG. 5A the valve activation projection 180*b* is yet to make contact with the valve plug 261, and the seal portion of the valve plug 261, provided at the periphery of the joint pipe 180, on the joint pipe side, is in contact with the seal portion of the first valve body 260*a*, with the valve plug 261 being under the pressure from the resilient member 263. Therefore, the ink container unit 200 remains airtightly sealed.

Figure 5C:
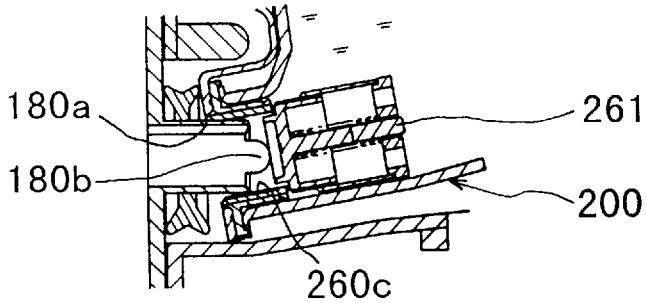

As the ink container unit 200 is inserted further into the holder 150, the joint portion is sealed at the sealing surface 260 of the joint opening 230 by the sealing projection 180*a*. During this sealing process, first, the bottom side of the sealing projection 180*a* comes into contact with the joint sealing surface 260, gradually increasing the size of the contact area toward the top side of the sealing projection 180*a* while sliding against the joint sealing surface 260. Eventually, the top side of the sealing projecting 180*a* comes into contact with the joint sealing surface 260 as shown in FIG. 5C. As a result, the sealing projection 180*a* makes contact with the joint sealing surface 260, by the entire peripheral surface, sealing the joint opening 230.

In the state illustrated in FIG. 5C, the valve activation projection 180*b* is not in contact with the valve plug 261, and therefore, the valve mechanism is not open. In other words, before the valve mechanism is opened, the gap between the joint pipe 180 and joint opening 230 is sealed, preventing ink from leaking from the joint opening 230 during the installation of the ink container unit 200.

Further, as described above, the joint opening 230 is gradually sealed from the bottom side of the joint sealing surface 260. Therefore, until the joint opening 230 is sealed by the sealing projection 180*a*, the air in the joint opening 230 is discharged through the gap between the sealing projection 180*a* and joint sealing surface 260. As the air in the joint opening 230 is discharged as described above, the amount of the air remaining in the joint opening 230 after the joint opening 230 is sealed is minimized, preventing the air in the joint opening 230 from being excessively compressed by the invasion of the joint pipe 180 into the joint opening 230, in other words, preventing the internal pressure of the joint opening 230 from rising excessively. Thus, it is possible to prevent the phenomenon that before the ink container unit 200 is completely installed into the holder 150, the valve mechanism is inadvertently opened by the increased internal pressure of the joint opening 230, and ink leaks into the joint opening 230.

Figure 5D:
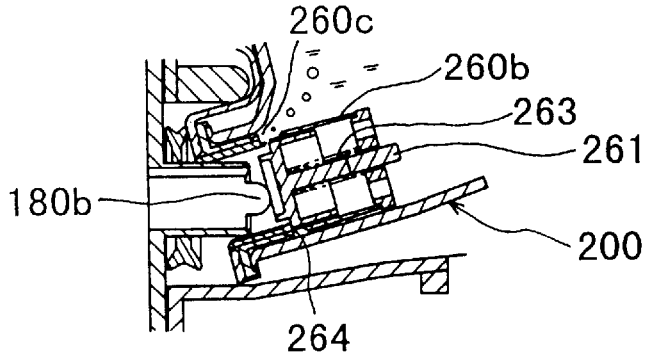

As the ink container unit 200 is further inserted, the valve activation projection 180*b* pushes the valve plug 261 against the resiliency of the resilient member 263, with the joint opening 230 remaining sealed by the sealing projection 180*a*, as shown in FIG. 5D. As a result, the internal space of the ink storing container 201 becomes connected to the internal space of the joint opening 230 through the opening 260*c* of the second valve body 26. Consequently, the air in the joint opening 230 is allowed to be drawn into the ink container unit 200 through the opening 260*c*, and the ink in the ink container unit 200 is supplied into the negative pressure controlling chamber shell 110 (FIG. 2).

As the air in the joint opening 230 is drawn into the ink container unit 200 as described above, the negative pressure in the internal bladder 220 (FIG. 2) is reduced, for example, when an ink container unit 200 the ink in which has been partially consumed is re-installed. Therefore, the balance in the internal negative pressure between the negative pressure controlling chamber shell 110 and internal bladder 220 is improved, preventing the ink from being inefficiently supplied into the negative pressure controlling chamber shell 110 after the re-installation of the ink container unit 200.

Figure 5E:
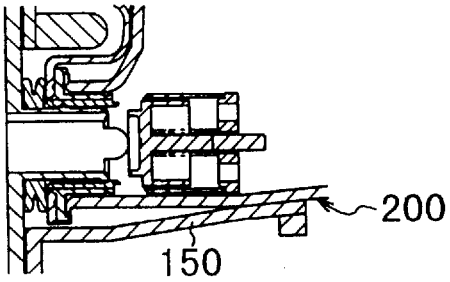

After the completion of the above described steps, the ink container unit 200 is pushed down onto the bottom wall of the holder 150 to finish installing the ink container unit 200 into the holder 150 as shown in FIG. 5E. As a result, the joint opening 230 is perfectly connected to the joint pipe 180, realizing the aforementioned state which assures that gas-liquid exchange occurs flawlessly.

In this embodiment, the opening 260*c* of the second valve body 260*b* is located adjacent to the valve body seal portion 264 and on the bottom side of the ink container unit 200. According to the configuration of this opening 260, during the opening of the valve mechanism, more specifically, immediately after the valve plug 261 is moved toward the valve cover 262 by being pushed by the valve activation projection 180*b*, the ink in the ink container unit 200 begins to be supplied into the negative pressure controlling chamber unit 100. Also, it is possible to minimize the amount of the ink which remains in the ink container unit 200 when the ink container unit 200 needs to be discarded because the ink therein can no longer be drawn out.

Also in this embodiment, elastomer is used as the material for the joint sealing surface 260, that is, the seal portion, of the first valve body 260*a*. With the use of elastomer as the material for the joint sealing surface 260, it is assured that because of the resilience of the elastomer, the joint between the joint sealing surface 260 and the sealing projection 180*a* of the joint pipe 180 is perfectly sealed, and also, the joint between the seal portion of the first valve body 260*a* and the correspondent seal portion of the valve plug 261 is perfectly sealed. In addition, by providing the elastomer with an amount of resiliency exceeding the minimum amount of resiliency necessary to assure that the joint between the first valve body 260*a* and joint pipe 180 is perfectly sealed (for example, by increasing the thickness of the elastomer layer), the flexibility of elastomer compensates for the effects of the misalignment, twisting, and/or rubbing, which occur at the contact point between the joint pipe 180 and valve plug 261 during the serial scanning movement of an ink jet head cartridge; it is doubly assured that the joint remains perfectly sealed. The joint sealing surface 260, the material for which is elastomer, can be integrally formed with the first valve body 260*a*, making it possible to provide the above described effects without increasing the number of components. Elastomer usage does not need to be limited to the above described structure; elastomer may also be used as the material for the sealing projection 180*a* of the joint pipe 180, the seal portion of the valve plug 261, and the like.

On the other hand, when the ink container unit 200 is removed from the holder 150, the above described installation steps occur in reverse, unsealing the joint opening 230, and allowing the valve mechanism to close.

In other words, as the ink container unit 200 is pulled in the direction to remove it from the holder 150, while gradually rotating the ink container unit 200 in the direction opposite to the installation direction, first, the valve plug 261 moves forward due to the resiliency of the resilient member 263, and presses on the seal portion of the first valve body 260*a* by its sealing surface to close the joint opening 230.

Then, as the ink container unit 200 is pulled out of the holder 150, the gap between the wall of the joint opening 230 and the joint pipe 180, which remained sealed by the sealing projection 180*a*, is unsealed. Since this gap is unsealed after the closing of the valve mechanism, it does not occur that ink is wastefully released into the joint opening 230.

In addition, since the sealing projection 180*a* is disposed at an angle as described before, the unsealing of the joint opening 230 occurs from the top side of the sealing projection 180*a*. Before the joint opening 230 is unsealed, ink remains in the joint opening 230 and joint pipe 180. However, it is at the top side where the unsealing starts. In other words, the bottom side remains sealed, preventing ink from leaking out of the joint opening 230. Further, the internal pressure of the joint opening 230 and joint pipe 180 is negative, and therefore, as the joint is unsealed from the top side of the sealing projection 180*a*, the outside air enters into the joint opening 230, causing the ink remaining in the joint opening 230 and 180 to be drawn into the negative pressure controlling chamber shell 110.

By causing the joint opening 230 to be unsealed starting from the top side of the sealing projection 180*a* to make the ink remaining in the joint opening 230 move into the negative pressure controlling chamber shell 110, it is possible to prevent ink from leaking from the joint opening 230 as the ink container unit 200 is removed from the holder 150.

As described above, according to the structure of the junction between the ink container unit 200 and negative pressure controlling chamber shell 110, the joint opening 230 is sealed before the valve mechanism of the ink container unit 200 is activated, and therefore, ink is prevented from inadvertently leaking from the joint opening 230. Further, since a time lag is provided between the top and bottom sides of the sealing projection 180*a* in terms of the sealing and unsealing timing, the valve plug 261 is prevented from inadvertently moving during the connection, and the ink remaining in the joint opening 230 is prevented from leaking during the connection and during the removal.

Also in this embodiment, the valve plug 261 is disposed in the joint opening 230, at a point deeper inside the joint opening 230, away from the outside opening of the joint opening 230, and the movement of the valve plug 261 is controlled by the valve activation projection 180*b* provided at the projecting end of the joint pipe 180. Therefore, a user is not required to touch the valve plug 261, being prevented from being contaminated by the ink adhering to the valve plug 261.

<Relationship between Engagement or Disengagement of Joint Portion, and ID>

Next, referring to FIGS. 4A to 4D and 5A to 5E, the relationship between the engagement or disengagement of the joint portion, and ID will be described. FIGS. 4 and 5 are drawings for depicting the steps for installing the ink container unit 200 into the holder 150, wherein FIGS. 4A, 4B and 4C and FIGS. 5A, 5B and 5C correspondingly represent the same steps. FIGS. 4 and 5 show in detail the portion related to ID, and the joint portion, respectively.

In the first step, the ink container unit 200 is inserted up to the position illustrated in FIG. 4A and FIG. 5A at which the plurality of ID members 170 for preventing the ink container unit installation error make contact with the slanted wall 251 of the ink container. The holder 150 and ink container unit 200 are structured so that at this point in time, the joint opening 230 and joint pipe 180 do not make contact. If a wrong ink container unit 200 is inserted, the slanted surface 251 of the wrong ink container unit 200 collides with the ID members 170 at this point in time, preventing the wrong ink container unit 200 from being inserted further. With this structural arrangement, the joint opening 230 of the wrong ink container unit 200 never makes contact with joint pipe 180. Therefore, the problems which occur at the joint portion as a wrong ink container unit 200 is inserted, for example, the mixture of inks with different color, ink solidification, production of incomplete images, and breaking down of the apparatus, can be prevented, and therefore, it never occurs that the head and ink containing portion of an apparatus, the ink containing portions of which are replaceable, will be replaced due to the occurrence of such problems.

If the inserted ink container unit 200 is a correct one, the positions of the ID members 170 match the positions of the ID member slots 252. Therefore, the ink container unit 200 is inserted a little deeper toward the negative pressure controlling chamber unit 100 to a position shown in FIG. 4B. At this position, the joint sealing surface 260 of the joint opening 230 of the ink container unit 200 has come into contact with the bottom side of the sealing projection 180*a* of the joint pipe 180.

Thereafter, the both sides are completely joined through the steps described before, providing a passage between the internal space of the ink container unit 200 and the internal space of the negative pressure controlling chamber unit 100.

In the above described embodiment, the sealing projection 180*a* is an integral part of the joint pipe 180. However, the two components may be separately formed. In such a case, the sealing projection 180*a* is fitted around the joint pipe 180, being loosely held by a projection formed on the peripheral surface of the joint pipe 180, or a groove provided in the peripheral surface of the joint pipe 180, so that the sealing projection 180*a* is allowed to move on the peripheral surface of the joint pipe 180. However, the joint portion is structured so that within the moving range of the independent sealing projection 180*a*, the valve action controlling projection 180*b* does not make contact with the valve plug 261 until the sealing projection 180*a* comes into contact with the joint sealing surface 260.

In the above description of this embodiment, it is described that as the ink container unit 200 is further inserted, the bottom side of the sealing projection 180*a* comes into contact with the joint sealing surface 260, and the sealing projection 180*a* slides on the joint sealing surface 260, gradually expanding the contact range between the sealing projection 180*a* and the joint sealing surface 260, upward toward the top side of the sealing projection 180*a*, until the top end of the sealing projection 180*a* finally comes into contact with the joint sealing surface 260. However, the installation process may be such that, first, the top side of the sealing projection 180*a* comes into contact with the joint sealing surface 260, and as the ink container unit 200 is further inserted, the sealing projection 180*a* slides on the joint sealing surface 260, gradually expanding the contact range between the sealing projection 180*a* and the joint sealing surface 260, downward toward the bottom end of the sealing projection 180*a*, until the bottom end of the sealing projection 180*a* finally makes contact with the joint sealing surface 260*a*. Further, the contact between the sealing projection 180*a* and joint sealing surface 260 may occur simultaneously at both the top and bottom sides. During the above process, if the air present between the joint pipe 180 and valve plug 261 opens the valve mechanism by pushing the valve plug 261 inward of the joint opening 230, the ink 300 within the ink storing container 201 does not leak outward, because the joint opening 230 has been completely sealed at the joint between the sealing projection 180*a* and joint sealing surface 260. In other words, the essential point of this invention is that the valve mechanism is opened only after the joint between the joint pipe 180 and joint opening 230 is completely sealed. According to this structure, it does not occur that the ink 300 within the ink container unit 200 leaks out during the installation of the ink container unit 200. In addition, the air pushed into the joint opening 230 enters the ink container unit 200, and pushes out the ink 300 in the ink storing container 201 into the joint opening 230, contributing to smoothly supplying ink from the ink storing container 201 into the absorbent material piece 140.

<Ink Supplying Operation>

Next, referring to FIG. 6, the ink supplying operation of the ink jet head cartridge illustrated in FIG. 2 will be described. FIG. 6 is a sectional drawing for describing the ink supplying operation of the ink jet head cartridge illustrated in FIG. 2.

By dividing the absorbent material in the negative pressure controlling chamber unit 100 into a plurality of pieces, and positioning the interface between the divided pieces of the absorbent material so that the interface will be positioned above the top end of the joint pipe 180 when the ink jet head cartridge is disposed in the attitude in which it is used, as described above, it becomes possible to consume the ink within the absorbent piece 140, or the bottom piece, after the ink within the absorbent material piece 130, or the top piece, if ink is present in both the absorbent material pieces 130 and 140 of the ink jet head cartridge illustrated in FIG. 2. Further, if the position of the gas-liquid interface L changes due to the ambient changes, ink seeps into the absorbent material piece 130 after filling up, first, the absorbent material piece 140 and the adjacencies of the interface 113*c* between the absorbent material pieces 130 and 140. Therefore, it is assured that buffering zone in addition to the buffering space 116 is provided in the negative pressure controlling chamber unit 100. Making the strength of the capillary force of the absorbent material piece 140 higher compared to that of the absorbent material piece 130 assures that the ink in the absorbent material piece 130 is consumed when the ink jet head cartridge is operating.

Further, in this embodiment, the absorbent material piece 130 remains pressed toward the absorbent material piece 140 by the ribs of the negative pressure controlling chamber cover 120, and therefore, the absorbent material piece 130 is kept in contact with the absorbent material piece 140, forming the interface 113*c*. The compression ratios of the absorbent material pieces 130 and 140 are higher adjacent to the interface 113*c* than those in the other portions, and therefore, the capillary force is greater adjacent to the interface 113*c* than that in the other portions. More specifically, representing the capillary force of the absorbent material piece 140, the capillary force of the absorbent material piece 130, and the capillary force of the area adjacent to the interface 113*c* between the absorbent material pieces 130 and 140, with P1, P2, and PS, correspondingly, their relationship is: P2<P1<PS. Providing the area adjacent to the interface 113*c* between the absorbent material pieces 130 and 140 with such capillary force that is stronger than that in the other areas assures that the strength of the capillary force in the area adjacent to the interface 113*c* exceeds the strength necessary to meet the above described requirement, even if the ranges of the strengths of the P1 and P2 overlap with each other because of the unevenness of the absorbent material pieces 130 and 140 in terms of their density, or compression. Therefore, it is assured that the above described effects will be provided. Further, positioning the joint pipe 180 below, and adjacent to, the interface 113*c* between the absorbent material pieces 130 and 140 assures that the gas-liquid interface remains at this position, and therefore, is desired.

Accordingly, next, the method for forming the interface 113*c*, in this embodiment, will be described. In this embodiment, olefinic fiber (2 denier) with a capillary force of −110 mmAq (P1=−110 mmAq) is used as the material for the absorbent material piece 140 as a capillary force generating member. The hardness of the absorbent material pieces 130 and 140 is 0.69 kgf/mm. The method for measuring their hardness is such that, first, the resilient force generated as a pushing rod with a diameter of 15 mm is pushed against the absorbent material placed in the negative pressure controlling chamber shell 110 is measured, and then, the hardness is obtained from the relationship between the distance the pushing rod was inserted, and the measured amount of the resilient force correspondent to the distance. On the other hand, the same material as that for the absorbent material piece 140, that is, olefinic fiber, is used as the material for the absorbent material piece 130. However, compared to the absorbent material piece 140, the absorbent material piece 130 is made weaker in capillary force (P2=−80 mmAq), and is made larger in the fiber diameter (6 denier), making it higher in rigidity at 1.88 kgf/mm.

By making the absorbent material piece 130, which is weaker in capillary force than the absorbent material piece 140, greater in hardness than the absorbent material piece 140, placing them in combination, and in contact, with each other, and keeping them pressed against each other, causes the absorbent material piece 140 to be kept more compressed than the absorbent material piece 130, adjacent to the interface 113*c* between the absorbent material pieces 130 and 140. Therefore, the aforementioned relationship in capillary force (P2<P1<PS) is established adjacent to the interface 113*c*, and also it is assured that the difference between the P2 and PS remains always greater than the difference between the P2 and P1.

<Ink Consumption>

Figure 7A:
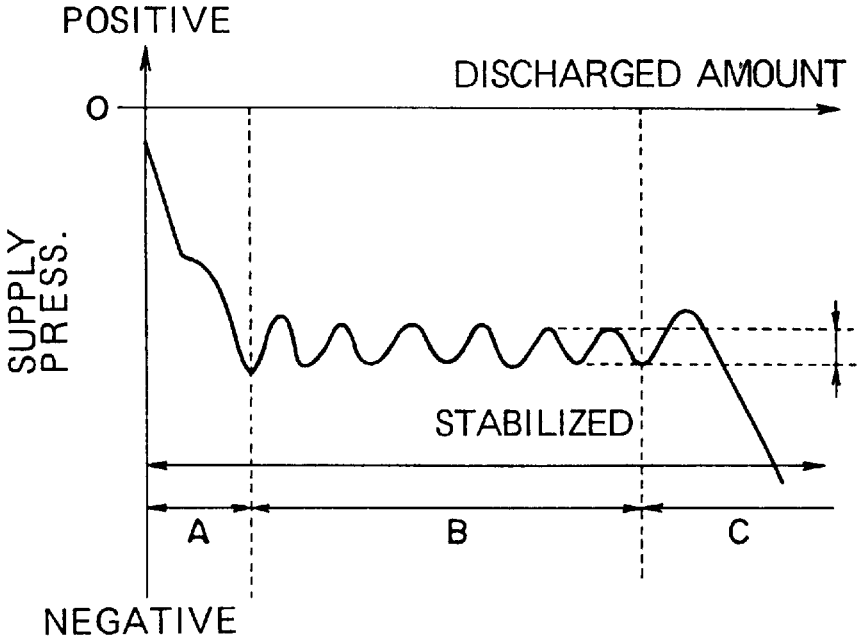
FIGS. 7A and 7B are graphs for depicting the state of the ink during ink consumption, with reference to FIG. 6.
Figure 7B:
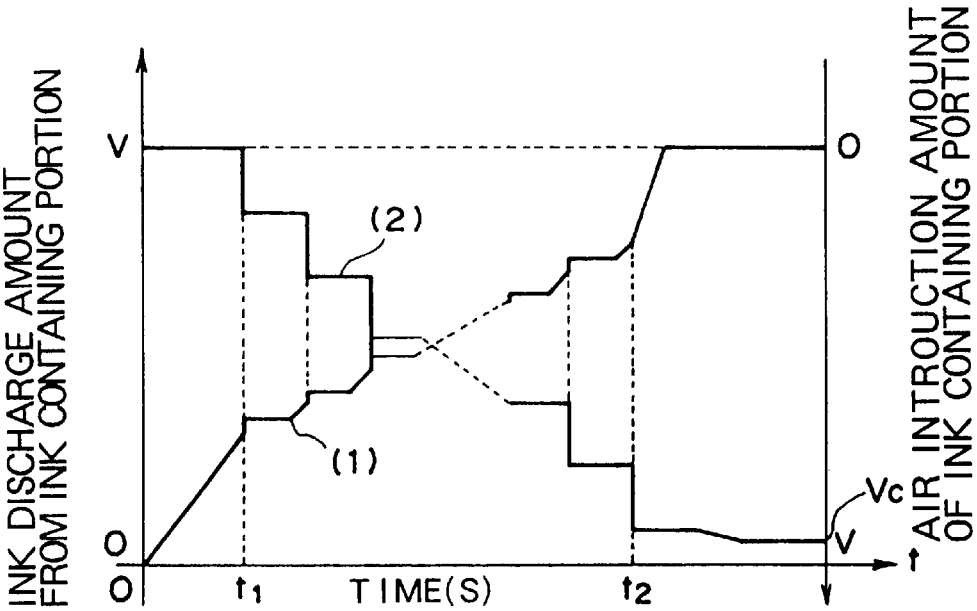

Next, referring to FIGS. 6–8, the outlines of the ink consuming process will be described from the time when the ink container unit 200 has been installed into the holder 150 and has become connected to the negative pressure controlling chamber unit 100, to the time when the ink in the ink storing container 201 begins to be consumed. FIGS. 7A and 7B are drawings for describing the state of the ink during the ink consumption described with reference to FIG. 6, and FIGS. 8A and 8B are graphs for depicting the effects of the deformation of the internal bladder 220 upon the prevention of the internal pressure change in the ink container unit 200.

First, as the ink storing container 201 is connected to the negative pressure controlling chamber unit 100, the ink in the ink storing container 201 moves into the negative pressure controlling chamber unit 100 until the internal pressure of the negative pressure controlling chamber unit 100 becomes equal to the internal pressure of the ink storing container 201, readying the ink jet head cartridge for a recording operation. Next, as the ink begins to be consumed by the ink jet head unit 160, both the ink in the internal bladder 220 and the ink in the absorbent material piece 140 are consumed, maintaining such a balance that the value of the static negative pressure generated by the internal bladder 220 and absorbent material piece 140 increases (first state: range A in FIG. 7A). In this state, when ink is in the absorbent material piece 130, the ink in the absorbent material piece 130 is also consumed. FIG. 7A is a graph for describing one of the examples of the rate at which the negative pressure in the ink delivery tube 165 varies. In FIG. 7A, the axis of abscissa represents the rate at which the ink is drawn out of the negative pressure controlling chamber shell 110 through the ink delivery tube 160, and the axis of ordinates represents the value of the negative pressure (static negative pressure) in the ink delivery tube 160.

Next, gas is drawn into the internal bladder 220, allowing ink to be consumed, that is, drawn out, through gas-liquid exchange while the absorbent material pieces 130 and 140 keep the position of the gas-liquid interface L at about the same level, and keep the internal negative pressure substantially constant (second state: range B in FIG. 7A). Then, the ink remaining in the capillary pressure generating member holding chamber 110 is consumed (range C in FIG. 7A).

As described above, the ink jet head cartridge in this embodiment goes through the stage (first stage) in which the ink in the internal bladder 220 is used without the introduction of the outside air into the internal bladder 220. Therefore, the only requirement to be considered regarding the internal volume of the ink storing container 201 is the amount of the air introduced into the internal bladder 220 during the connection. Therefore, the ink jet head cartridge in this embodiment has merit in that it can compensate for the ambient changes, for example, temperature change, even if the requirement regarding the internal volume of the ink storing container 201 is relaxed.

Further, in whichever period among the aforementioned periods A, B, and C, in FIG. 7A, the ink storing container 201 is replaced, it is assured that the proper amount of negative pressure is generated, and therefore, ink is reliably supplied. In other words, in the case of the ink jet head cartridge in this embodiment, the ink in the ink storing container 201 can be almost entirely consumed. In addition, air may be present in the joint pipe 180 and/or joint opening 230 when the ink container unit 200 is replaced, and the ink storing container 201 can be replaced regardless of the amounts of the ink retained in the absorbent material pieces 130 and 140. Therefore, it is possible to provide an ink jet head cartridge which allows the ink storing container 201 to be replaced without relying on an ink remainder detection mechanism; in other words, the ink jet head cartridge in this embodiment does not need to be provided with an ink remainder detection mechanism.

At this time, the aforementioned ink consumption sequence will be described from a different viewpoint, referring to FIG. 7B.

FIG. 7B is a graph for describing the above described ink consumption sequence. In FIG. 7B, the axis of abscissas represents the elapsed time, and the axis of ordinates represents the cumulative amount of the ink drawn out of the ink storing container, and the cumulative amount of the air drawn into the internal bladder 220. It is assumed that the rate at which the ink jet head unit 160 is provided with ink remains constant throughout the elapsed time.

The ink consumption sequence will be described from the angles of the cumulative amount of the ink drawn out of the ink containing portion, and the cumulative amount of the air drawn into the internal bladder 220, shown in FIG. 7B. In FIG. 7B, the cumulative amount of the ink drawn out of the internal bladder 220 is represented by a solid line (1), and the cumulative amount of the air drawn into the ink containing portion is represented by a solid line (2). A period from a time t0 to t1 corresponds to the period A, or the period before the gas-liquid exchange begins, in FIG. 7A. In this period A, the ink from the absorbent material piece 140 and internal bladder 220 is drawn out of the head while balance is maintained between the absorbent material piece 140 and 220, as described above.

Next, the period from time t1 to time t2 corresponds to the gas-liquid exchange period (period B) in FIG. 7B. In this period B, the gas-liquid exchange continues according to the negative pressure balance, as described above. As air is introduced into the internal bladder 220 (which corresponds to the stepped portions of the solid line (2)), as indicated by the solid line (1) in FIG. 7B, ink is drawn out of the internal bladder 220. During this process, it does not occur that ink is always drawn out of the internal bladder 220 by an amount equal to the amount of the introduced air. For example, sometimes, ink is drawn out of the internal bladder 220 a certain amount of time after the air introduction, by an amount equivalent to the amount of the introduced air. As is evident from FIG. 7B, the occurrence of this kind of reaction, or the timing lag, characterizes the ink jet head cartridge in this embodiment in comparison to an ink jet head cartridge which does not have an internal ink bladder (220), and the ink containing portion of which does not deform. As described above, this process is repeated during the gas-liquid exchange period. As the ink in the internal bladder 220 continues to be drawn out, the relationship between the amounts of the air and ink in the internal bladder 220 reverses at a certain point in time.

The period after the time t2 corresponds to the period (range C) after the gas-liquid exchange period in FIG. 7A. In this range C, the internal pressure of the internal bladder 220 becomes substantially the same as the atmospheric pressure as stated before. As the internal pressure of the internal bladder 220 gradually changes toward the atmospheric pressure, the initial state (pre-usage state) is gradually restored by the resiliency of the internal bladder 220. However, because of the so-called buckling, it does not occur that the state of the internal bladder 220 is completely restored to its initial state. Therefore the final amount Vc of the air drawn into the internal bladder 220 is smaller than the initial internal volume of the internal bladder 220 (V>Vc). Even in the state within the range C, the ink in the internal bladder 220 can be completely consumed.

As described above, the structure of the ink jet head cartridge in this embodiment is characterized in that the pressure fluctuation (amplitude $\gamma$ in FIG. 7A) which occurs during the gas-liquid exchange in the ink jet head cartridge in this embodiment is greater compared to that in an ink jet head cartridge which employs a conventional ink container system in which gas-liquid exchange occurs.

The reason for this characteristic is that before the gas-liquid exchange begins, the internal bladder 220 is deformed, and kept deformed, by the drawing of the ink from inside the internal bladder 220. Therefore, the resiliency of the internal bladder material continuously generates such force that works in the direction to move the wall of the internal bladder 220 outward. As a result, the amount of the air which enters the internal bladder 220 to reduce the internal pressure difference between the absorbent material piece 140 and internal bladder 220 during the gas-liquid exchange often exceeds the proper amount, as described, increasing the amount of the ink drawing out of the internal bladder 220 into the external shell 210. On the contrary, if the ink container unit 200 is structured so that the wall of the ink containing portion does not deform as does the wall of the internal bladder 220, ink is immediately drawn out into the negative pressure controlling chamber unit 100 as soon as a certain amount of air enters the ink containing portion.

For example, in 100% duty mode (solid mode), a large amount of ink is ejected all at once from the ink jet head unit 160, causing ink to be rapidly drawn out of the negative pressure controlling chamber unit 100 and ink storing container 201. However, in the case of the ink jet head cartridge in this embodiment, the amount of the ink drawn out through gas-liquid exchange is relative large, improving the reliability, that is, eliminating the concern regarding the interruption of ink flow.

Also, according to the structure of the ink jet head cartridge in this embodiment, ink is drawn out with the internal bladder 220 remaining deformed inward, providing thereby an additional benefit in that the structure offers a higher degree of buffering effect against the vibration of the carriage, ambient changes, and the like.

As described above, according to the structure of the ink jet head cartridge in this embodiment, the slight changes in the negative pressure can be eased by the internal bladder 220, and even when air is present in the internal bladder 220, for example, during the second stage in the ink delivery, the ambient changes such as temperature change can be compensated for by a method different from the conventional methods.

Next, referring to FIG. 8, a mechanism for assuring that even when the ambient condition of the ink jet head cartridge illustrated in FIG. 2 changes, the liquid within the unit remains stable will be described. In the following description, the absorbent material pieces 130 and 140 may be called a capillary force generating member.

As the air in the internal bladder 220 expands due to decrease in the atmospheric pressure and/or increase in the temperature, the walls or the like portions of the internal bladder 220, and the liquid surface in the internal bladder 220, are subjected to pressure. As a result, not only does the internal volume of the internal bladder 220 increase, but also a portion of the ink in internal bladder 220 flows out into the negative pressure controlling chamber shell 110 from the internal bladder 220 through the joint pipe 180. However, since the internal volume of the internal bladder 220 increases, the amount of the ink that flows out into the absorbent material piece 140 in the case of this embodiment is substantially smaller compared to a case in which the ink storage portion is undeformable.

As described above, the aforementioned changes in the atmospheric pressure ease the negative pressure in the internal bladder 220 and increase the internal volume of the internal bladder 220. Therefore, initially, the amount of the ink which flows out into the negative pressure controlling chamber shell through the joint opening 230 and joint pipe 180 as the atmospheric pressure suddenly changes is substantially affected by the resistive force generated by the internal bladder wall as the inward deformation of the wall portion of the internal bladder 220 is eased, and by the resistive force for moving the ink so that the ink is absorbed by the capillary force generating member.

In particular, in the case of the structure in this embodiment, the flow resistance of the capillary force generating members (absorbent material pieces 130 and 140) is greater than the resistance of the internal bladder 220 against the restoration of the original state. Therefore, as the air expands, initially, the internal volume of the internal bladder 220 increases. Then, as the amount of the air expansion exceeds the maximum amount of the increase in the internal volume of the internal bladder 220 afforded by the internal bladder 220, ink begins to flows from within the internal bladder 220 toward the negative pressure controlling chamber shell 110 through the joint opening 230 and joint pipe 180. In other words, the wall of the internal bladder 220 functions as the buffer against the ambient changes, and therefore, the ink movement in the capillary force generating member calms down, stabilizing the negative pressure adjacent to the ink delivery hole 165.

Also according to this embodiment, the ink which flows out into the negative pressure controlling chamber shell 110 is retained by the capillary force generating members. In the aforementioned situation, the amount of the ink in the negative pressure controlling chamber shell 110 increases temporarily, causing the gas-liquid interface to rise, and therefore, in comparison to when the internal pressure is stable, the internal pressure temporarily becomes slightly positive, as it is initially. However, the effect of this slightly positive internal pressure upon the characteristics of a liquid ejection recording means such as the ink jet head unit 160, in terms of ejection, creates no practical problem. As the atmospheric pressure returns to the normal level (base unit of atmospheric pressure), or the temperature returns to the original level, the ink which leaked out into the negative pressure controlling chamber shell 110 and has been retained in the capillary force generating members, returns to the internal bladder 220, and the internal bladder 220 restores its original internal volume.

Next, the basic action in the stable condition restored under such atmospheric pressure that has changed after the initial operation will be described.

What characterizes this state is the amount of the ink drawn out of the internal bladder 220, as well as that the position of the interface between the ink retained in the capillary force generating member, and the gas, changes to compensate for the fluctuation of the negative pressure resulting from the fluctuation of the internal volume of the internal bladder 220 itself. Regarding the relationship between the amount of the ink absorbed by the capillary force generating member and the ink storing container 201, all that is necessary from the viewpoint of preventing ink from leaking from the air vent or the like during the aforementioned decrease in the atmospheric pressure and temperature change, is to determine the maximum amount of the ink to be absorbed by the negative pressure controlling chamber shell 110 and the amount of the ink to be retained in the negative pressure controlling chamber shell 110 while the ink is supplied from the ink storing container 201, in consideration of the amount of the ink which flows out of the ink storing container 201 under the worst conditions, and then, to give the negative pressure controlling chamber shell 110 an internal volume sufficient for holding the capillary force generating members, the sizes of which match the aforementioned amount of ink under the worst conditions, and the maximum amount of the ink to be absorbed.

Figure 8A:
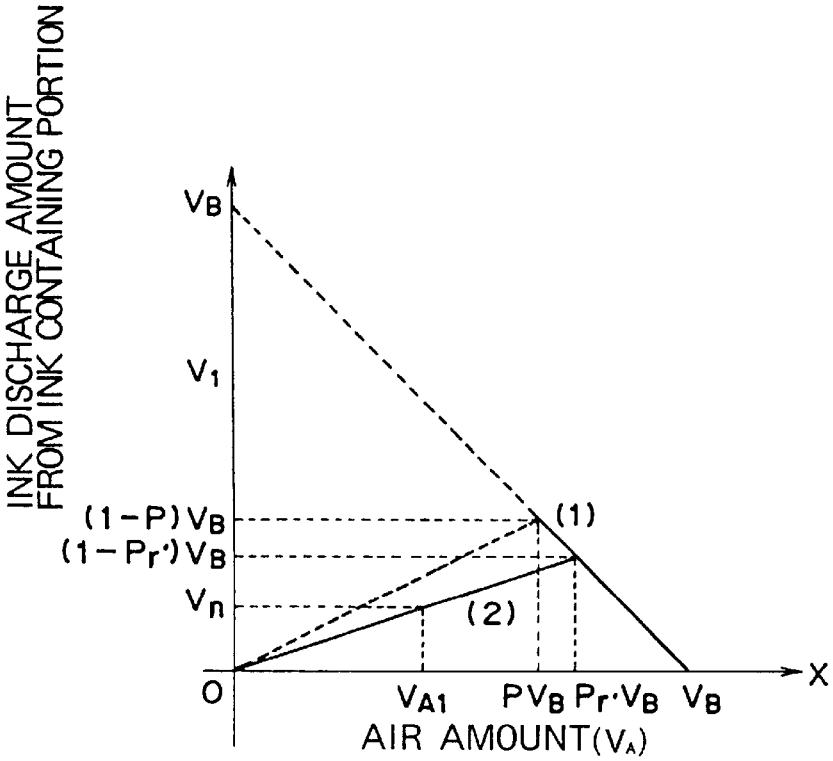
FIGS. 8A and 8B are graphs for depicting the effect of the change in the internal pressure resulting from the deformation of the internal bladder during the ink consumption in the ink jet head cartridge shown in FIG. 6.

In FIG. 8A, the initial volume of the internal space (volume of the air) of the internal bladder 220 before the decrease in the atmospheric pressure, in a case in which the internal bladder 220 does not deform at all in response to the expansion of the air, is represented by the axis of abscissas (X), and the amount of the ink which flowed out as the atmospheric pressure decreased to a value of P (0<P<1) is represented by the axis of ordinates, and their relationship is depicted by a dotted line (1).

The amount of the ink which flows out of the internal bladder 220 under the worst conditions may be estimated based on the following assumption. For example, a situation in which the amount of the ink which flows out of the internal bladder 220 becomes the maximum when the lowest level to which the value of the atmospheric pressure decreases is 0.7, is when the volume of the ink remaining in the internal bladder 220 equals 30% of the volumetric capacity VB of the internal bladder 220. Therefore, presuming that the ink below the bottom end of the wall of the internal bladder 220 is also absorbed by the capillary force generating members in the negative pressure controlling chamber shell 110, it may be expected that the entirety of the ink remaining in the internal bladder 220 (equals in volume to 30% of the volumetric capacity VB) leaks out.

On the contrary, in this embodiment, the internal bladder 220 deforms in response to the expansion of the air. In other words, compared to the internal volume of the internal bladder 220 before the expansion, the internal volume of the internal bladder 220 is greater after the expansion, and the ink level in the negative pressure controlling chamber shell 110 changes to compensate for the fluctuation of the negative pressure in the internal bladder 220. Under the stable condition, the ink level in the negative pressure controlling chamber shell 110 changes to compensate for the decrease in the negative pressure in the capillary force generating members, in comparison to the negative pressure in the capillary force generating members before the change in the atmospheric pressure, caused by the ink from the internal bladder 220. In other words, the amount of the ink which flows out decreases in proportion to the amount of the expansion of the internal bladder 220, as depicted by a solid line (2). As is evident from the dotted line (1) and solid line (2), the amount of the ink which flows out of the internal bladder 220 may be estimated to be smaller compared to that in the case in which the internal bladder 220 does not deform at all in response to the expansion of the air. The above described phenomenon similarly occurs in the case of the change in the temperature of the ink container, except that even if the temperature increases approximately 50 degrees, the amount of the ink outflow is smaller than the aforementioned amount of the ink outflow in response to the atmospheric pressure decrease.

As described above, the ink container in accordance with the present invention can compensate for the expansion of the air in the ink storing container 201 caused by the ambient changes not only because of the buffering effect provided by the negative pressure controlling chamber shell 110, but also because of the buffering effect provided by the ink storing container 201 which is enabled to increase in its volumetric capacity to the maximum value at which the shape of the ink storing container 201 becomes substantially the same as the shape of the internal space of the external shell 210. Therefore, it is possible to provide an ink supplying system which can compensate for the ambient changes even if the ink capacity of the ink storing container 201 is substantially increased.

Figure 8B:
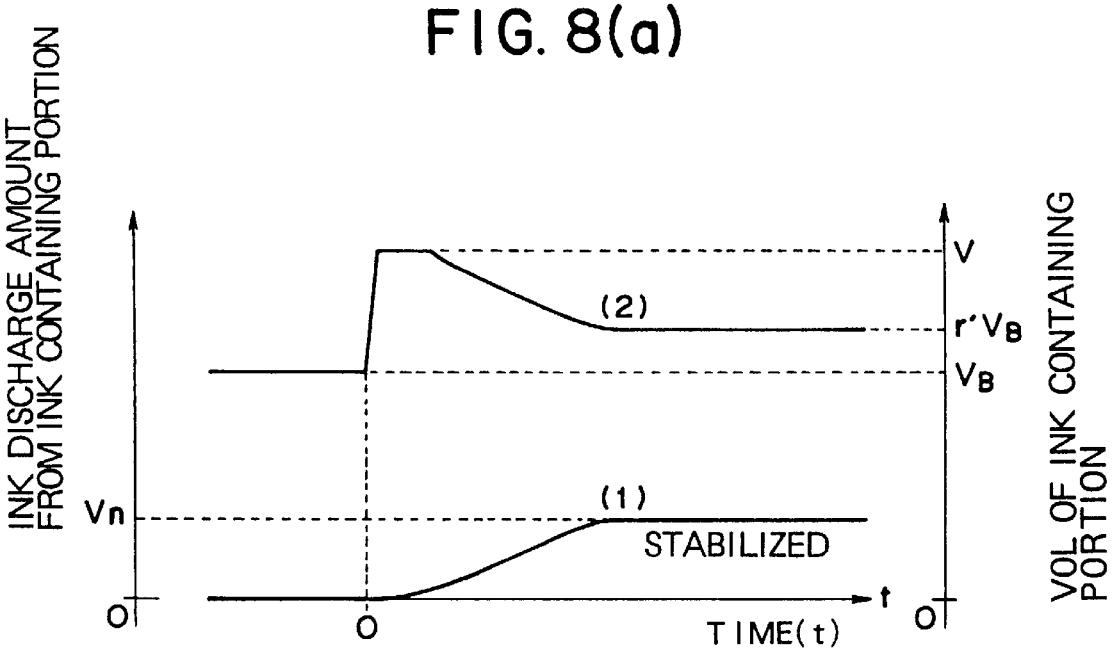

FIG. 8B schematically shows the amount of the ink drawn out of the internal bladder 220 and the internal volume of the internal bladder 220, in relation to the length of the elapsed time, when the ambient pressure is reduced from the normal atmospheric pressure to the pressure value of P (0<P<1). In FIG. 8B, the initial volume of the air is VA1, and a time t0 is a point in time at which the ambient pressure is the normal atmospheric pressure, and from which the reduction in the ambient pressure begins. The axis of abscissas represents time (t) and the axis of ordinates represents the amount of the ink drawn out of the internal bladder 220 and the internal volume of the internal bladder 220. The changes in the amount of the ink drawn out of the internal bladder 220 in relation to the elapsed time is depicted by a solid line (1), and the change in the volume of the internal bladder 220 in relation to the elapsed time is depicted by a solid line (2).

As shown in FIG. 8B, when a sudden ambient change occurs, the compensation for the expansion of the air is made mainly by the ink storing container 201 before the normal state, in which the negative pressure in the negative pressure controlling chamber shell 110 balances with the negative pressure in the ink storing container 201, is finally restored. Therefore, at the time of sudden ambient change, the timing with which the ink is drawn out into the negative pressure controlling chamber shell 110 from the ink storing container 201 can be delayed.

Therefore, it is possible to provide an ink supplying system capable of supplying ink under the stable negative pressure condition during the usage of the ink storing container 201, while compensating the expansion of the air introduced in the ink storing container 201 through gas-liquid exchange, under various usage conditions.

According to the ink jet head cartridge in this embodiment, the volumetric ratio between the negative pressure controlling chamber shell 110 and internal bladder 220 can be optimally set by optionally selecting the material for the capillary force generating members (ink absorbent pieces 130 and 140), and the material for the internal bladder 220; even if the ratio is greater than 1:2, practical usage is possible. In particular, when emphasis needs to be placed on the buffering effect of the internal bladder 220, all that is necessary is to increase, within the range in which the elastic deformation is possible, the amount of the deformation of the internal bladder 220 during the gas-liquid exchange, relative to the initial state.

As described above, according to the ink jet head cartridge in this embodiment, although the capillary force generating members occupies only a small portion of the internal volume of the negative pressure controlling chamber shell 110, it is still effective to compensate for the changes in the ambient condition, by synergistically working with the structure of the negative pressure controlling chamber shell 110.

Referring to FIG. 2, in the ink jet head cartridge in this embodiment, the joint pipe 180 is located adjacent to the bottom end of the negative pressure controlling chamber shell 110. This arrangement is effective to reduce the uneven distribution of the ink in the absorbent material pieces 130 and 140 in the negative pressure controlling chamber shell 110. This effect will be described below in detail.

The ink from the ink container unit 200 is supplied to the ink jet head unit 160 through the joint opening 230, absorbent material piece 130, and absorbent material piece 140. However, between the joint opening 230 and ink delivery tube 165, the ink takes a different path depending on the situation. For example, the shortest path, that is, the path taken by the ink in a situation in which the ink is directly supplied, is substantially different from the path taken in a situation in which the ink goes, first, to the top of the absorbent material piece 140 due to the rise of the liquid surface of the absorbent material piece 140 caused by the aforementioned ambient changes. This difference creates the aforementioned uneven ink distribution, which sometimes affects recording performance. This variation in the ink path, that is, the difference in the length of the ink path, can be reduced to reduce the unevenness of the ink distribution, by positioning the joint pipe 180 adjacent to the absorbent material piece 140, as it is according to the structure of the ink jet head cartridge in this embodiment, so that the unevenness in the recording performance is reduced. Thus, it is desired that the joint pipe 180 and joint opening 230 are placed as close as possible to the top portion.

However, in consideration of the need to provide the buffering performance, they are placed at reasonably high positions as they are in this embodiment. These positions are optionally chosen in consideration of various factors, for example, the absorbent material pieces 130 and 140, ink, amount by which ink is supplied, amount of ink, and the like.

In this embodiment, the absorbent material piece 140 which generates a capillary force with a value of P1 and the absorbent material piece 130 which generates a capillary force with a value of P2 are placed in the negative pressure controlling chamber shell 110, in contact with each other, in a compressed state, generating a capillary force with a value of PS. The relationship in the strength among these capillary forces is: $P2<P1<PS$. In other words, the capillary force generated at the interface 113*c* is the strongest, and the capillary force generated in the absorbent material piece 130, or the absorbent material piece on the top side, is the weakest. Because the capillary force generated at the interface 113*c* is the strongest, and the capillary force generated in the absorbent material piece 130, or the absorbent material piece on the top side, is the weakest, even if the ink supplied through the joint opening 230 flows into the absorbent material piece 130 on the top side past the interface 113*c*, the ink is pulled with strong force toward the interface 113*c*, and moves back toward the interface 113*c*. With the presence of this interface 113*c*, it does not occur that the path J forms a line through both the absorbent material pieces 140 and 130. For this reason, in addition to the fact that the position of the joint opening 230 is higher than that of the supply opening 131, the difference in length between the path K and path J can be reduced. Therefore, it is possible to reduce the difference in the effect which ink receives from the absorbent material piece 140, which occurs as the ink path through the absorbent material pieces 140 varies.

Further, in this embodiment, the ink absorbing member as the negative pressure generating member placed in the negative pressure controlling chamber shell 110 comprises two pieces 130 and 140 of absorbent material, which are different in capillary force. The piece with stronger capillary force is used as the piece for the bottom side. The positioning of the joint pipe 180 below, and adjacent to, the interface 113*c* between the absorbent material pieces 130 and 140 assures that the shifting of the ink path is controlled while providing a reliable buffering zone.

As for an ink delivery port, the ink delivery port 131 located at the approximate center of the bottom wall of the negative pressure controlling chamber shell 110 is described as an example. However, the choice is not limited to the ink delivery port 131; if necessary, an ink delivery port may be moved away from the joint opening 230; in other words, it may be positioned at the left end of the bottom wall, or adjacent to the left sidewall. With such modifications, the position of the ink jet head unit 160, with which the holder 150 is provided, and the position of the ink delivery tube 165, may also be correspondingly altered to the left end of the bottom wall, or the adjacency of the left sidewall.

<Valve Mechanism>

Next, referring to FIGS. 9A to 9D, the valve mechanism provided inside the joint opening 230 of the above described ink container unit 200 will be described.

Figures 9A, 9B:
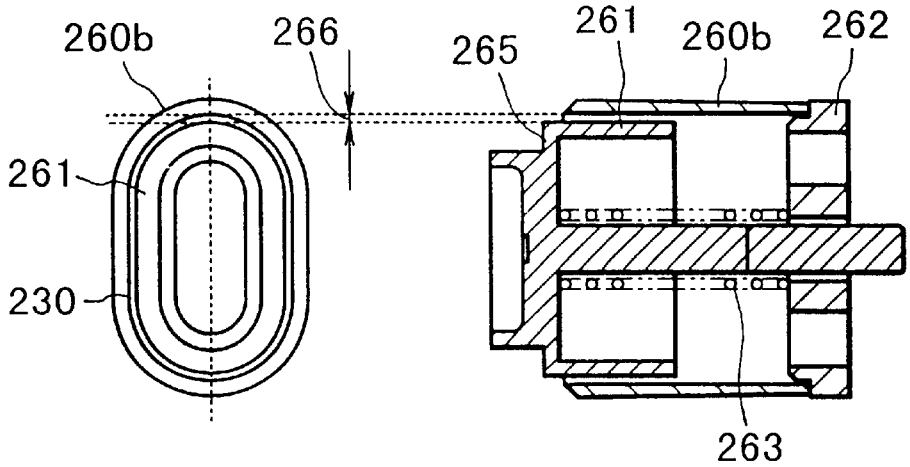
FIGS. 9A to 9D are sectional drawings for depicting the relationship between the valve body and valve plug in the valve mechanism to which the present invention is applicable.
Figures 9C, 9D:
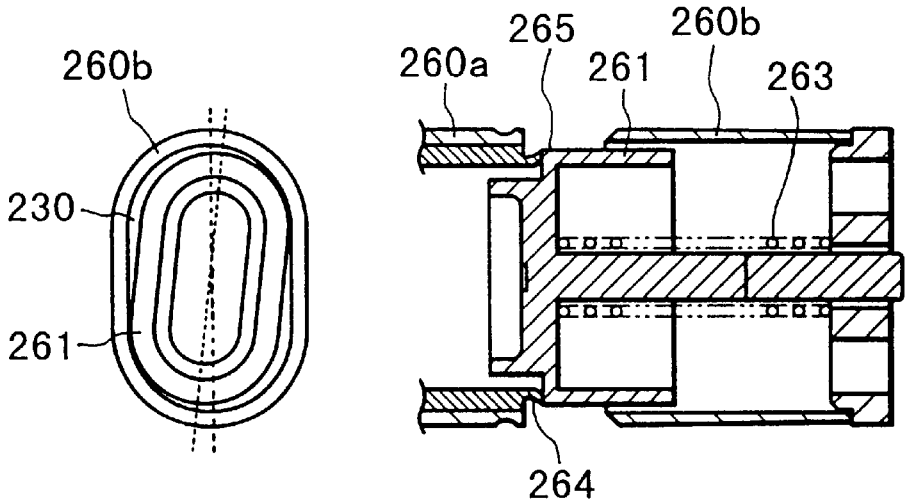

FIG. 9A is a front view of the relationship between the second valve body 260*b* and valve plug 261; FIG. 9B is a lateral and vertically sectional view of the second valve body 260*b* and valve plug 261 illustrated in FIG. 9A; FIG. 9C is a front view of the relationship between the second valve body 260*b*, and the valve plug 260 which has slightly rotated; and FIG. 9D is a lateral and vertically sectional view of the second valve body 260*b* and valve plug 260 illustrated in FIG. 9C.

As shown in FIG. 3, FIG. 9A, and FIG. 9B, the front end of the joint opening 230 is elongated in one direction, enlarging the cross-sectional area of the opening, to enhance the ink supplying performance of the ink storing container 201. However, if the joint opening 230 is widened in the width direction perpendicular to the lengthwise direction of the joint opening 230, the space which the ink storing container 201 occupies increases, leading to increase in the apparatus size. This configuration is particularly effective when a plurality of ink containers are placed side by side in terms of the widthwise direction (direction of the scanning movement of the carriage), in parallel to each other, to accommodate the recent trends, that is, colorization and photographic printing. Therefore, in this embodiment, the shape of the cross section of the joint opening 230, that is, the ink outlet of the ink storing container 201 is made oblong.

In addition, in the case of the ink jet head cartridge in this embodiment, the joint opening 230 has two roles: the role of supplying the external shell 210 with ink, and the role of guiding the atmospheric air into the ink storing container 201. Thus, the fact that the shape of the cross section of the joint opening 230 is oblong in the direction parallel to the gravity direction makes it easier to give the top and bottom sides of the joint opening 230 different functions, that is, that is, to allow the top side to essentially function as the air introduction path, and the bottom side to essentially function as the ink supply path, assuring that gas-liquid exchange occurs flawlessly.

As described above, as the ink container unit 200 is installed, the joint pipe 180 of the negative pressure controlling chamber unit 100 is inserted into the joint opening 230. As a result, the valve plug 261 is pushed by the valve activation projection 180*b* located at the end of the joint pipe 180. Consequently, the valve mechanism of the joint opening 230 opens, allowing the ink in the ink storing container 201 to be supplied into the negative pressure controlling chamber unit 100. Even if the valve activation projection 180*b* misses the exact center of the valve plug 261 as it comes into contact with the valve plug 261 to push it, because of the attitude of the ink container unit 200 when the ink container unit 200 is engaged with the joint opening 230, the twisting of the valve plug 261 can be avoided because the cross section of the end portion of the sealing projection 180*a* placed on the peripheral surface of the joint pipe 180 is semicircular. Referring to FIGS. 9A and 9B, in order to allow the valve plug 261 to smoothly slide during the above process, a clearance 266 is provided between the joint sealing surface 260 in the joint opening 230, and the circumference of the first valve body side of the valve plug 261.

In addition, at the end of the joint pipe 180, at least the top portion has an opening, and therefore, when the joint pipe 180 is inserted into the joint opening 230, there is no hindrance to the formation of the essential air introduction path through the top sides of the joint pipe 180 and joint opening 230. Therefore, an efficient gas-liquid exchange is possible. On the contrary, during the removal of the ink container unit 200, as the joint pipe 180 separates from the joint opening 230, the valve plug 261 is slid forward, that is, toward the first valve body 260*a*, by the resilient force which it receives from the resilient member 263. As a result, the seal portion 264 of the first valve body 260*a* and the valve plug 261 engage with each other, closing the ink supply path, as shown in FIG. 9D.

Figure 10:
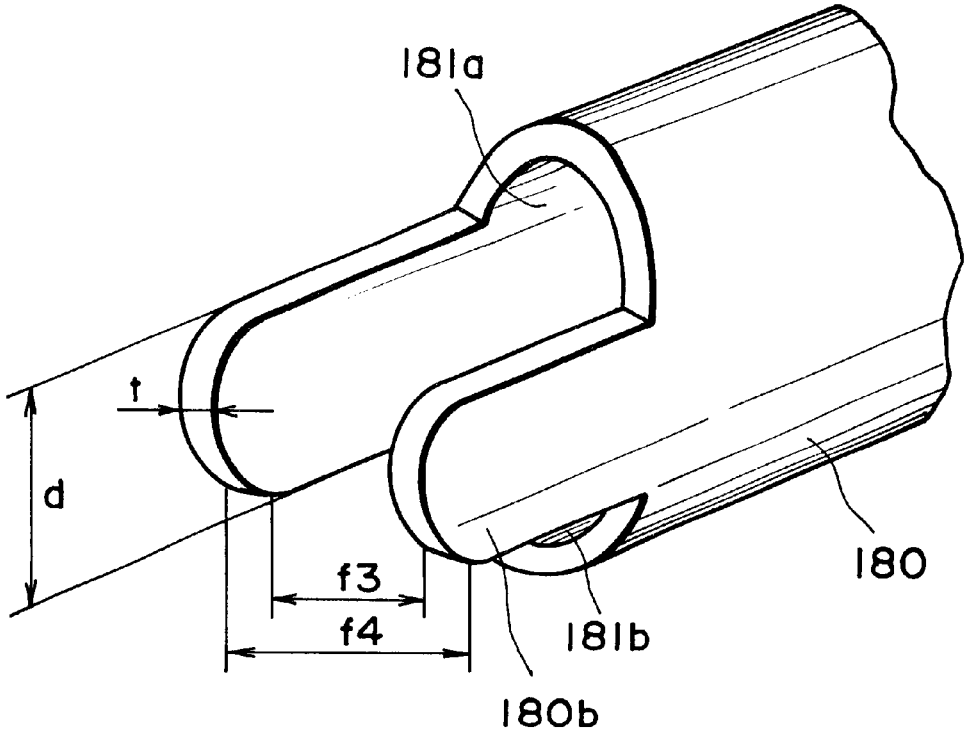
FIG. 10 is a perspective view of an example of the shape of the end portion of the joint pipe which engages with the valve mechanism when the valve mechanism is opened or closed, and to which the present invention is applicable.

FIG. 10 is a perspective view of the end portion of the joint pipe 180, and depicts an example of the shape of the end portion. As shown in FIG. 10, the top side of the end portion of the joint pipe 180 with the aforementioned oblong cross section is provided with an opening 181*a*, and the bottom side of the end portion of the joint pipe 180 is provided with an opening 181*b*. The bottom side opening 181*b* is an ink path, and the top side opening 181*a* is an air path, although ink is occasionally passed through the top side opening 181*a*.

The value of the force applied to the valve plug 261 by the resilient member to keep the valve plug 261 in contact with the first valve body 260*a* is set so that it remains substantially the same even if a pressure difference occurs between the inside and outside of the ink storing container 201 due to the changes in the environment in which the ink storing container 201 is used. If the valve plug 261 is returned to the closed position after the above described ink container unit 200 is used at high altitude with an atmospheric pressure of 0.7, and then, the ink container unit 200 is carried to an environment with an atmospheric pressure of 1.0, the internal pressure of the ink storing container 201 becomes lower than the atmospheric pressure. As a result, the valve plug 261 is pressed in the direction to open the valve mechanism. In the case of this embodiment, the force FA applied to the valve plug 261 by the atmospheric pressures is calculated by the following formula:

$$FA=1.01\times10^5(N/m^2)(=1.0),$$

whereas the force FB applied to the valve plug 261 by the gas in the ink container is obtained from the following formula:

$$FB=0.709\times10^5(N/m^2)(=0.7).$$

The constant force FV necessary to be generated by the resilient member to keep the valve plug 261 in contact with the valve body must satisfy the following requirement:

$$FV-(FA-FB)>0.$$

In other words, in this embodiment, $$FV>1.01\times10^5-0.709\times10^5=0.304\times10^5(N/m^2).$$

This value applies to a situation in which the valve plug 261 is in contact with the first valve body 260*a*, under pressure. When the valve plug 261 is apart from the first valve body 260*a*, that is, after the amount of the deformation of the deformation of the resilient member 26*e* for generating the force applied to the valve plug 261 has increased, the value of the force applied to the valve plug 261 by the resilient member 263 in the direction to push the valve plug 261 toward the first valve body 260*a* is greater, which is evident.

In the case of the above described valve structure, there is a possibility that it suffers from a phenomenon called "twisting". More specifically, the coefficient of friction at the interface between the valve activation projection 180*b* and valve plug 261 sometimes increases due to the adhesion of solidified ink or the like. If such a situation occurs, the valve plug 261 fails to slide on the surface of the valve activation projection 180*b* upon which it was intended to slide. As a result, as the ink container unit 200 is rotationally moved, the valve plug 261 strokes while being pushed, being thereby twisted, in the upward direction in the drawing by the valve activation projection 180*b*.

Thus, hereinafter, the configuration of a valve capable of compensating for the effect of the twisting (clogging) phenomenon upon the sealing performance will be described, along with the comparative examples.

Figure 11:
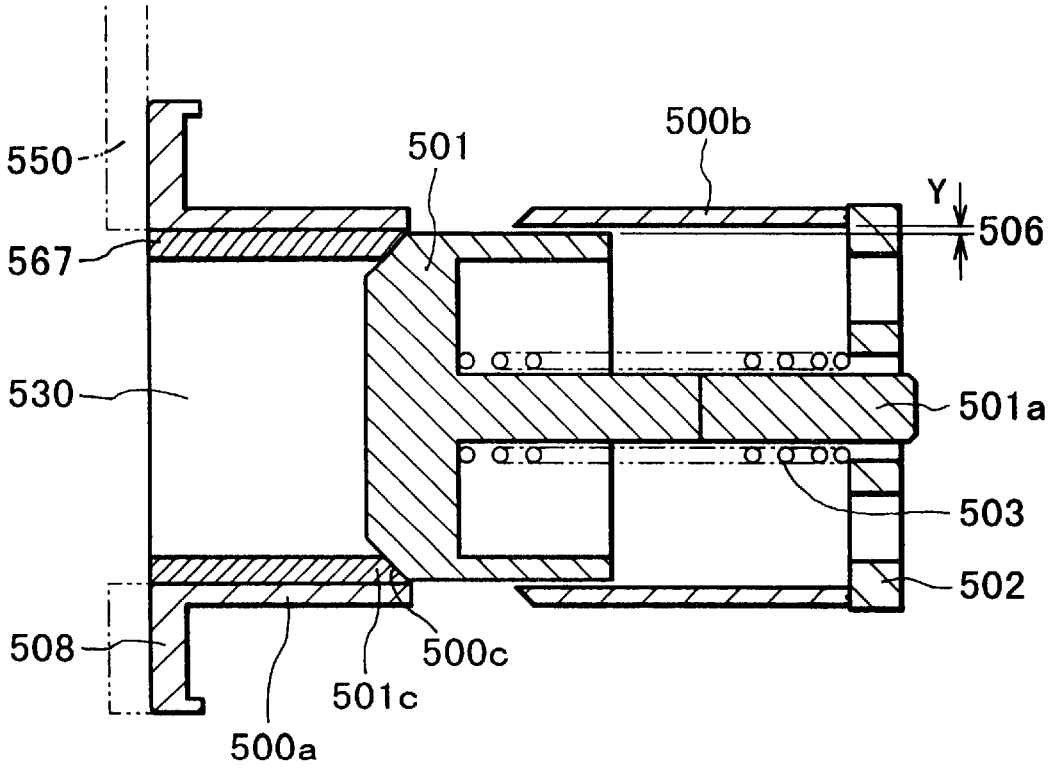
FIG. 11 is a sectional drawing for depicting an example of a valve mechanism, which is to be compared with the valve mechanism in accordance with the present invention.
Figure 12:
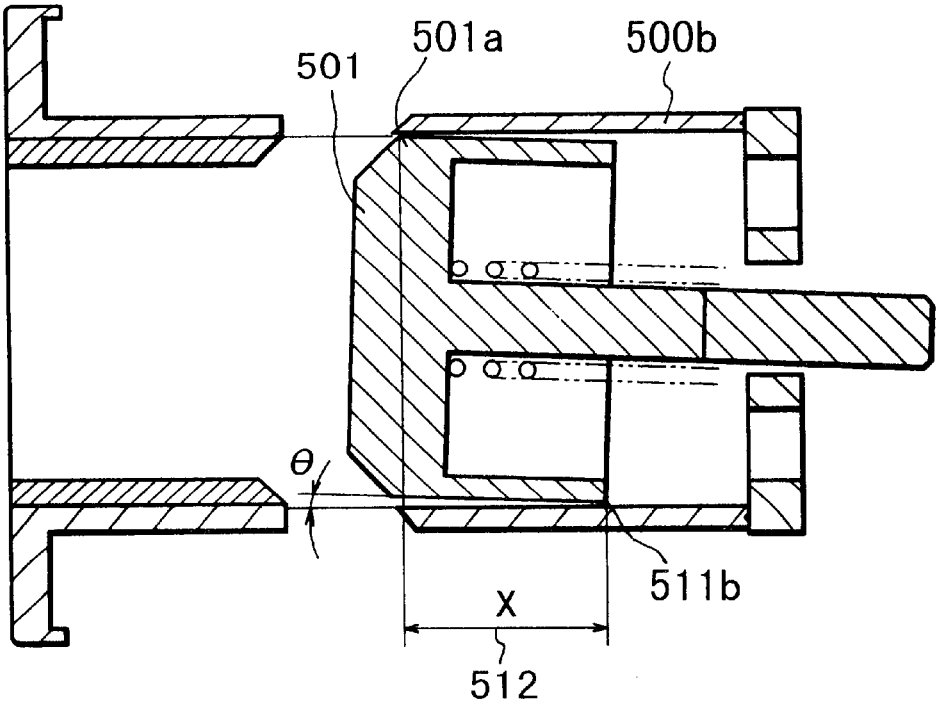
FIG. 12 is a sectional drawing for depicting the state of twisting in the valve mechanism illustrated in FIG. 11.
Figure 13:
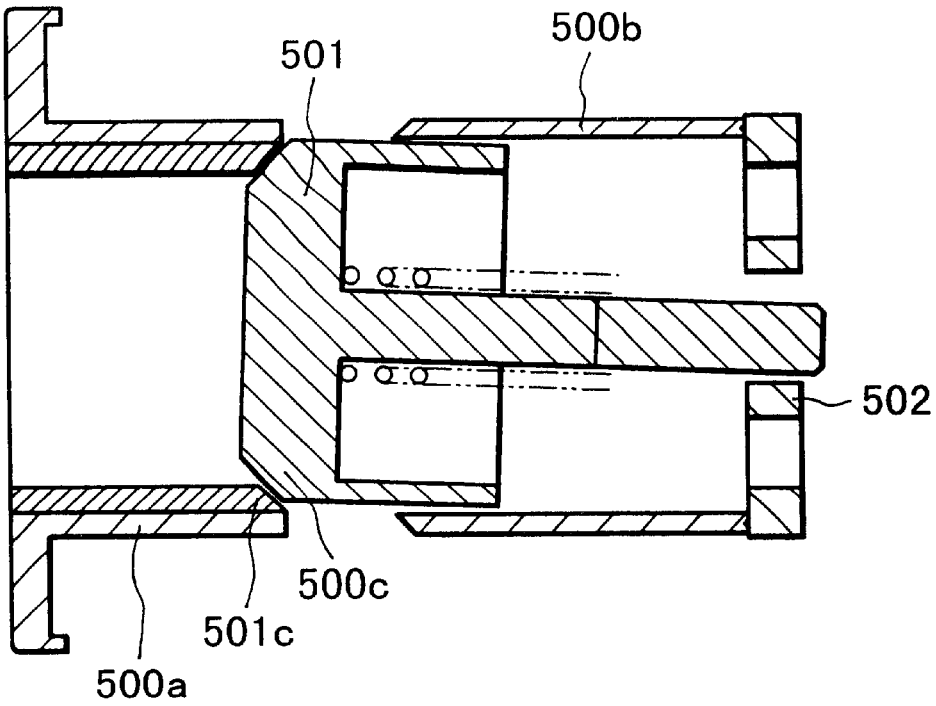
FIG. 13 is a sectional drawing for depicting how the liquid outlet is sealed by the valve mechanism illustrated in FIG. 11.

FIG. 11 shows an example of a valve mechanism, which is compared with the valve mechanism in this embodiment. FIGS. 12 and 13 show the twisting in the valve mechanism illustrated in FIG. 11, and the state in which the joint is sealed. In the case of the comparative example in FIG. 11, a clearance 506 provided between a valve plug 501 with an oblong cross section and a second valve body 500*b* to facilitate the stroking of the valve plug 501, is even. The valve plug 501 is pressed upon a first valve body 500*a* by a resilient member 503 to keep the sealing surface 501*c* of the valve plug 501, that is, the surface of the tapered, second valve body side of the valve plug 501, tightly in contact with the tapered seal portion 500*c* of the first valve body 500*a*, to seal a joint opening 530. Referring to FIG. 12, if the above described twisting phenomenon occurs in the above described structure of the comparative example, the valve plug 501 makes contact with the second valve body 500*b* at two areas, that is, a contact surface 510*a* and a contact surface 511*b*. Representing the distance between these two contact surfaces, and the amount of the clearance, with X and Y, the twist angle θ is: $\theta=\tan^{-1}(2Y/X)$. Assuming that the clearance remains the same, the greater the distance X between the two contact surfaces, the smaller the value of the twist angle θ.

In the case of this comparative example, however, the length X of the contact surface is relatively small (compared to the valve plug diameter, for example), rendering the twist angle θ relatively large. In other words, in order to rectify the twisting, a rotational motion with a relatively large angle is necessary. Therefore, it is evident that the probability that the twisting is rectified after its occurrence is small.

Referring to FIG. 13, if a contact is made with the first valve body 500*a* without rectification of the twisting, the tapered seal portion 501*c* of the valve plug 501 becomes different in the contact radius from the tapered seal portion 500*c* of the first valve body 500*a*. As a result, the contact portions fail to make perfect contact with each other, allowing ink leakage to occur.

The second valve body 500*b* and a valve cover 502 are welded by ultrasonic waves. The valve cover in the comparative example is a simple flat one, raising the possibility that the ultrasonic waves causes misalignment, that is, the accuracy with which the center hole of the valve cover 502, though which the sliding axis 501*a* of the valve plug 501 is put, varies, making it necessary to enlarge the center hole of the valve cover 502 to prevent the wall of the hole of the valve cover 502 from contacting the sliding axis 501*a* of the valve plug 501. Consequently, it becomes difficult to reduce the size of the resilient member 503, and therefore, it becomes difficult to reduce the size of the entirety of the valve mechanism, because the minimum diameter of the resilient member 503 is dependent upon the diameter of the hole of the valve cover 502.

Figure 14:
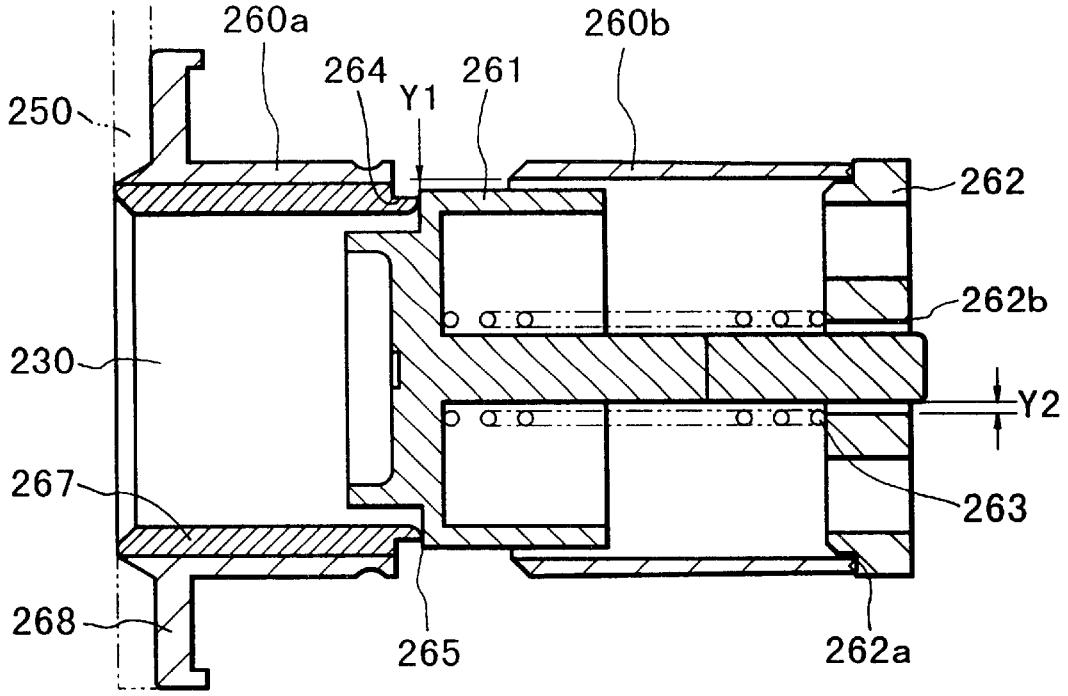
FIG. 14 is a sectional drawing for depicting the valve mechanism in accordance with the present invention.
Figure 15:
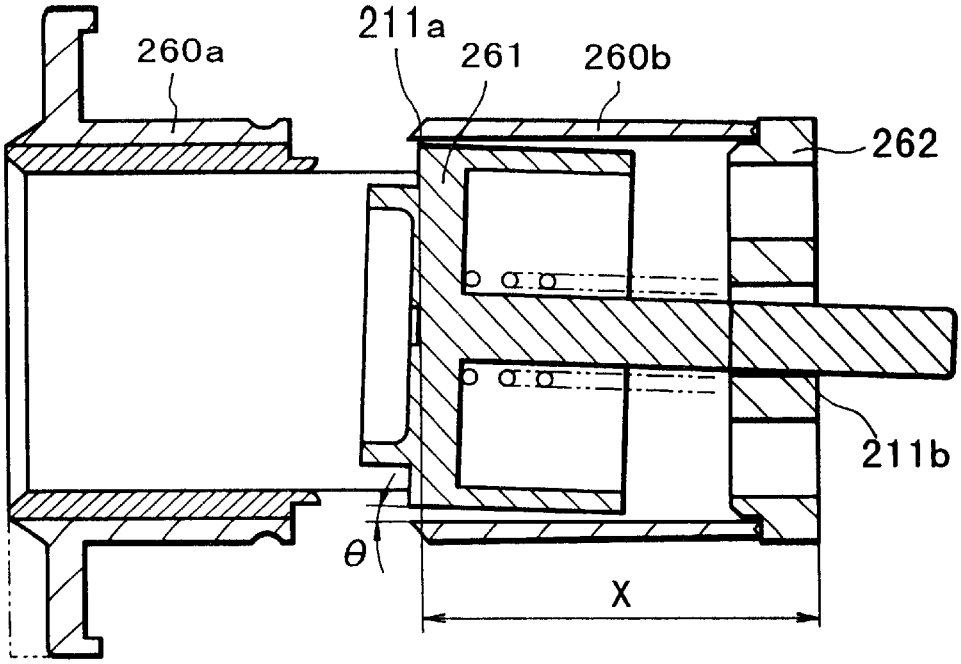
FIG. 15 is a sectional drawing for depicting the state of twisting in the valve mechanism illustrated in FIG. 14.
Figure 16:
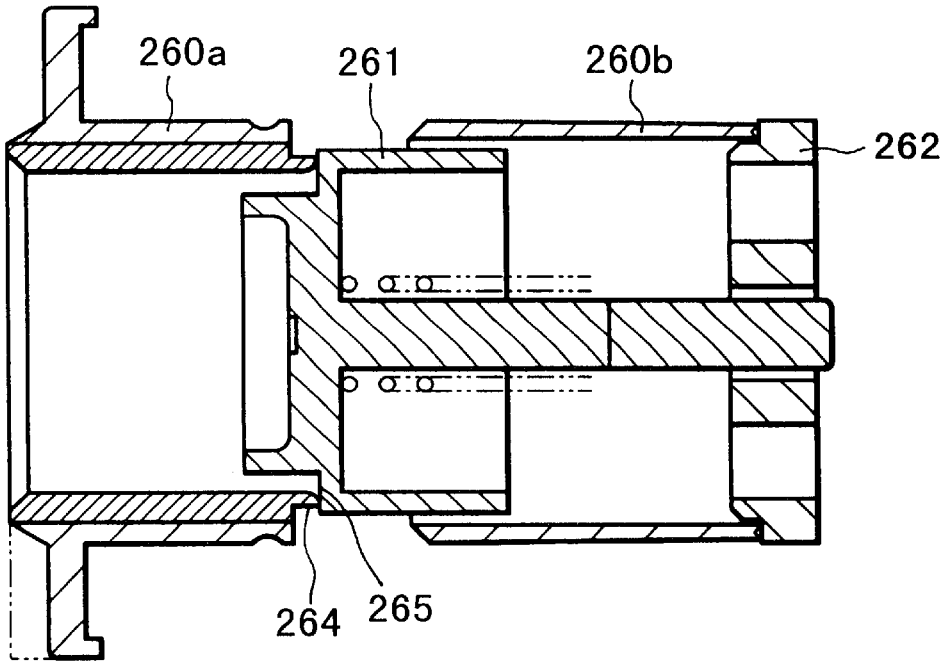
FIG. 16 is a sectional drawing for depicting how the liquid outlet is sealed by the valve mechanism illustrated in FIG. 14.

In contrast to the above described comparative example, the valve mechanism in this embodiment has the following structure. FIG. 14 shows the valve mechanism in this embodiment of the present invention, and FIGS. 15 and 16 show the twisting of the valve mechanism in FIG. 14, and the state of the relationship between the two seal portions. Referring to FIG. 14, in this embodiment, the valve plug 261 is tapered in terms of the stroke direction (rightward direction in the drawing); the diameter (at least, length of the major axis) of the valve plug 261 gradually reduces in terms of the rightward direction. The interior wall of the second valve body 260*b* is tapered so that its diameter gradually increases in terms of the stroke (rightward) direction. With this structural arrangement, in order for the valve plug 261 to come into contact with the second valve body 260*b* at a position equivalent to the contact surface 51*b* in the comparative example in FIG. 12 when the valve plug 261 is twisted, a substantially larger angle is necessary, and before the angle of the valve plug 261 reaches this substantially large angle, the sliding axis of the valve plug 261 comes into contact with the wall of the hole of the valve cover 262 (FIG. 15). Thus, the length of X of the contact surface can be set to be longer, making it possible to reduce the amount of the twist angle θ. Therefore, even if the twisted valve plug 261 is placed in contact with the first valve body 500*a* without being rectified in its twist as shown in FIG. 16, the twist angle θ is extremely small compared to the comparative example; the interfaces between the seal portion 265 of the valve plug 261 and the seal portion 264 of the first valve body 260*a* are better sealed.

It should be noted here that representing the length of the contact surface, and the clearance between the sliding axis of the valve plug 261 and the hole of the valve cover 260*b*, with X and Y1:

$$\theta=\tan^{-1}(Y1+Y2/X).$$

The valve cover 252 is provided with a valve cover welding guide 262*a*, which is a stepped portion (depth of penetration by the valve cover: 0.8 mm), and comes in contact with the edge of the second valve body 260*b* as the valve cover 252 is pushed into the second valve body 260*b*. Therefore, the hole of the valve cover 262, through which the sliding axis of the valve plug 261 is put, is rendered smaller than that in the comparative example. In other words, the provision of the valve cover 262 with the welding guide 262*a* reduces the amount of the misalignment between the second valve body 260*b* and the valve cover 262 which is caused by the vibrations occurring during the welding between the two components, and therefore, the accuracy with which the hole of the valve cover 262 is positioned is improved. Thus, it becomes possible to reduce the diameter of the hole of the valve cover 262, which makes it possible to reduce the diameter of the resilient member 263. Consequently, it becomes possible to reduce the size of the valve mechanism. Further, even if force is applied by the valve plug 261 through the sliding axis of the valve plug 261 due to the twisting of the valve plug 261, the rigidity of the valve cover 262 is secured by the valve cover welding guide 262*a*.

The ridge line portion of the hole of the valve cover 262 is provided with an R portion 262*b*. This R portion 262*b* is provided at only the ridge line on the non-welding surface side (right-hand side in the drawing). With the provision of this arrangement, the friction between the sliding axis of the valve plug 261 and the valve cover 262 during the movement, in particular, the opening movement, of the valve plug 261 in the twisted state, can be reduced.

The end portion of the valve plug 261, which comes into contact with the first valve body 260*a*, is a seal portion 265 of the valve plug 261, which has a flat surface. In contrast, the portion of the first valve body 260*a*, which the seal portion 265 of the valve plug 261 contacts, is the seal portion 264 of the first valve body sealing portion 264, that is, the surface of a piece of elastomer 267 placed on the interior surface of the first valve body 260*a*. Flattening the seal portion of the valve plug 261 and first valve body 260*a* equalizes the contact radii of the valve plug 261 having the oblong cross section, with the R portion of the first valve body 260*a*; perfect contact is made between the valve plug 261 and first valve body 260*a*. In addition, the seal portion 264 of the first valve body 260*a* is shaped like a tongue sticking out of a mouth, assuring further that the interfaces between the two components are flawlessly sealed.

In the case of a valve mechanism structured as described above, if clearance is provided between the valve plug 261 and second valve body 260*b*, it occurs sometimes that the valve plug 261 rotates about its axis, within the second valve body 260*b*, during the installation or removal of the ink container unit 200, as shown in FIG. 9C. In this embodiment, however, even if the valve plug 261 is rotated about its axis to the maximum angle, and then, is pressed upon the first valve body 260*a* while remaining in the maximumly rotated state, the contact between the valve plug 261 and first valve body 260*a* is by their seal portions 265 and 264, respectively; in other words, the contact is made surface to surface. Therefore, it is assured that the valve mechanism is airtightly sealed.

In addition, since the joint opening 230 and valve mechanism are shaped so that their cross sections become oblong, the rotational angle of the valve plug 261 during the sliding of the valve plug 261 can be minimized, and also, the valve response can be improved. Therefore, it is possible to assure that the valve mechanism of the joint opening 230 flawlessly functions in terms of sealing performance. Further, since the joint opening 230 and valve mechanism are shaped so that their cross sections become oblong, the projection 180*a* for sealing, provided on the peripheral surface of the joint opening 230, and the valve plug 261, swiftly slide through the joint opening 230 during the installation or removal of the ink container unit 200, assuring that the connecting operation ensues smoothly.

Figure 17A:
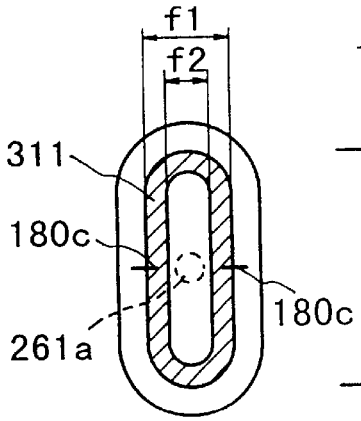
FIGS. 17A to 17D are schematic drawings for depicting how the valve plug of the valve mechanism illustrated in FIG. 14 engages with the end portion of the joint pipe.
Figure 17B:
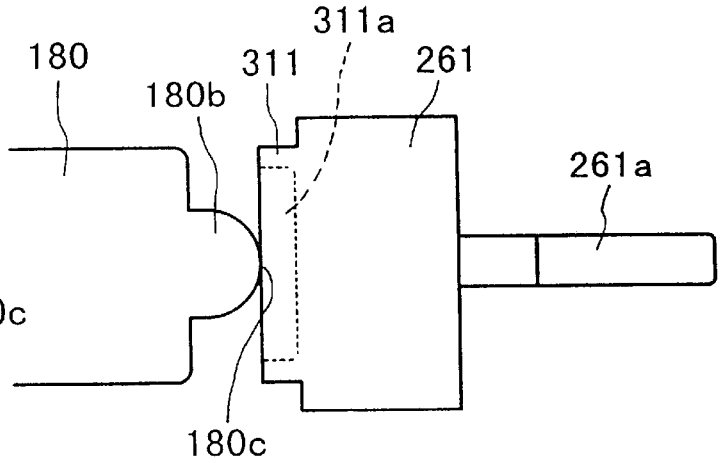
Figure 17C:
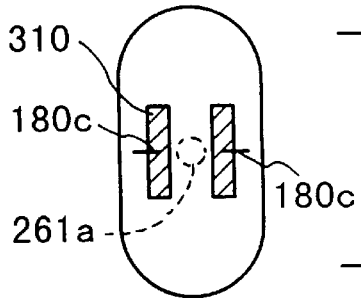
Figure 17D:
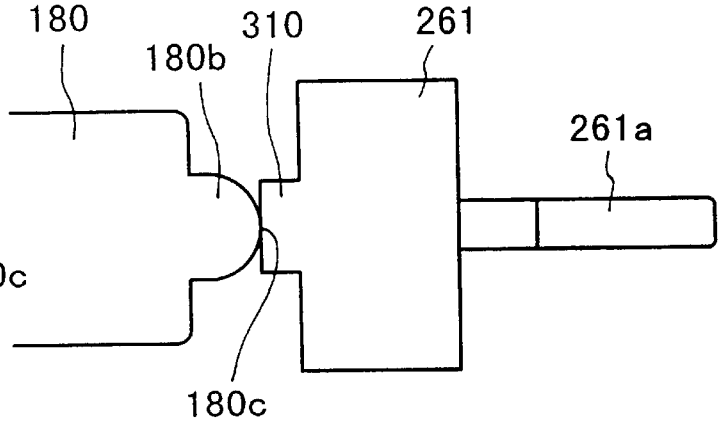

Referring to FIG. 10, the end portion of the joint opening 230, which makes contact with the valve plug 261, comprises two symmetrical absorbent material pieces180*b*. There are the opening 181*a* for gas-liquid exchange, on the top side of the end portion of the joint opening 230, and the opening 181*b*for supplying liquid, on the bottom side. Therefore, a study was made regarding the idea of providing the valve plug 261 with a pair of contact ribs 310 as counterparts to the projection 180*b*, which are to be positioned on the areas excluding the sealing portion 265 which is placed tightly in contact with the sealing portion 264 of the first valve body 260*a*, as shown in FIGS. 17C and 17D. However, during the opening of the valve, the valve plug 261 is pushed back by the force from the resilient member 263, and therefore, the rib portions are required to have a certain amount of rigidity, high enough to prevent the deformation of the rib portions. In addition, regarding the positioning and shapes of the contact rib portions, it is required, from the viewpoint of reliability, that even if the positions of the contact rib portions of the valve plug 261 shift in the radial direction of the sliding axis of the valve plug 261, relative to the two valve activation projections 180*b* of the joint pipe 180, the moments which generate at the two contact rib portions which oppose each other across the sliding axis 261*a*, cancel each other. Therefore, in this embodiment, the valve plug 261 is provided with a circular rib 311 (0.6 mm in width and 1.3 mm in height), which is similar in cross section to the joint pipe 180 which has the oblong cross section, as shown in FIGS. 17A and 17B. In other words, the surface of the valve plug 261, on the first valve body side, excluding the sealing portion 265 which is placed in contact with the sealing portion 264 of the first valve body 500*a*, is provided with an oblong recess 311*a*, the center of which coincides with the axial line of the valve plug 261. This structure provides the valve plug 261 with the strength and reliability required when the valve activation projection 180*b* makes contact with the valve plug 261. Making the rib circular, and making the center of the recess coincide with the axial line of the valve plug 261, could improve the moldability of the valve plug 261. From this viewpoint, regarding moldability, it is desired that the base portion of the circular rib, on the recess side, be given a minuscule curvature.

Referring to FIGS. 2, 3A and 3B, during the assembly of the ink container unit 200, the ID member 250 is attached by welding and interlocking, after the valve mechanism comprising the first valve body 260*a* and second valve body 260*b* is inserted into the ink delivery opening of the ink storing container 201. In particular, the internal bladder 220 is exposed at the edge of the opening of the ink delivery opening of the ink storing container 201, and the flange 268 of the first valve body 260*a* of the valve mechanism is welded to this exposed portion 221*a* of the internal bladder 220. Thereafter, the ID member 250 is welded at the location of the flange 268, and is interlocked with the engagement portions 201*a* of the container external shell 210.

In the case of this type of assembly, for example, the flange 508 of the first valve body, to which the ID member 550 is attached, is flat as it is in the case of the comparative example illustrated in FIG. 11; the elastomer layer 567 is not exposed at the edge of the ink delivery opening with which the ID member 550 is provided, and therefore, there is a possibility that seal leakage may occur during the process, illustrated in FIG. 5, for connecting the joint pipe 180. Thus, in this embodiment, the welding surface of the flange 508 of the first valve body, to which the ID member 550 is welded, and which was in the same plane as the plane of the opening of the joint opening 530, has been moved in the direction opposite to the container installation direction. In other words, the first valve body flange 268 is positioned so that when the ID member 250 is glued to the first valve body flange 268 as shown in FIGS. 2, 14, and the like, the plane of the external surface of the ID member 250 coincides with the plane of the opening of the joint opening 230. This structural arrangement assures the presence of the elastomer layer 267 inside the ink delivery hole with which the ID member 250 is provided, rendering the valve mechanism into a highly reliable one which allows no possibility of the aforementioned seal leakage. Further, since the first valve body flange 268 has been moved away from the plane of the opening of the joint opening 230, the opening portion of the joint opening 230 protrudes from the surface of the first valve body flange 268. Therefore, when the ID member 250 is attached, the position of the ID member is guided by the opening portion of the joint opening 230, making it easier to accurately position the ID member 250.

Each ink storing container 201 of the ink container unit 200 in this embodiment is installed into the holder 150, and supplies the correspondent negative pressure controlling chamber shell 110 with ink through the joint pipe 180 and the valve mechanism of the joint opening 230 of the container 201. The holder 150 holding the ink storing containers 201 as described above is mounted on the carriage of a serial scanning type recording apparatus (FIG. 24) and is moved back and forth in the direction parallel to the plane of recording paper. In this case, it is desired from the viewpoint of product reliability that countermeasures are taken to prevent the state of the sealing between the interior surface of the joint opening 230 of the ink storing container 201, and the exterior surface of the joint pipe 180 of the negative pressure controlling chamber shell 110, from deteriorating due to the twisting which is caused at the joint by the run out of the axis of the joint pipe 180, the shifting of the ink storing containers 201, and the like, which occur as the carriage is moved back and forth.

Therefore, in this embodiment, the thickness of the elastomer layer 267 in the first valve body 260*a* of the valve mechanism shown in FIGS. 2, 14, and the like, is made greater than the minimum requirement for sealing between the first valve body 260*a* and joint pipe 180, so that the run out of the shaft and the twisting, which occur at the location of the joint pipe connection during the reciprocal movement of the carriage, can be neutralized by the elasticity of the elastomer layer, to ensure a high level of reliability in terms of sealing performance. As for other measures, the rigidity of the valve body into which the joint pipe 180 is inserted may be rendered greater than the rigidity of the joint pipe 180, so that the deformation of the valve body, which is caused by the run out of the shaft and the twisting, which occur at the location of the joint pipe connection during the reciprocal movement of the carriage, can be controlled, to ensure a high level of reliability in terms of sealing performance.

Next, referring to FIGS. 10, 17, and 25, the dimensions of the various components for realizing the aforementioned valve mechanism will be described.

Figure 25:
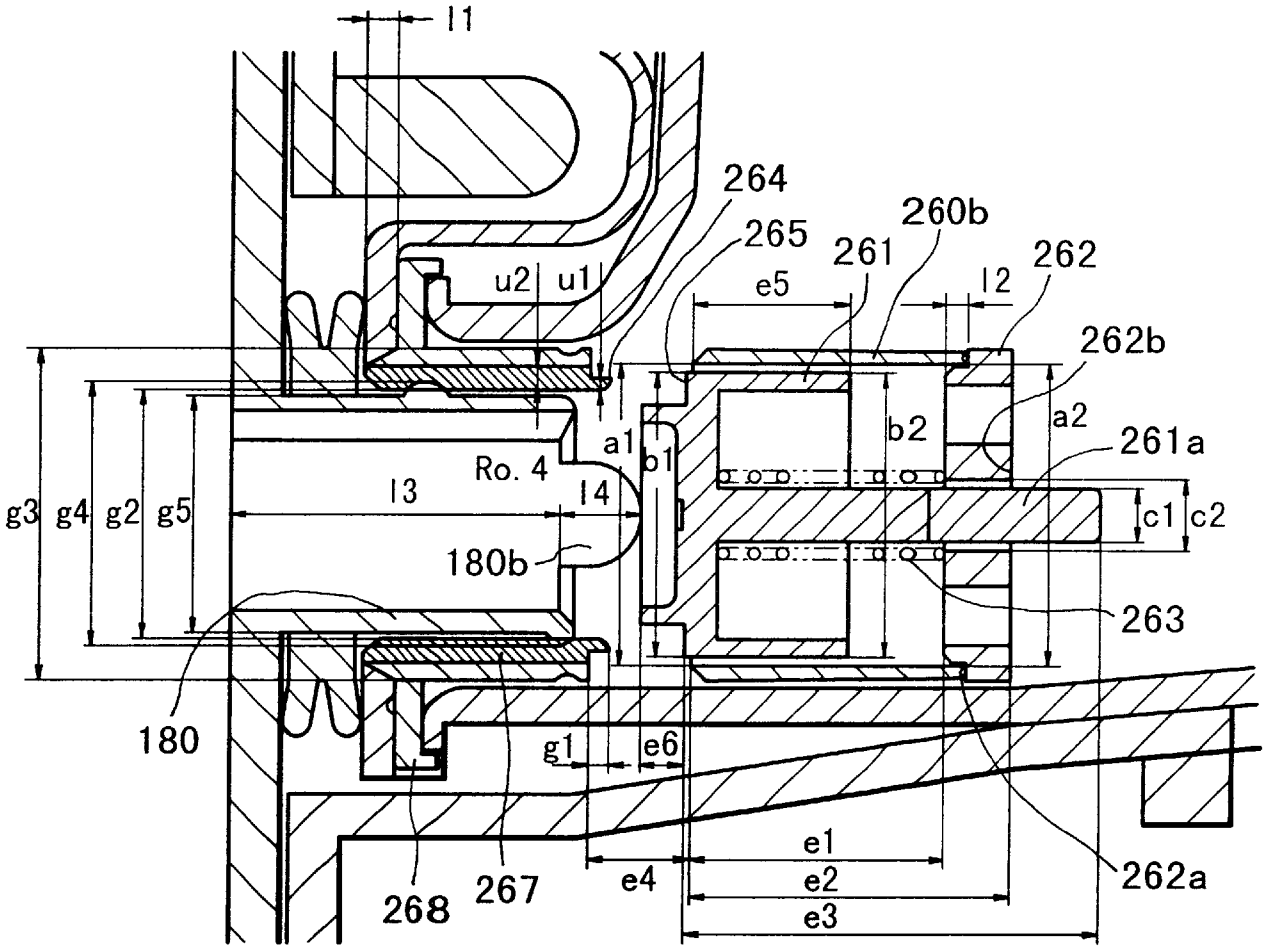
FIG. 25 is a sectional view of the ink container unit, for giving the measurements of the structural components which constitute the joint portion of the ink container unit in accordance with the present invention.

Referring to FIG. 25, the dimension e5 of the valve plug 261 in the longitudinal direction is 5.7 mm; the distance e3 from the sealing portion 265 of the valve plug 261 to the sliding axis 261*a* of the valve plug 261, 14.4 mm; distance e1 from the second valve body 260*b* to the inside surface of the valve cover 262, 8.7 mm; distance e2 from the second valve body 260*b* to the outside surface of the valve cover 262, 11.0 mm; length e4 of the opening between the first valve body 260*a* and second valve body 260*b*, 3.0 mm; the distance e6 the rib protrudes from the sealing portion 265 of the valve plug 261, 1.3 mm; the length 12 of the valve cover welding guide 262*a*, 0.8 mm; dimension b1 of the sealing portion 265 of the valve plug 261 in the longitudinal direction, 9.7 mm; dimension b2 of the valve plug 261, on the valve cover side, in the longitudinal direction, 9.6 mm; dimension al of the second valve body 260*b*, on the first valve body side, in the longitudinal direction; 10.2 mm; dimension a2 of the second valve body 260*b*, on the valve cover side, in the longitudinal direction, 10.4 mm; diameter c1 of the sliding axis of the valve plug 261, 1.8 mm; diameter c2 of the hole of the valve cover 262, through which the sliding axis of the valve plug 261 is put, 2.4 mm; length of a spring as the resilient member 263, 11.8 mm (spring constant: 1.016 N/mm); R portion 262*b* of the valve cover 262, R0.2 mm (entire circumference); length g1 of the sealing portion 264 of the first valve body, which is a part of the elastomer layer 267, 0.8 mm; R portion of the sealing portion 264 of the first valve body, R0.4 mm; thickness ul of the sealing portion 264 of the first valve body, 0.4 mm; thickness u2 of the elastomer layer 267, 0.8 mm; internal diameter g2 of the elastomer layer 267 in the longitudinal direction, 8.4 mm; external diameter g3 of first valve body 260*a* in the longitudinal direction, 10.1 mm; external diameter g5 of the joint pipe 180 in the longitudinal direction, 8.0 mm; external diameter g4, inclusive of the sealing projection 180*a*, of the joint pipe 180 in the longitudinal direction, 8.7 mm; distance 11 of the setback of the first valve body flange 268, 1.0 mm; length 13 of the joint pipe 180, 9.4 mm; and the length 14 of the valve activation projection 180*b* is 2.5 mm.

The length g1 of the sealing portion 264 of the first valve body is set at 0.8 mm; it is desired that the length g1 is sufficient to allow the sealing portion 264 of the first valve body to protrude far enough from the valve body so that the sealing portion 264 bends outward and perfectly seals the gap as it makes contact with the sealing portion 265 of the sealing portion 264 of the valve plug 261.

For the reason given above, the length g1 of the sealing portion of the first valve body has only to be within a range which satisfies the following inequality:

$$(g3-g2)/2>g1>(b1-g2)/2.$$

As for the dimension of the valve activation projection 180*b* of the joint pipe 180, and the rib 311 of the valve plug 261, which are in contact with each other as shown in FIGS. 10 and 17, the thicknesses t of the joint pipe 180 and rib 211 are 0.75 mm; distance f3 between the inside surfaces of the opposing valve activation projection 180*b*, 1.7 mm; distance f4 between the outside surfaces of the opposing valve activation projection 180*b*, 3.2 mm; distance f1 between the outside surfaces of the oblong rib 311 of the valve plug 261 at the short axis of the oblong rib 311, 2.6 mm; distance f2 between the inside surfaces of the rib 311 at the short axis, 1.4 mm; and the length d of the rib 311 is 3.6 mm.

It is desired from the viewpoint of molding accuracy that the thickness u2 of the elastomer layer 267 on the inside surface of the first valve body 260*a* with the oblong cross section is even; the thickness at the curved portion and the thickness at the straight portion are the same. In terms of the vertical direction of the joint opening 230, the depth of the sealing bite between the elastomer layer 267 and the largest diameter portion (portion comprising the sealing projection 180*a*) of the joint pipe 180 is: g4−g2=0.3 mm, and this amount is absorbed by the elastomer layer 267. The total thickness of the elastomer layer 267, which is involved in the absorption is: 0.8 mm×2=1.6 mm. However, since the depth of the bite is 0.3 mm, it does not require as much force as otherwise necessary, to deform the elastomer layer 267. Also in terms of the horizontal direction of the joint opening 230, the depth of the bite for sealing is set at 0.3 mm, and the elastomer layer 267, the total thickness of which for the absorption is: 0.8 mm×2=1.6 mm, is made to absorb this amount. The exterior diameter g5 of the joint pipe 180 in the vertical direction is smaller than the internal diameter g2 of the elastomer layer 267: g5<g2, and this relationship also applies to the horizontal direction: g5<g2. Therefore, in the state illustrated in FIG. 25, it is assured that the elastomer layer comes into contact with only the sealing projection 180*a* of the joint pipe 180, allowing the joint pipe 180 to be smoothly inserted, to perfectly seal the joint. The play in the horizontal direction between the ink storing container 201 and holder 150 has only to be in a range (±0.8 mm in this embodiment) in which the play can be absorbed by the thickness of the elastomer layer 267. In this embodiment, the maximum tolerance of the play is set at ±0.4 mm. In this embodiment, if the amount of the play in the horizontal direction (amount of displacement from the center) is greater than a half of the absolute value of the difference between the external diameter g5 and the internal diameter g2 of the elastomer layer 267 (in other words, if the amount of the play in this embodiment in terms of the horizontal direction is no less than ±0.2 mm), the external surface of the joint pipe 180, exclusive of the external surface of the sealing portion 180*a*, contacts the elastomer layer 267 across a wide range, and presses thereupon. Therefore, the resiliency of the elastomer generates centering force.

Employing the above listed measurements made it possible to realize a valve mechanism capable of providing the above described effects.

<Effects of Valve Mechanism Position>

In the case of the ink jet head cartridge in this embodiment, the valve cover 262 and second valve body 260*b* of the valve mechanism attached to the joint opening 230 of the ink container unit 200 protrude deeper into the internal bladder 220. With this arrangement, even if the internal bladder 220 becomes separated from the external shell 210, across the portion adjacent to the joint opening 230 due to the deformation of the internal bladder 220 caused by the consumption of the ink in the internal bladder 220, the deformation of the internal bladder 220, adjacent to the joint opening 230, is regulated by the portion of the valve mechanism, which has been deeply inserted into the internal bladder 220, that is, the valve cover 262 and second valve body 260*b*. In other words, even if the internal bladder 220 deforms as the ink is consumed, the deformation of the internal bladder 220, immediately adjacent to the valve mechanism and in the area surrounding the immediate adjacencies of the valve mechanism, is regulated by the valve mechanism, and therefore, the ink path in the adjacencies of the valve mechanism, in the internal bladder 220, and the bubble path for allowing bubbles to rise during gas-liquid exchange, are ensured. Therefore, during the deformation of the internal bladder 220, ink is not prevented from being supplied from the internal bladder 220 into the negative pressure controlling chamber unit 100, and the bubbles are not prevented from rising in the internal bladder 220.

In the case of the ink container unit 200 comprising the internal bladder 220 deformable as described above, or the ink jet head cartridge equipped with the negative pressure controlling chamber unit 100, it is desired from the viewpoint of increasing the buffering space in the external shell 210 that balance is maintained between the negative pressure in the internal bladder 220 and the negative pressure in the negative pressure controlling chamber shell 110 so that the gas-liquid exchange occurs between the ink container unit 200 and negative pressure controlling chamber unit 100 after the internal bladder 220 is deformed to the maximum extent. For the sake of high speed ink delivery, the joint opening 230 of the ink container unit 200 may be enlarged. Obviously, it is desired that there is a large space in the region adjacent to the joint opening 230 of the internal bladder 220, and that ample ink supply path is secured in this region.

If the deformation of the internal bladder 220 is increased to secure the buffering space in the external shell 210 which contains the internal bladder 220, normally, the space adjacent to the joint opening 230 in the internal bladder 220 narrows as the internal bladder 220 deforms. If the space adjacent to the joint opening 230 in the internal bladder 220 narrows, the bubbles are prevented from rising in the internal bladder 220, and the ink supply path adjacent to the joint opening 230 is shrunk, raising the possibility that they will fail to compensate for the high speed ink delivery. Therefore, in the case that the valve mechanism does not protrude deeply into the internal bladder 220, and the deformation of the internal bladder 220, adjacent to the joint opening 230, is not regulated, unlike the ink jet head cartridge in this embodiment, the amount of the deformation of the internal bladder 220 must be kept within a range in which the deformation does not substantially affect the ink delivery, so that balance is maintained between the negative pressure in the internal bladder 220 and the negative pressure in the negative pressure controlling chamber shell 110, to compensate for the high speed ink delivery.

Comparatively, in this embodiment, the valve mechanism protrudes deeply into the internal bladder 220 as described above, and the deformation of the internal bladder 220, adjacent to the joint opening 230, is regulated by the valve mechanism. Therefore, even if the deformation of the internal bladder 220 is increased, the region adjacent to the joint opening 230, that is, the region through which the ink supply path leads to the joint opening 230, is secured by sufficient size, making it possible to accomplish both objects: securing a large buffering space in the external shell 210, and securing an ink delivery path capable of accommodating high speed ink delivery.

Below the bottom portion of the ink container unit 200 of the above described ink jet head cartridge, an electrode 270 used as an ink remainder amount detecting means for detecting the amount of the ink remaining in the internal bladder 220, as will be described later, is positioned. The electrode 270 is fixed to the carriage of a printer into which the holder 150 is installed. The joint opening 230 to which the valve mechanism is attached is located in the bottom portion of the ink container unit 200, adjacent to the front wall, that is, the wall on the negative pressure controlling chamber unit side. The valve mechanism is inserted deep into the internal bladder 220 in the direction approximately parallel to the bottom surface of the ink container unit 200, and therefore, when the internal bladder 220 deforms, the deformation of the bottom portion of the internal bladder 220 is regulated by the deeply inserted portion of the valve mechanism. In addition, the deformation of the bottom portion of the internal bladder 220 during the deformation of the internal bladder 220 is regulated also by the slanting of a part of the bottom portion of the ink storing container 201 comprising the external shell 110 and internal bladder 220. Since the shifting of the bottom portion of the internal bladder 220 relative to the electrode 270 is regulated by the further regulation of the deformation of the bottom portion of the internal bladder 220 by the valve mechanism, in addition to, the effect of the regulation of the deformation of the bottom portion of the internal bladder 220 by the slanting of the bottom portion of the ink storing container 201, it becomes possible to more accurately carry out the ink remainder amount detection. Therefore, the above described regulation of the deformation of the internal bladder 220, adjacent to the joint opening 230, by the valve mechanism makes it possible to obtain a liquid supplying system capable of more accurately detecting the ink remainder amount, in addition to accomplishing the two objectives of securing a large buffering space in the external shell 210 by increasing the deformation of the internal bladder 220, and supplying ink at a high rate.

In this embodiment, the valve mechanism is inserted deeper into the internal bladder 220 so that the deformation of the internal bladder 220, adjacent to the joint opening 230, is regulated as described above, but a member different from the valve mechanism may be inserted into the internal bladder 220 to regulate the deformation of the aforementioned portion of the internal bladder 220. Further, a piece of plate may be inserted into the internal bladder 220 through the joint opening 230 so that the piece of plate stretches along the bottom surface of the internal bladder 220. With this arrangement, more accurate ink remainder amount detection can be carried out when the ink remainder amount in the internal bladder 220 is detected with the use of the electrode 270.

In addition, in this embodiment, in the valve mechanism attached to the joint opening 230, the structural components of the valve mechanism protrude far deeper into the internal bladder 220, beyond the opening 260*c* which is connected to the joint opening 230 to form an ink path. With this structural arrangement, it is assured that an ink path is secured in the adjacencies of the joint opening 230, in the internal bladder 220 of the ink container unit 200.

<Production Method for Ink Container>

Figure 18C:
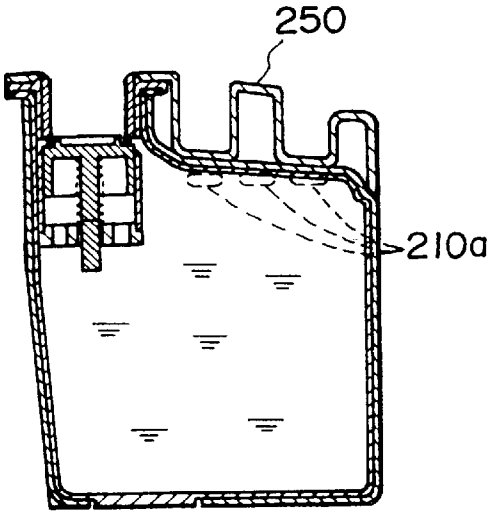
FIGS. 18A to 18C are sectional drawing for depicting the method for manufacturing an ink storing container in accordance with the present invention.

Next, referring to FIGS. 18A to 18C, a production method method for the ink container in this embodiment will be described. First, referring to FIG. 18A, the exposed portion 221*a* of the internal bladder 220 of the ink storing container 201 is directed upward, and the ink 401 is injected into the ink storing container 201 with the use of an ink injection nozzle 402 through the ink delivery opening. In the case of the structure in accordance with the present invention, ink injection can be performed under the atmospheric pressure.

Figure 18B:
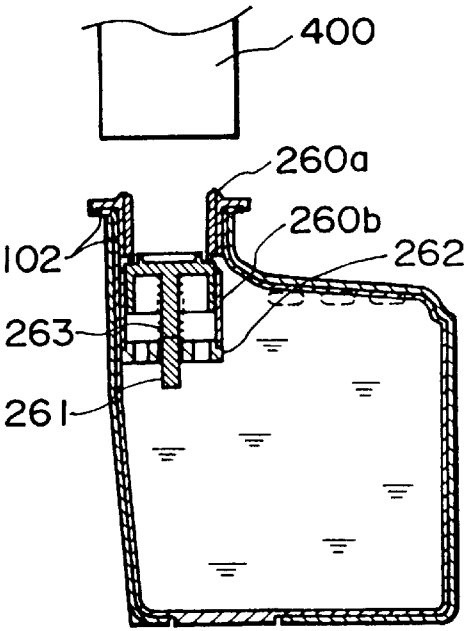
Figure 18A:
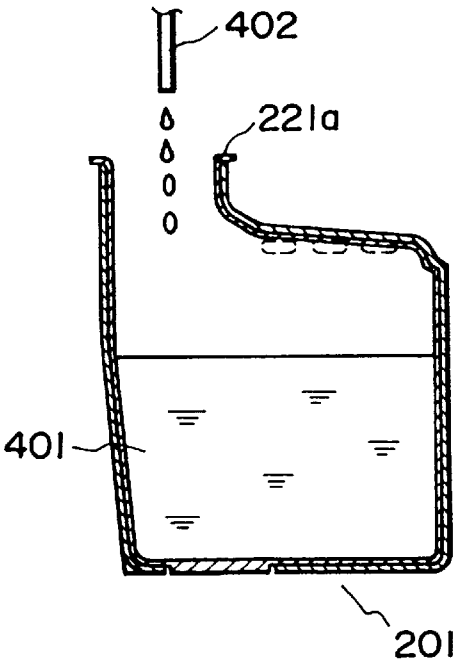

Next, referring to FIG. 18B, the valve plug 261, valve cover 262, resilient member 263, first valve body 260*a*, and second valve body 260*b*, are assembled together into a valve unit, and then, this valve unit is dropped into the ink delivery opening of the ink storing container 201.

At this point in time, the periphery of the sealing surface 102 of the ink storing container 201 is surrounded by the stepped shape of the first valve body 260*a*, on the outward side of the welding surface, making it possible to improve the positional accuracy with which the ink storing container 201 and first valve body 260*a* are positioned relative to each other. Thus, it becomes possible to lower a welding horn 400 from above to be placed in contact with the periphery of the joint opening 230 of the first valve body 260*a*, so that the first valve body 260*a* and the internal bladder 220 of the ink storing container 201 are welded to each other at the sealing surface 102, and at the same time, the first valve body 260*a* and the external shell 210 of the ink storing container 201 are welded to each other at the periphery of the sealing surface 102, assuring that the joints are perfectly sealed. The present invention is applicable to a production method which uses ultrasonic welding or vibration welding, as well as a production method which uses thermal welding, adhesive, or the like.

Next, referring to FIG. 18C, the ID member 250 is placed on the ink storing container 201 to which the first valve body 260*a* has been welded, in a manner to cover the ink storing container 201. During this process, the engagement portions 210*a* formed in the side wall of the external shell of the ink storing container 201, and the click portions 250*a* of the ID member 250, engage, and at the same time, the click portions 250*a* located on the bottom surface side engage, with the external shell 210, on the side opposite to the sealing surface 102 of the ink storing container 201, with the first valve body 260*a* interposed (FIG. 3).

<Detection of Ink Remainder Amount in Container>

Next, the detection of the ink remainder amount in the ink container unit will be described.

Referring to FIG. 2, below the region of the holder 150 where the ink container unit 200 is installed, the electrode 270 in the form of a piece of plate with a width narrower than the width of the ink storing container 201 (depth direction of the drawing) is provided. This electrode 270 is fixed to the carriage (unillustrated) of the printer, to which the holder 150 is attached, and is connected to the electrical control system of the printer through the wiring 271.

On the other hand, the ink jet head unit 160 comprises: an ink path 162 connected to the ink delivery tube 165; a plurality of nozzles (unillustrated) equipped with an energy generating element (unillustrated) for generating the ink ejection energy; and a common liquid chamber 164 for temporarily holding the ink supplied through the ink path 162, and then, supplying the ink to each nozzle. Each energy generating element is connected to a connection terminal 281 with which the holder 150 is provided, and as the holder 150 is mounted on the carriage, the connection terminal 281 is connected to the electrical control system of the printer. The recording signals from the printer are sent to the energy generating elements through the connection terminal 281, to give ejection energy to the ink in the nozzles by driving the energy generating elements. As a result, ink is ejected from the ejection orifices, or the opening ends of the nozzles.

Also, in the common liquid chamber 164, an electrode 290 is disposed, which is connected to the electrical control system of the printer through the same connection terminal 281. These two electrodes 270 and 290 constitute the ink remainder amount detecting means in the ink storing container 201.

Further, in this embodiment, in order to enable this ink remainder amount detecting means to detect more accurately the ink remainder amount, the joint opening 230 of the ink container unit 200 is located in the bottom portion, that is, the bottom portion when in use, in the wall of the ink storing container 201, between the largest walls of the ink storing container 201. Further, a part of the bottom wall of the ink supplying container 201 is slanted so that the bottom surface holds an angle relative to the horizontal plane when the ink storing container 201 is in use. More specifically, referring to the side, where the joint opening 230 of the ink container unit 200 is located, the front side, and the side opposite thereto, the rear side, in the adjacencies of the front portion in which the valve mechanism is disposed, the bottom wall is rendered parallel to the horizontal plane, whereas in the region therefrom to the rear end, the bottom wall is slanted upward toward the rear. In consideration of the deformation of the internal bladder 220, which will be described later, it is desired that this angle at which the bottom wall of the ink storing container 201 is obtuse relative to the rear sidewall of the ink container unit 200. In this embodiment, it is set to be no less than 95 degrees.

The electrode 270 is given a shape which conforms to the shape of the bottom wall of the ink storing container 201, and is positioned in the area correspondent to the slanted portion of the bottom wall of the ink storing container 201, in parallel to the slanted portion.

Hereinafter, the detection of the ink remainder amount in the ink storing container 201 by this ink remainder amount detecting means will be described.

The ink remainder amount detection is carried out by detecting the capacitance (electrostatic capacity) which changes in response to the size of the portion of the electrode 270 correspondent to where the body of the remaining ink is, while applying pulse voltage between the electrode 270 on the holder 150 side and the electrode 290 in the common liquid chamber 164. For example, the presence or absence of ink in the ink storing container 201 can be detected by applying between the electrodes 270 and 290, such pulse voltage that has a peak value of 5V, a rectangular waveform, and a pulse frequency of 1 kHz, and computing the time constant and gain of the circuit.

As the amount of the ink remaining in the ink storing container 201 reduces due to ink consumption, the ink liquid surface descends toward the bottom wall of the ink storing container 201. As the ink remainder amount further reduces, the ink liquid surface descends to a level correspondent to the slanted portion of the bottom wall of the ink storing container 201. Thereafter, as the ink is further consumed (the distance between the electrode 270 and the body of the ink remains approximately constant), the size of the portion of the electrode 270 correspondent to where the body of ink remains, gradually reduces, and therefore, capacitance begins to reduce.

Eventually, the ink will disappear from the area which corresponds with the position of the electrode 270. Thus, the decrease of the gain, and the increase in electrical resistance caused by the ink, can be detected by computing the time constant by changing the pulse width of the applied pulse or changing the pulse frequency. With this, it is determined that the amount of the ink in the ink storing container 201 is extremely small.

The above is the general concept of the ink remainder amount detection. In reality, in this embodiment, the ink storing container 201 comprises the internal bladder 220 and external shell 210, and as the ink is consumed, the internal bladder 220 deforms inward, that is, in the direction to reduce its internal volume, while allowing gas-liquid exchange between the negative pressure controlling chamber shell 110 and ink storing container 201, and the introduction of air between the external shell 210 and internal bladder 220 through the air vent 222, so that balance is maintained between the negative pressure in the negative pressure controlling chamber shell 110 and the negative pressure in the ink storing container 201.

Referring to FIG. 6, during this deformation, the internal bladder 220 deforms while being controlled by the corner portions of the ink storing container 201. The amount of the deformation of the internal bladder 220, and resultant partial or complete separation of the walls of the internal bladder 220 from the external shell 210, are the largest at the two walls having the largest size (walls approximately parallel to the plane of the cross sectional in FIG. 6), and is small at the bottom wall, or the wall adjacent to the above two walls. Nevertheless, with the increase in the deformation of the internal bladder 220, the distance between the body of the ink and the electrode 270, and the capacitance decreases in reverse proportion to the distance. However, in this embodiment, the main area of the electrode 270 is in a plane approximately perpendicular to the deformational direction of the internal bladder 220, and therefore, even when the internal bladder 220 deforms, the electrode 270 and the wall of the bottom portion of the internal bladder 220 remain approximately parallel to each other. As a result, the surface area directly related to the electrostatic capacity is secured in terms of size, assuring accuracy in detection.

Further, as described before, in this embodiment, the ink storing container 201 is structured so that the angle of the corner portion between the bottom wall and the rear sidewall becomes no less than 95 degrees. Therefore, it is easier for the internal bladder 220 to separate from the external shell 210 at this corner compared to the other corners. Thus, even when the internal bladder 220 deforms toward the joint opening 230, it is easier for the ink to be discharged toward the joint opening 230.

Hereinbefore, the structural aspects of this embodiment were individually described. These structures may be employed in optional combinations, and the combinations promise a possibility of enhancing the aforementioned effects.

For example, combining the oblong structure of the joint portion with the above described valve structure stabilizes the sliding action during the installation or removal, assuring that the value is smoothly open or closed. Giving the joint portion the oblong cross section assures an increase in the rate at which ink is supplied. In this case, the location of the fulcrum shifts upward, but slanting the bottom wall of the ink container upward makes possible stable installation and removal, that is, the installation and removal during which the amount of twisting is small.

<Ink Jet Head Cartridge>

Figure 23:
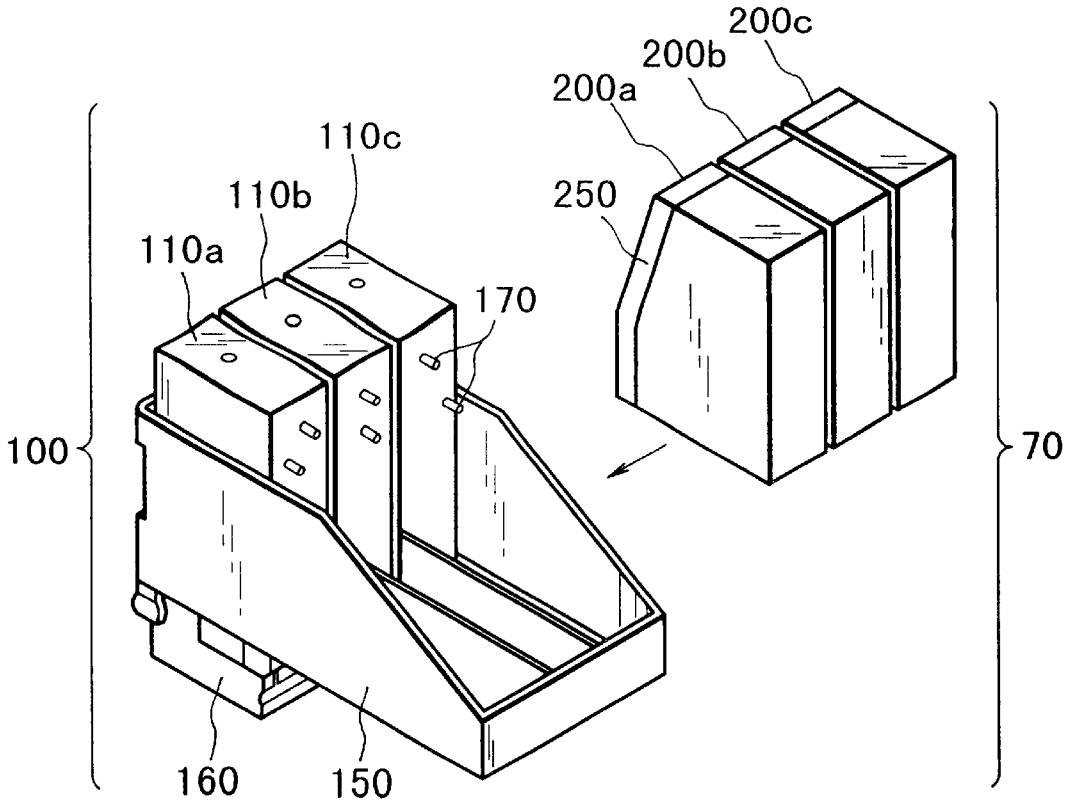
FIG. 23 is a schematic perspective view of an ink jet head cartridge compatible with the ink container unit in accordance with the present invention.

FIG. 23 is a perspective view of an ink jet head cartridge employing an ink container unit to which the present invention is applicable, and depicts the general structure of the ink jet head cartridge.

An ink jet head cartridge 70 in this embodiment, illustrated in FIG. 23, is provided with the negative pressure controlling chamber unit 100, which comprises the ink jet head unit 160 enabled to eject plural kinds of ink different in color (yellow (Y), magenta (M), and cyan (C), in this embodiment) and the negative pressure controlling chamber unit 100 integrally comprising the negative pressure controlling chamber shells 110*a*, 110*b*, and 110*c*. The ink container units 200*a*, 200*b*, and 200*c*, which contain liquid different in color are individually and removably connectible to the negative pressure controlling chamber unit 100.

In order to assure that the plurality of the ink container units 200*a*, 200*b*, and 200*c*, are connected to the correspondent negative pressure controlling chamber shells 110*a*, 110*b*, and 110*c*, without an error, the ink jet head cartridge is provided with the ink holder 150, which partially covers the exterior surface of the ink container unit 200, and each ink container unit 200 is provided with the ID member 250. The ID member 250 is provided with the plurality of the recessed portions, or the slots, and is attached to the front surface of the ink container unit 200, in terms of the installation direction, whereas the negative pressure controlling chamber shell 110 is provided with the plurality of the ID members 170 in the form of a projection, which corresponds to the slot in position and shape. Therefore, it is assured that the installation error is prevented.

In the case of the present invention, the color of the liquid stored in the ink container units may be different from Y, M, and C, which is obvious. It is also obvious that the number of the liquid containers and the type of combination of the liquid containers (for example, a combination of a single black (Bk) ink container and a compound ink container containing inks of Y, M, and C colors), are optional.

<Recording Apparatus>

Next, referring to FIG. 24, an example of an ink jet recording apparatus in which the above described ink container unit or ink jet head cartridge can be mounted will be described.

Figure 24:
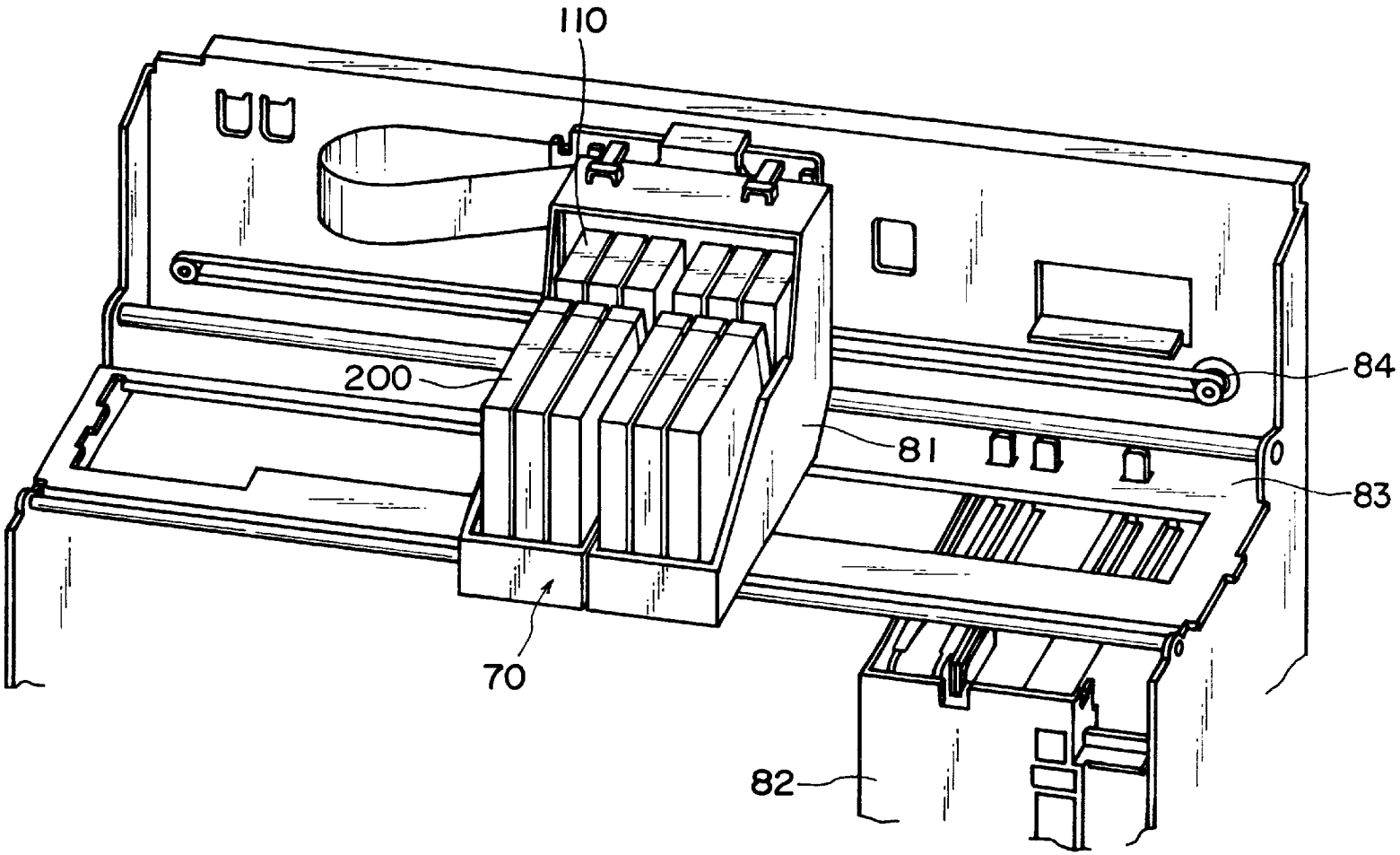
FIG. 24 is a schematic perspective view of a recording apparatus compatible with the ink jet head cartridge in accordance with the present invention.

The recording apparatus shown in FIG. 24 is provided with: a carriage 81 on which the ink container unit 200 and the ink jet head cartridge 70 are removably installable; a head recovery unit 82 assembled from a head cap for preventing ink from losing liquid components through the plurality of orifices of the head and a suction pump for sucking out ink from the plurality of orifices as the head malfunctions; and a sheet feeding surface 83 by which recording paper as recording medium is conveyed.

The carriage 81 uses a position above the recovery unit 82 as its home position, and is scanned in the leftward direction as a belt 84 is driven by a motor or the like. Printing is performed by ejecting ink from the head toward the recording paper conveyed onto the sheet feeding surface 83.

As described above, the above structure in this embodiment is a structure not found among the conventional recording apparatuses. Not only do the aforementioned substructures of this structure individually contribute to the effectiveness and efficiency, but also contribute cooperatively, rendering the entirety of the structure organic. In other words, the above described substructures are excellent inventions, whether they are viewed individually or in combination; disclosed above are examples of the preferable structure in accordance with the present invention. Further, although the valve mechanism in accordance with the present invention is most suitable for the usage in the above described liquid container, the configuration of the liquid container does not need to be limited to the above described one; it can be also applied to liquid containers of different types in which liquid is directly stored in the liquid delivery opening portion.

Referring to FIGS. 26A to 26J, the description will be made as to a joint opening of the ink container unit and another valve mechanism provided in the joint opening.

Figures 26A, 26B:
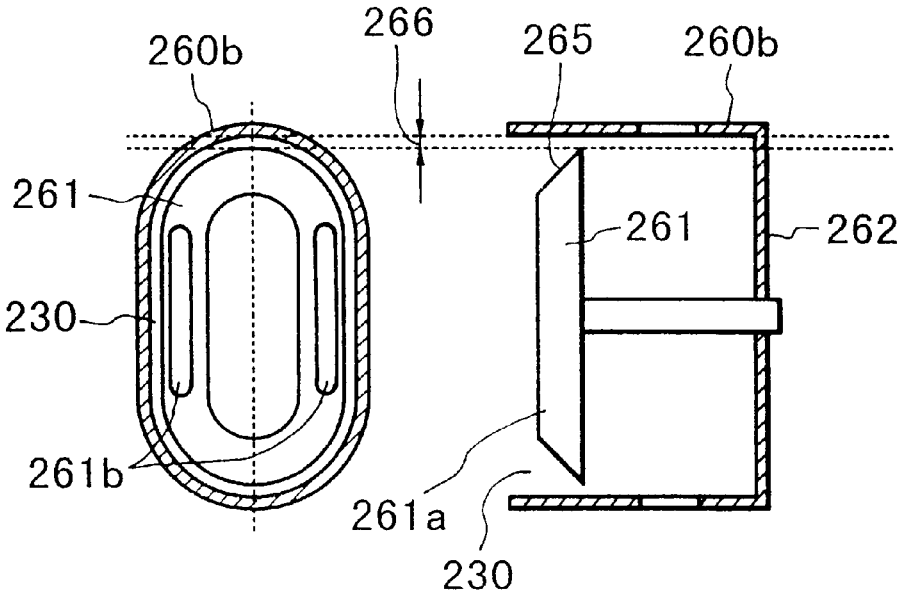
FIGS. 26A to 26J illustrate examples of a valve mechanism provided in the joint opening of the ink container unit.
Figures 26C, 26D:
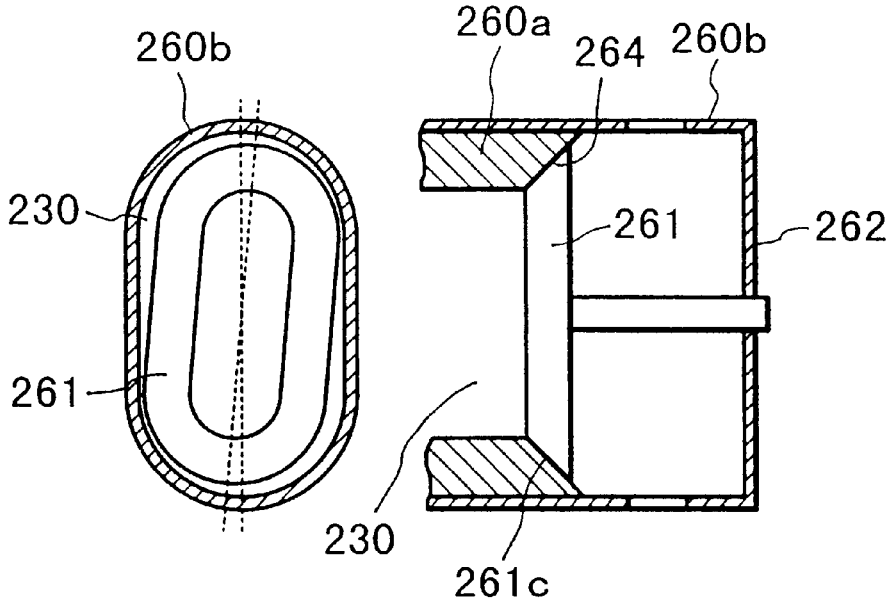

FIG. 26A is a front view illustrating a relation between the valve member 261 and the second valve frame 260*b*; FIG. 26B is a sectional view at the side of FIG. 26A; FIG. 26C is a front view showing a relation between the second valve frame 260*b* and the rotated valve member 261; and FIG. 26D is a sectional view at the side of FIG. 26C.

As shown in FIG. 26A and FIG. 26B, the opening configuration of the joint opening 230 is an elongated hole extended in one direction to provide high supply performance of the ink of the ink accommodating container 201 by expanding an opening area of the joint opening 230. The opening configuration of the elongated hole of the joint opening 230 has a portion having a constant opening width. The configuration of the valve member 261 at the first valve frame 260*a* side corresponds to inner shape of the cross-section of the joint opening 230, that is, the elongated hole configuration of the joint opening 230. However, if the opening width of the joint opening 230 in the widthwise direction perpendicular to the longitudinal direction of the joint opening 230, the space occupied by ink accommodating container 201 increases with the result of bulkiness of the apparatus. This is particularly significant when ink containers are juxtaposed in the lateral direction (scanning direction of the carriage) in the case of color or photographic printing. In this embodiment, the configuration of the joint opening 230 which is an ink supply port of the ink accommodating container 201 is an elongated hole.

Furthermore, the joint opening 230 of the ink jet head cartridge of the embodiment functions to supply the ink to the negative pressure control chamber unit 100 and to introduce the ambience into the ink accommodating container 201. Since the joint opening 230 is elongated in the direction of the gravity, the lower portion of the joint opening 230 mainly functions as an ink supply passage, and the upper portion of the joint opening 230 mainly functions as an ambience introduction path, so that function separation is easily accomplished by which assure ink supply and gas-liquid exchange can be accomplished. As described in the foregoing, the joint pipe 180 of the negative pressure control chamber unit 100 is inserted into the joint opening 230 with the mounting of the ink container unit 200. Then, third valve member 261 is pushed by the valve opening and closing projection 180*b* provided at a free end of the joint pipe 180 to open third valve mechanism of the joint opening 230, by which the ink inner is supplied into the negative pressure control chamber unit 100 from third inside of third ink accommodating container 201. Depending on the orientation or position of the ink container unit 200 which is being mounted to the joint pipe 180, the valve opening and closing projection 180*b* might be obliquely abutted to the valve member. Even if this happens, the valve member 261 is not clogged, since the cross-sectional configuration of the end of the seal projection 180*a* disposed at the side of the joint pipe 180 is semicircular. In order to accomplish stable sliding motion of the valve member 261 at this time, a clearance 266, as shown in FIG. 26A and FIG. 26B is provided between a joint seal surface 260 inside of the joint opening 230 and outer periphery of the first valve frame 260*a* side portion of the valve member 261. Moreover, at the free end portion of the joint pipe 180, at least the upper portion is open, and therefore, when the joint pipe 180 is inserted into the joint opening 230, the formation of the main ambience introduction path is not obstructed at the upper portion in the joint opening 230 and in the joint pipe 180, thus accomplishing smooth gas-liquid exchanging operation.

When the ink container unit 200 is dismounted, the joint pipe 180 is separated from the joint opening 230, by which the valve member 261 slides forward toward the first valve frame 260*a* by the elastic force applied by the urging member 263, until the taper portion 264 of the valve frame of the first valve frame 260*a* as shown in FIG. 26D is engaged with the taper portion 265 of the valve member 261, by which the ink supply passage is shut.

When the clearance 266 is provided to permit sliding motion, between the valve member 261 and the second valve frame 260*b*, in such a valve mechanism, the valve member 261 might rotate in the second valve frame 260*b* about nothing as shown in FIG. 26C during the mounting-and-demounting operation of the ink container unit 200.

On the other hand, in the urging force to the first valve frame 260*a* provided by the first valve frame 260*a* is selected such that even if pressure difference is produced between the inside and outside of the ink accommodating container 201 duty the ambient condition change, the urging force of the valve member 261 is maintained substantially constant. When such an ink container unit 200 is used at a highland (the ambient pressure is 0.7 atm, for example), and then, the valve member 261 is closed, and then the ink container unit 200 is transported to ambience of 1.0 atm, the inside pressure of the ink accommodating container 201 is lower than the ambient pressure, so that force is produced in the direction of opening the valve member 261. In this embodiment, similarly to the embodiment of FIG. 2:

$$FV > 1.01\times10^5 - 0.709\times10^5 = 0.304\times10^5 [N/m^2]$$

The values are those when the valve member 261 and the first valve frame 260*a* are engaged with each other. When the valve member 261 and the first valve frame 260*a* are disengaged from each other, the displacement of the urging member 263 to produce the urging force to the valve member 261 is large, so that urging force urging the valve member 261 toward the first valve frame 260*a* is further large.

A maximum rotation angle is defined as a rotation angle of the valve member 261 when the valve member 261 is contacted to the second valve frame 260*b* as a result of the rotation of the valve member 261 about the shaft thereof. When the valve member 261 is urged to the first valve frame 260*a* with the maximum rotation angle, the valve frame taper portion 264 and the valve member seal portion 261*c* are contacted at two diametrically opposite conditions about the center of the axis of rotation. The valve member 261 is urged toward the first valve frame 260*a* side by the urging force, and therefore, the valve member 261 produces a restoring force in the opposite rotational direction, and it stops with the valve frame taper portion 264 completely engaged with the seal portion 261*c* of the valve member. In the state of complete engagement between the taper portion 264 and the seal portion 261*c* of the valve member, they are engaged with each other in the engagement region 261*b* as shown in FIG. 26A. However, when the valve member 261 rotates, a frictional force is produced at the point of contact between the valve member seal portion 261c and the valve frame taper portion 264. If the rotation angle required for the restoration of rotation is small, the work required for the restoration is also small, so that first valve frame 260*a* and the valve member 261 are engaged with each other quickly.

The inventors have empirically found that when a ratio of the clearance 266 to the width first the valve member 261 is approx. 1:25, the maximum rotation angle of the valve member 261 is approx. 10°, and when the valve mechanism is closed with the valve member 261 is inclined, the rotation angle of the valve member 261 restores to 0° so that valve member 261 and the first valve frame 260*a* are valve member 261 with each other, in the case that ratio of the length to the width is larger than 3:2 in the configuration as seen in a direction perpendicular to the direction of the flow paths of the valve member 261 and the second valve frame 260*b*. When the ratios of the length to the width of the valve member 261 and the second valve frame 260*b* are smaller than 3:2, the maximum rotation angle of the valve member 261 cannot be restored, and therefore, when the valve mechanism is closed with the valve member 261 is inclined, the om restoration and the first valve frame 260*a* clog with each other with the result that hermeticality of the valve mechanism is not established.

Therefore, a length x measured in the longitudinal direction in the plane of the opening of the joint opening 230 and a width y in the plane of the opening of the joint opening 230, preferably satisfy $y/x<2/3$.

In this embodiment, the ratio of the length and the width in the configuration of the cross-section taken along a plane perpendicular to direction of the flow path of the valve member 261 and the second valve frame 260*b*, is approximately 10:5 which is larger the 3:2. The maximum rotation angle at this time was approx. 5°. When the valve mechanism is closed with the valve member 261 rotated, the rotation angle of the valve member 261 restores to 0°, so that valve member 261 and the first valve frame 260*a* are engaged with each other with the valve mechanism being substantially hermetically closed.

Referring to FIGS. 26E through 26J, the description will be made as to a further embodiment of the present invention. FIGS. 26E and 26H to FIGS. 26A and 26D.

The valve mechanism shown in FIGS. 26E through 26J comprises a first valve frame 260*a*, a second valve frame 260*b*, a valve member 261, an urging member 263*a*, a valve cap 262.

Figure 26E:
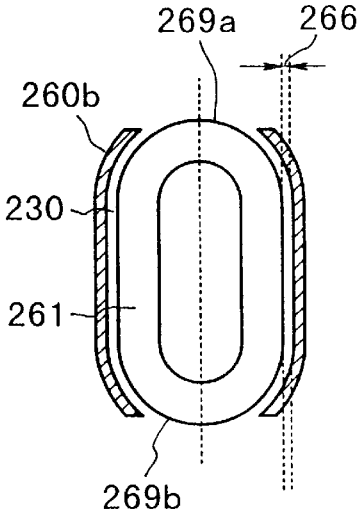
Figure 26F:
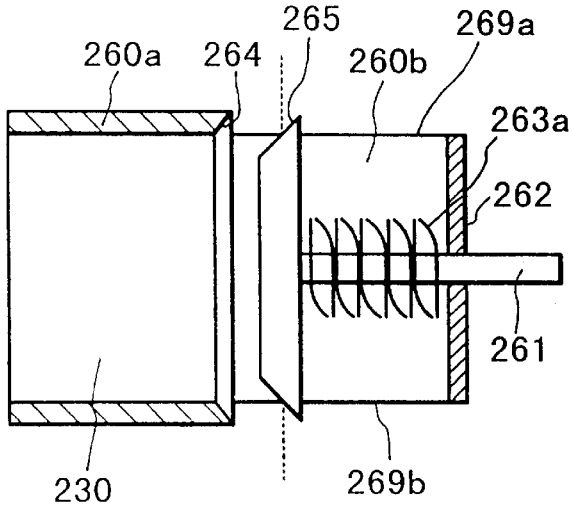
Figure 26G:
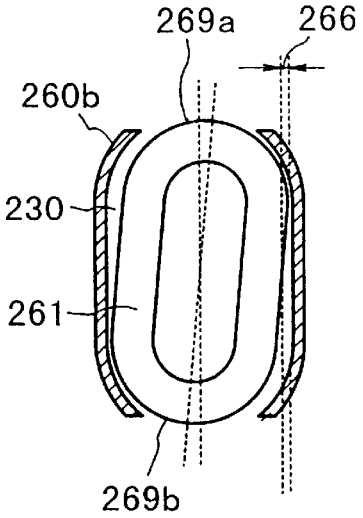
Figure 26H:
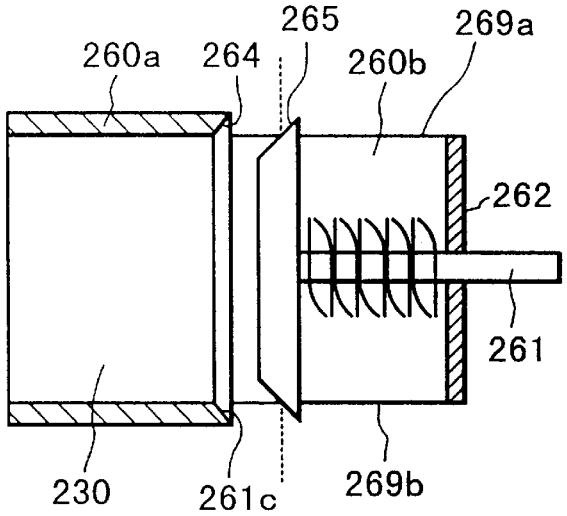
Figure 26I:
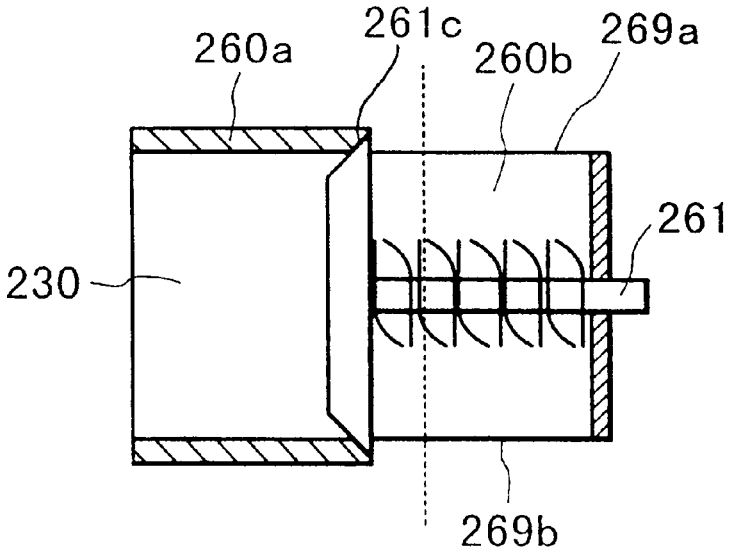
Figure 26J:
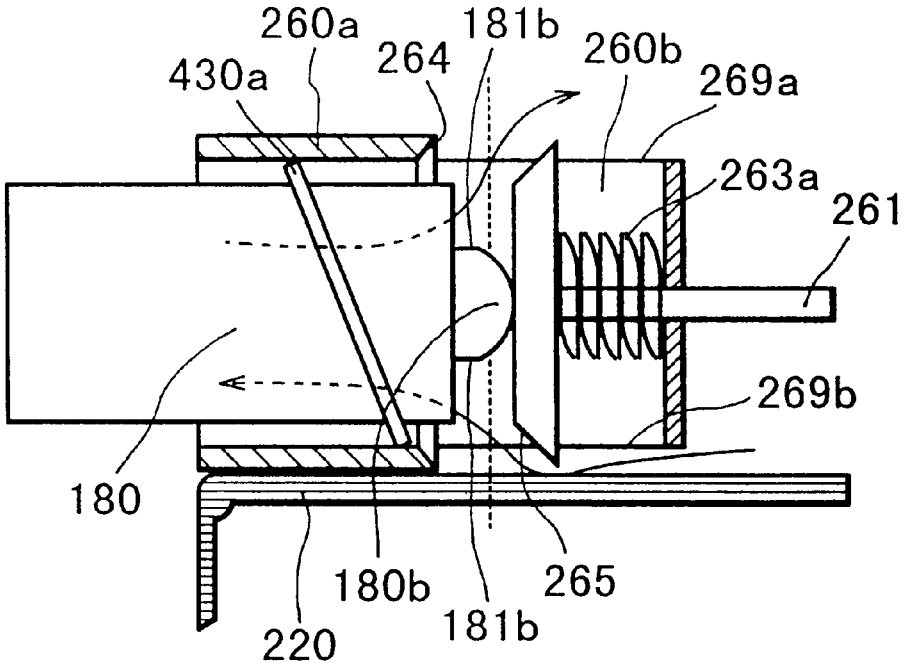

The valve member 261 is urged toward the first valve frame 260*a* by the urging member 263*a*, and by the abutment of the valve member taper part 265 to the valve frame taper part 264, the sealing is effected as shown in FIG. 26I, thus maintaining the hermeticality of the ink container unit 200. The valve member 261 is slidable in the second valve frame 260*b* (urged by a spring 263*a* which is similar to the above- described urging member 263) is urged by a projection 180*b* for opening and closing the valve,toward the valve cap 262, so that it slides in the second valve frame 260*b* by which the seal of the taper part is released as shown in FIG. 26J.

The second valve frame 260*b* is provided with an opening 269*b* adjacent the valve frame taper part 264 at a bottom portion side of ink container. With the structure of the opening 269*b*, when the valve mechanism is opened, the valve member 261 is pushed by a valve opening and closing projection 180*b*, and immediately after the movement toward the valve cap 262, the supply of the ink is started from the inside of the ink container unit 200 to the negative pressure control chamber unit 100, and in addition, the ink remaining amount at the end of the use of the ink is minimized. As shown in FIG. 26E, the opening 269*b* is open wide in the direction of the thickness of the ink container to such an extent that round part partly remains in the sliding portion of the valve member 261 of the second valve frame 260*b*. With this structure, the area of the opening 269*b* is maximized, and the clogging of the valve is properly provided, and therefore, the stable opening and closing of the valve can be assured with large flow rate.

In this embodiment, the opening 269*a* is provided in the second valve frame 260*b* at a symmetrical position relative to the opening 269*b*.

With this structure, since the openings 269*a*, 269*b* are large at the upper portion and the lower portion of the second valve frame 260*b*, the advantage that flow of the liquid and the flow of the gas during the gas-liquid exchange is assured is provided, in addition to the above- described advantageous effects. More particularly, the upper opening 269*a* functions as an ambience introduction path to positively pass the gas, and the lower opening 269*b* functions as an ink flow path to positively pass the liquid.

The dimensions of the parts constituting the valve mechanism of the joint pipe 180 shown in FIGS. 26A through 26J, are as follows: the length of the valve member 261 measured in the longitudinal direction is 9.5 mm; the width of the valve member 261 is 5.0 mm; the length of the second valve frame 260*b* measured in the longitudinal direction is 9.9 mm; the width of the second valve frame 260*b* is 5.4 mm; and the clearance 266 between the valve member 261 and the second valve frame 260*b* is 0.2 mm. The distance from the engagement region 261*b* of the valve member 261 to the valve cap 262 is approx. 15.5 mm when the valve member 261 and the first valve frame 260*a*, the rotation of the valve member 261 in the vertical direction in a plane substantially parallel width direction of the flow path about the fulcrum constituted by the contact portion between the sliding shaft of the valve member 261 and the valve cap 262 is approximately 0.70, which is negligible.

By the elongated configuration of the joint opening 230 and the valve mechanism and by the configuration of the valve member 261 corresponding to the configuration of the joint opening 230, the rotation angle of the valve member 261 with the sliding of the valve member 261 can be minimize, and the responsivity of the valve can be improved, and therefore, the sealing property of the valve mechanism at the joint opening 230 can be assured. Because the configurations of the valve mechanism and the joint opening 230 are elongated holes, the valve member 261 and the seal projection 180*a* disposed at the side of the joint pipe 180 can smoothly slide in the joint opening 230 during the mounting-and-demounting operation of the ink container unit 200, so that connecting operation is stabilized.

In this embodiment, the ink container unit 200 comprises the deformable inner bladder 220. However, the valve mechanism is available in an ink supply port of an ink container constituted by non-deformable walls. The ink supply port of the ink container has a configuration corresponding to the configuration of the joint opening 230, and the ink supply port is provided with a valve mechanism having the similar structure as the valve mechanism provided in the joint opening 230, by which the advantageous effects similar to the ink container unit 200 described-above for the ink supply port of the ink container.

The configuration of the joint opening 230 is not limited to the configuration shown in FIGS. 26A and 26B but may be any if it is elongated in one direction and if the above-described advantageous effects are provided, for example, ellipse configurations are usable.

As described in the foregoing, since the opening configuration of the ink supply port of the ink container is elongated in one direction, the rotation angle of the valve member when the valve member makes a sliding motion, the sealing property of the valve mechanism when it is closed, and in addition, the opening area of the ink supply port can be sufficiently large even when the width of the ink container is not be able to be large enough because of the limit of the space which can be used by the ink container or ink containers. Accordingly, the ink can be supplied at a large flow rate with high sealing performance. Moreover, there are provided an ink container, an ink jet cartridge and an ink jet recording apparatus, employing the valve mechanism.

The description will be as to the position of the valve structure.

Figure 27A:
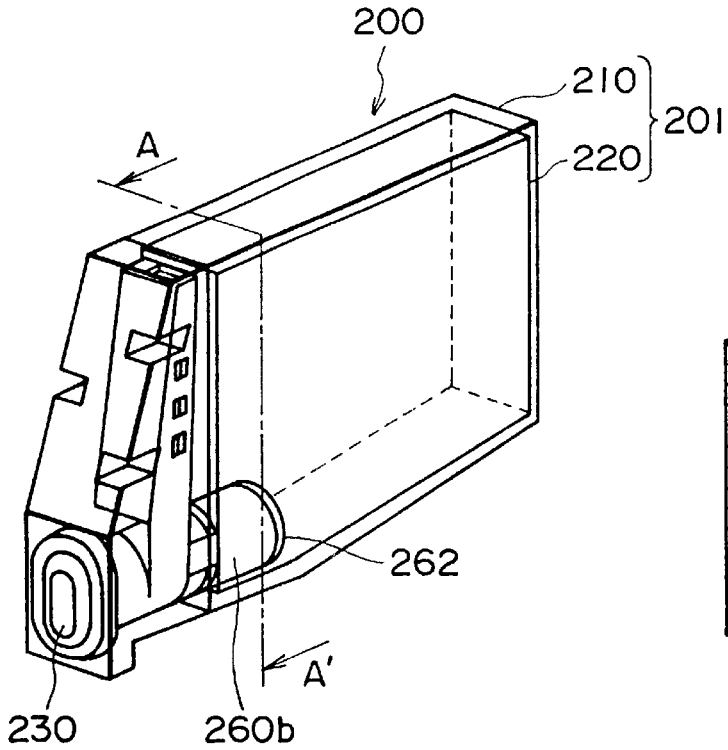
FIGS. 27A and 27B illustrate an ink container unit before the ink is not consumed as yet therefrom.
Figure 27B:
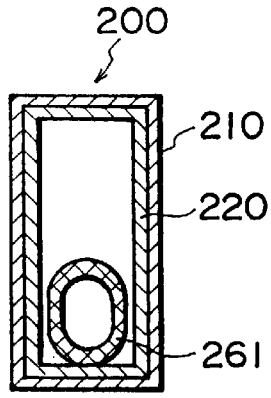
Figure 28A:
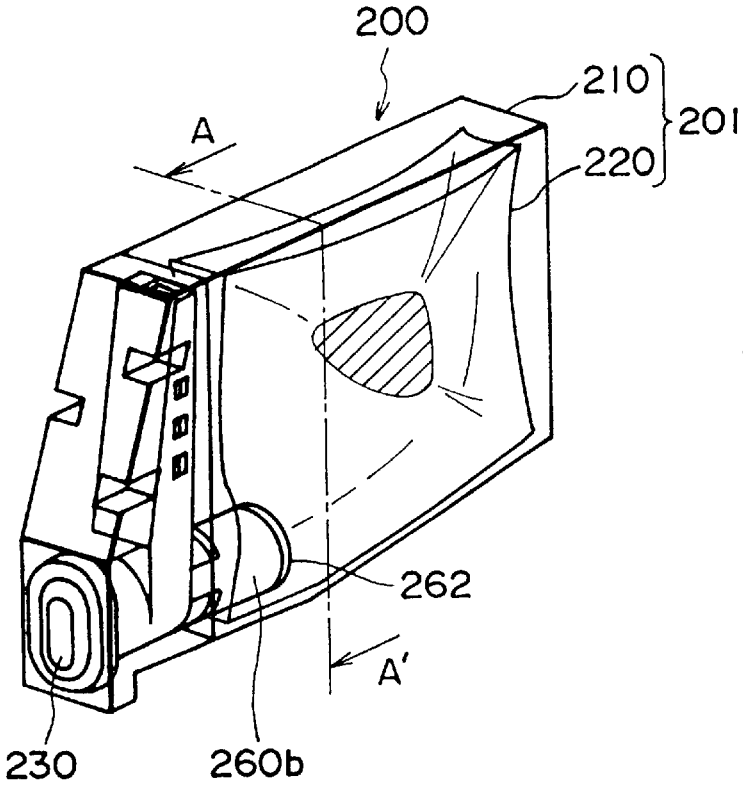
FIGS. 28A and 28B illustrate deformation of the inner bladder in the ink container unit with consumption of the ink in the ink container unit.
Figure 28B:
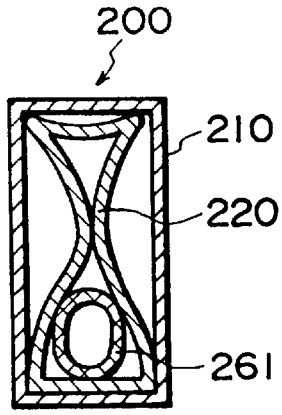

FIGS. 27A and 27B illustrate the ink container unit 200 when the ink is not be used, and FIGS. 28A and 28B illustrate the ink container unit 200 in which the inner bladder 220 therein is deformed due to the consumption of the ink from the inside of the ink container unit 200. FIGS. 27A and 28A are perspective perspective views of the ink container unit 200. FIG. 27B is a sectional view taken along the line A—A of FIG. 27A, and FIG. 28B is a sectional view taken along a lining A—A of FIG. 28A. In the ink accommodating container 201 of the ink container unit 200 of the embodiment, the inner bladder 220 is rectangular parallelepiped in the shape before the ink is discharged, and the casing 210 is also rectangular parallelepiped before the ink is discharged. In this state, the outer configuration of the inner bladder 220 is substantially the same as the inner configuration of the casing 210. The maximum area sides (major sides) of the casing 210 and the inner bladder 220 are vertical sides in use, and the joint opening 230 (supply port) is formed in a side which is different from the maximum area side. The valve mechanism is contacted to the bottom surface in the inner bladder 220.

As shown in FIG. 27A and FIG. 27B, in the state before the ink in the ink container unit 200 is consumed, the outer periphery of the inner bladder 220 is substantially closely contacted to the inner wall of the casing 210. The valve cap 262 and the second valve frame 260*b* constituting the valve mechanism mounted to the supply port of the ink accommodating container 201, is contacted to the bottom surface of the inner bladder 220, but is not contacted to the major side wall of the inner bladder 220, so that be space between the maximum area side of the inner wall of the inner bladder 220 and the second valve frame 260*b* and the valve cap 262. Therefore, the ink is present between the maximum area side of the inner wall of the inner bladder 220 and the second valve frame 260*b* and the valve cap 262.

When the ink is consumed from the inside of the ink container unit 200, the inner bladder 220 deforms in the direction of reducing the inner volume of the inner bladder 220, and the portion except for the motion sandwiched by valve mechanism and the casing 220 of the inner bladder 220 is separated from the casing 210 When the inner bladder 220 deforms in this manner with the consumption of the ink from the inner bladder 220, the portion adjacent the joint opening 230 of the inner bladder 220 may be separated from the casing 210, but the valve mechanism is sandwiched between the maximum area sides of the inner bladder 220 so that deformation of the portion adjacent the joint opening 230 of the inner bladder 220 is limited by the portion which is deed in the inner bladder 220 of the valve mechanism, namely, the valve cap 262 and/or the second valve frame 260*b*. In addition, since the opening of the valve mechanism is elongated vertically, the opening is not closed by the inner bladder 220. Thus, the valve cap 262 and/or the second valve frame 260*b* of the valve mechanism function as a regulating member for regulating the deformation of the portion adjacent the joint opening 230 of the inner bladder 220, and by the regulation of the deformation of the portion adjacent the joint opening 230 in the inner bladder 220 in this manner, the ink flow path around the valve mechanism in the inner bladder 220 and the passage for the bubble for permitting the bubble to rise during the gas-liquid exchanging operation, are assured. Therefore, the ink supply to the negative pressure control chamber unit 100 from the in side of the inner bladder 220 when the inner bladder 220 deforms, and the rising of the bubble in the inner bladder 220, are not obstructed, thus preventing improper supply of the ink attributable to the stagnation of the bubbles in the valve mechanism.

In the ink jet head cartridge provided with the negative pressure control chamber unit 100 and/or the ink container unit 200 having the deformable inner bladder 220, as described in the foregoing, it is desirable from the standpoint of increasing a buffer space in the casing 210 that balance is provided between the negative pressure in the inner bladder 220 and the negative pressure in the negative pressure control chamber container 110 so as to effect the gas-liquid exchanging operation between the ink container unit 200 and the negative pressure control chamber unit 100 with the large deformation of the inner bladder 220. For the purpose of high speed ink supply, a large joint opening 230 of the ink container unit 200 is desirable. It is also desirable that large space exists in the region adjacent the joint opening 230 in the inner bladder 220, so that ink supply passage is sufficiently provided in the region. If the deformation of the inner bladder 220 is increased in an attempt to assure the buffer space in the casing 210 accommodating the inner bladder 220, the space adjacent the joint opening 230 in the inner bladder 220 because small with the deformation of the inner bladder 220. When a space adjacent the joint opening 230 in the inner bladder 220, the rise of the bubble in the inner bladder 220 is obstructed, or the ink supply passage adjacent the joint opening 230 is reduced, with the result of obstructing the high speed ink supply. In the case that valve mechanism is not deep into the inner bladder 220, and the deformation of the portion around the joint opening 230 of the inner bladder 220, as in this embodiment, the amount of the deformation of the inner bladder 220 is suppressed within range not significantly influencing the supply of the ink to balance the negative pressure inevitable and the negative pressure in the negative pressure control chamber container 110, from the standpoint of high speed ink supply.

In this embodiment, the valve mechanism is deep into the inner bladder 220, as described hereinbefore, and the deformation of the portion adjacent the joint opening 230 of the inner bladder 220 is regulated. By doing so, even if the deformation of the deformation is large, the space adjacent the joint opening 230 in the inner bladder 220, that is, the ink supply passage in fluid communication with the joint opening 230 can be sufficiently assured, so that both of the large buffer space in the casing 210 and the ink supply at a high rate (high speed ink supply) can be accomplished.

Below the bottom portion of the ink container unit 200 in the above- described ink jet head cartridge, there is provided an electrode 270 used as ink remaining amount detecting means for detecting the ink remaining amount in the inner bladder 220, as will be described hereinafter. The electrode 270 is fixed to the carriage of the printer to which the holder 150 is mounted. The joint opening 230 to which the valve mechanism is mounted is provided below the front end surface of the ink container 200 at the negative pressure control chamber unit 100 side, and the valve mechanism is inserted deep into the inner bladder 220 in the direction substantially parallel to the bottom surface of the ink container unit 200, and therefore when the inner bladder 220 deforms, the deformation of the bottom portion of the inner bladder 220 is limited or regulated by the portion inserted into the valve mechanism. In addition, since a part of the bottom portion of the ink accommodating container 201 including the casing 210 and the inner bladder 220 is tapered, a corner portion is provided to regulate the deformation of the bottom portion of the inner bladder 220 during the deformation of the inner bladder 220. In addition to the advantageous effects of the regulation of the deformation of the bottom portion of the inner bladder 220 by the inclination of the bottom portion of the ink accommodating container 201, the deformation of the bottom portion of the inner bladder 220 is related by the valve mechanism, so that movement of the bottom portion of the inner bladder 220 relative to the electrode 270 is regulated, and therefore, correct detection of the ink remaining amount is accomplished even when the deformation of the inner bladder 220 is large in order to assure the buffer space. Therefore, the deformation of the portion of the inner bladder 220 adjacent the joint opening 230 by the valve mechanism, as described hereinbefore, there is provided a liquid supplying system in which the assuring of the large buffer space in the casing 210 by using large deformation of the inner bladder 220 and the high speed ink supply are both satisfied together with the advantage of correct detection of the ink remaining amount.

In this embodiment, the valve mechanism enters deep into the inner bladder 220 so as to regulate the deformation of the portion adjacent the joint opening 230 of the inner bladder 220. However, it is an alternative that another member other than the valve mechanism may be inserted into the inner bladder 220 to regulate the deformation of the portion adjacent the joint opening 230 of the inner bladder 220. In order to prevent the deformation of the portion adjacent the electrode 270 in the bottom portion of the inner bladder 220, a plate member for example may be inserted into the inner bladder 220 through the joint opening 230 to extend the plate member along the bottom surface in an inner bladder 220. By doing so, the correct a detection of the ink remaining amount is accomplished when the ink remaining amount in the inner bladder 220 is detected.

Moreover, in this embodiment, in the valve mechanism mounted the joint opening 230, the constituent element of the valve mechanism is inserted deeper into the inner bladder 220 the opening 260*c* which is in fluid communication with the joint opening 230 to constitute the ink flow path. By doing so, the ink container unit 200 can assure the ink flow path adjacent the joint opening 230 in the inner.

The description will be made as to structures for the detection of the ink remaining amount.

Figure 29:
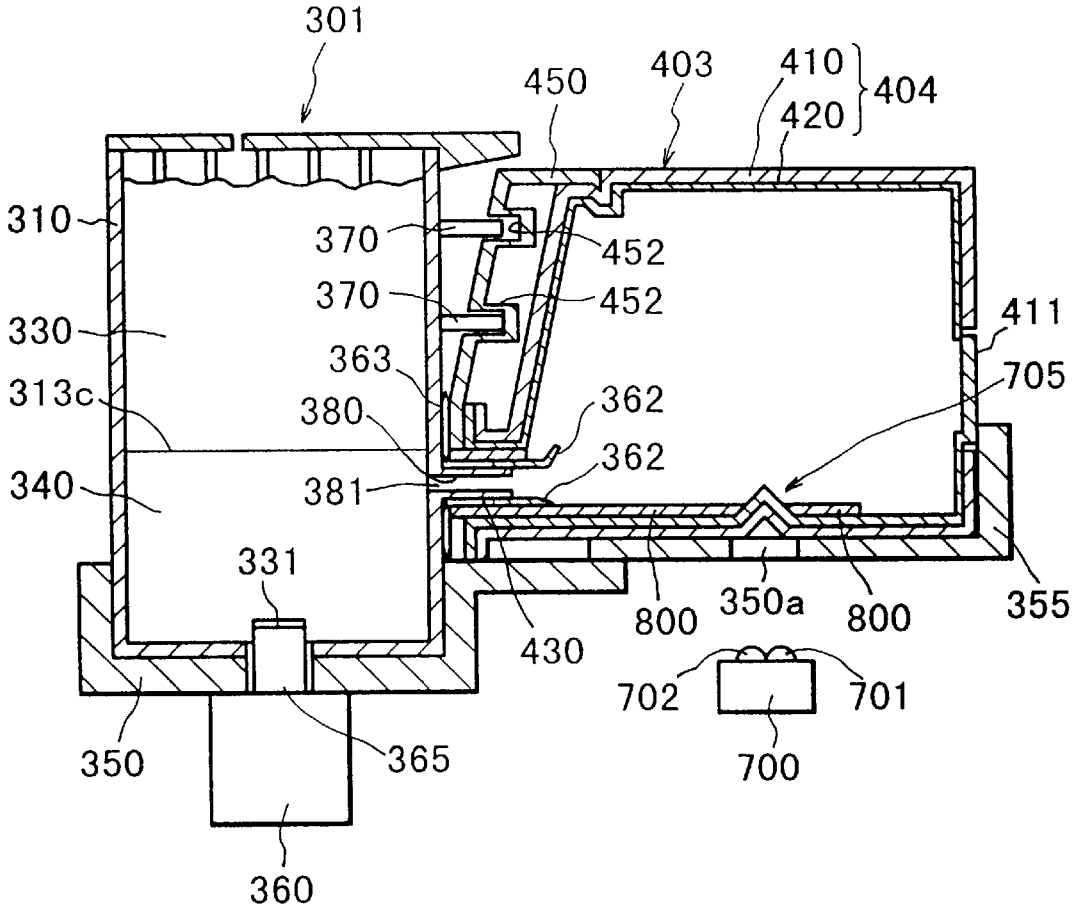
FIG. 29 is a sectional view of an ink jet head cartridge according to a further embodiment of the present invention.

FIG. 29 shows another example of the structure for detecting the ink remaining amount. The ink jet head cartridge of this embodiment is mainly different from FIG. 2 embodiment in the structure of the connecting portion between the ink container unit and the negative pressure control chamber unit and in the structure for detecting the presence or absence of the ink in the ink container unit. The ink jet head cartridge uses an optical detecting means for detecting the ink remaining amount (presence or absence) of the ink in the ink container unit. In order to regulate the deformation of the bottom surface portion of the inner bladder in the ink container unit, there is provided a regulating member in the ink container unit. The description will be made as to the structures which are different mainly from the structure of FIG. 2.

Referring to FIG. 29, the ink fills the ink container unit 403 detachably mounted to the holder 350 having the negative pressure control chamber unit 301, and the ink is not consumed.

As shown in FIG. 29, the ink jet head cartridge of this embodiment comprises an ink container unit 403 including an ink accommodating container 404 and an ID member 450 mounted to the negative pressure control chamber unit 301 side surface of ink accommodating container 404. The ink accommodating container 404 includes an inner bladder 420 which contains the ink and which is deformable and a casing 410 accommodating an inner bladder 420, similarly to the first embodiment. In the ink accommodating container 404, a joint opening 430 has an ink supply port which is engaged with a joint pipe 380 of the negative pressure control chamber unit 301. The ink accommodating container 404 is in a completely hermetically sealed state by a joint opening 430 sealed by a film seal 362, before it is mounted to the holder 350. The ID member 450 is provided with two ID recesses 452, at different positions, responding to the two ID members 370 provided on the lateral side of the negative pressure control chamber container 310 in the negative pressure control chamber unit 301.

The ink container unit 403 is provided with a regulating member 800 on the inner bottom wall of the joint opening 430 and of the bottom surface in the inner bladder 420. The regulating member 800 comprises the hollow portion having a configuration corresponding to the configuration of the inner wall of the joint opening 430 and a plate-like portion instead in one direction from the hollow portion. The regulating member 800 is inserted into the inner bladder 420 through the joint opening 430, and is fixed to ink container unit 403 at the front side portion of the joint opening 430. The hollow portion of the regulating member 800 is disposed in the joint opening 430, and the outer surface of the hollow portion is contacting to the surface of the inner wall of the inner, and the plate-like portion of the regulating member 800 is extended along the bottom surface in the inner bladder 420.

The regulating member 800 is in the ink in the inner bladder 420, and therefore, it has desirably a high ink hydrophilicity and a certain degree of rigidity. The material of the regulating member 800 may be a similar material to the material of the ink accommodating container 404, since then the recycling is easy. The plate-like portion of the regulating member 800 is provided with a hole at a position corresponding to the ink remaining amount detection portion 705 (liquid remaining amount detection portion) provided at the bottom surface portions of the inner bladder 420 of the casing 410. The ink remaining amount detection portion 705, as will be described hereinafter, the presence or absence of the ink in the inner bladder 420 is detected using light. The holder 350 is provided with an opening 350*a* at a portion corresponding to the ink remaining amount detection portion 705.

Figure 30:
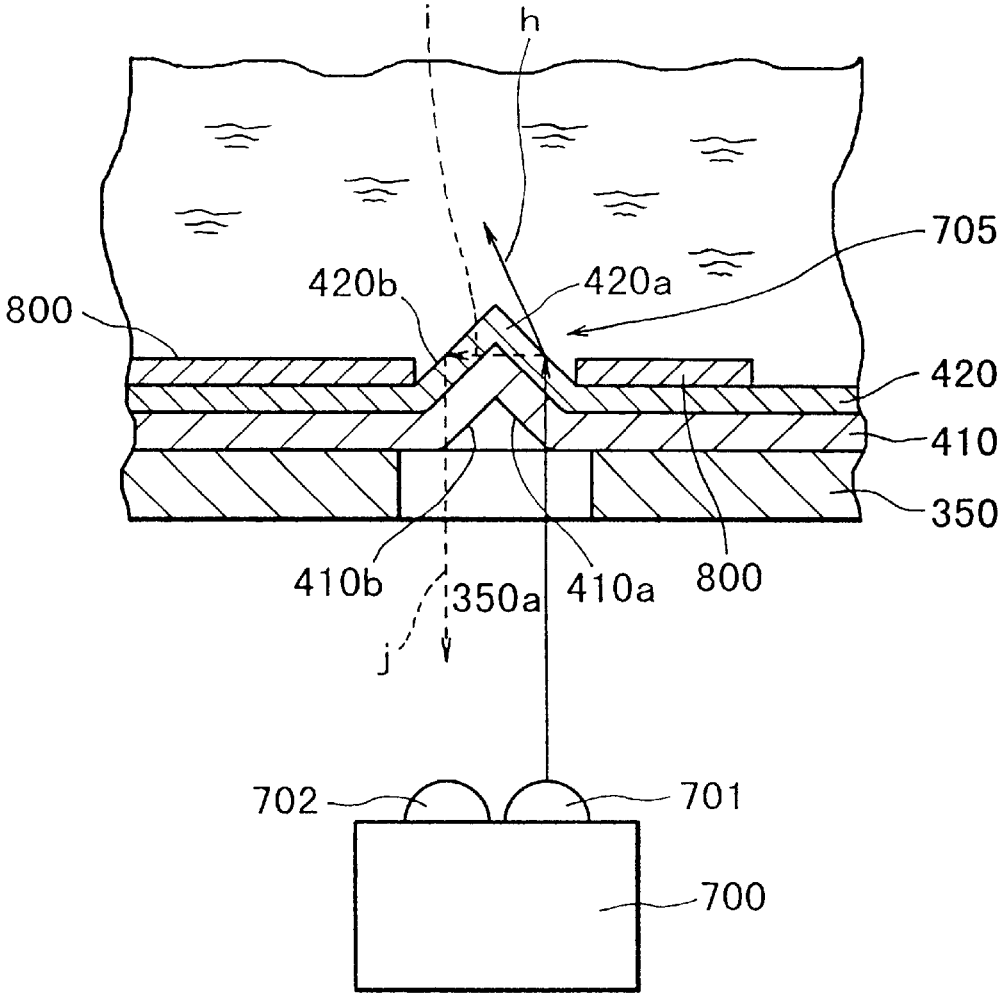
FIG. 30 illustrates a detection portion for detecting an ink remaining amount provided at the bottom surface portion of the ink accommodating container shown in FIG. 29.

FIG. 30 illustrates the ink remaining amount detection portion 705 provided on the bottom surface portion of the ink accommodating container 404 shown in FIG. 29. As shown in FIG. 30 the ink remaining amount detection portion 705 comprises inclined surface portions 410*a*, 410*b* formed on the bottom surface portion of the casing 410 and inclined surface portions 420*a*, 420*b* formed on the bottom surface portion of the inner bladder 420. The inclined surface portion 420*a* of the inner bladder 420 is overlaid on and contacted due to inside surface of the inclined surface portion 410*a* of the casing 410, and the inclined surface portion 420*b* of the inner bladder 420 is overlaid on and contacted to the inside surface of the inclined surface portion 410*b* of the casing 410. The portions functioning as to ink remaining amount detection portions 705 of the inner bladder 420 and the casing 410 are made of a material which is close to transparent and which has a refractive index which is very close the ink, for example, polypropylene or the like. Below the ink remaining amount detection portion 705, there is disposed a detection device 700 as an ink remaining amount detecting means of an optical type, provided in the main assembly such as an ink jet recording apparatus. The detection device 700 includes an emitting portion 701 and a light receiving portion 702.

In the optical detecting mechanism for the ink remaining amount, when there is a sufficient amount of the it in the inner bladder 420, the ink 906 in the inner bladder 420 is contacted to the inclined surface portions 420*a*, 903*b*. Here, the refractive index of the ink is different from the refractive index of the air, and the refractive index of the ink is closer to the refractive index of the material of the ink remaining amount detection portion 705. Therefore, when a sufficient amount of the ink is in the inner bladder 420, the quantity of light traveling in the direction indicated by an arrow h is large when the light from the emitting portion 701 is projected to the inclined surface portions 410*a*, 420*a*, as shown in FIG. 30, and the quantity of the light reflected by the inclined surface portions 410*a*, 420*a* is small.

When the amount of the ink in the inner bladder 420 becomes small as a result of consumption of the ink, the inclined surface portions 420*a*, 420*b* are contacted to the air in the inner bladder 420. When the inclined surface portions 420*a*, 420*b* are contacted to the air in the inner bladder 420, a part of the light from the emitting portion 701 is partly reflected by the inside surface of the inclined portion 420*a* and is directed in the direction indicated by an arrow 1 in the FIG. 30. The quantity of the light directed in the direction of the arrow 1 is larger than when the ink is sufficient, and the reflected light is then reflected further to the direction indicated by an arrow J by an inside surface of the inclined surface portion 420*b*. The difference in the light quantity of the light arriving at the light receiving portion 702 is converted to an electronic signal through a known photoelectric converting system, by which the presence or absence of the ink in the inner bladder 420 can be detected on the basis of the light combat received by light receiving portion 702.

Amended, the negative pressure control chamber unit 301 is constituted mainly by the negative pressure control chamber container 310 and the absorbing materials 330, 340 accommodated in the negative pressure control chamber container 310. In the negative pressure control chamber container 310, two absorbing materials 330, 340 are stacked into two stages, the joint pipe 380 provided in the ink container unit 403 side of the negative pressure control chamber container 310 is disposed adjacent an upper end of the lower absorbing material 340, that is, adjacent the interface surface 313*c* between the absorbing material 330 ended absorbing material 340.

The joint pipe 380 has such a length as not to obstruct the mounting of the ink container unit 403 when it is mounted to the holder 350 from the upper right side in FIG. 29 but as to be longer enough than the thickness of the casing 410 around the joint opening 430 in the ink accommodating container 404 so as to pierce the film seal 362 sealing the joint opening 430 to bring stable fluid communication between the inside of the ink accommodating container 404 and the inside of the negative pressure control chamber unit 301. An O-ring 363 is mounted to the base portion of the joint pipe 380. When the ink container unit 403 is mounted to the negative pressure control chamber unit 301, the O-ring 363 produced an urging force for urging the lower portion of the rear surface 411 of the ink accommodating container 404 to the upper portion 355 of the ink container system of the holder 350.

The relation between the inner diameter of the joint opening 430 and the outer diameter of the joint pipe 380 is such as to provide a such a gap that film seal 362 folded into the inside of the inner bladder 420 by being pierced by the joint pipe 380 is sandwiched between the inner diameter of the joint opening 430 and the outer diameter of the joint pipe 380. In addition to producing the urging force as described above, the O-ring 363 functions to prevent the ink leakage from the ink accommodating container 404 through the gap formed between the outer diameter of the joint pipe 380 and the inner diameter generation.

The holder 350 is provided with an ink jet head unit 360, and the ink is supplied from the negative pressure control chamber unit 301 through the supply port 331 and the ink supply tube 365 into the ink jet head unit 360.

Figure 31:
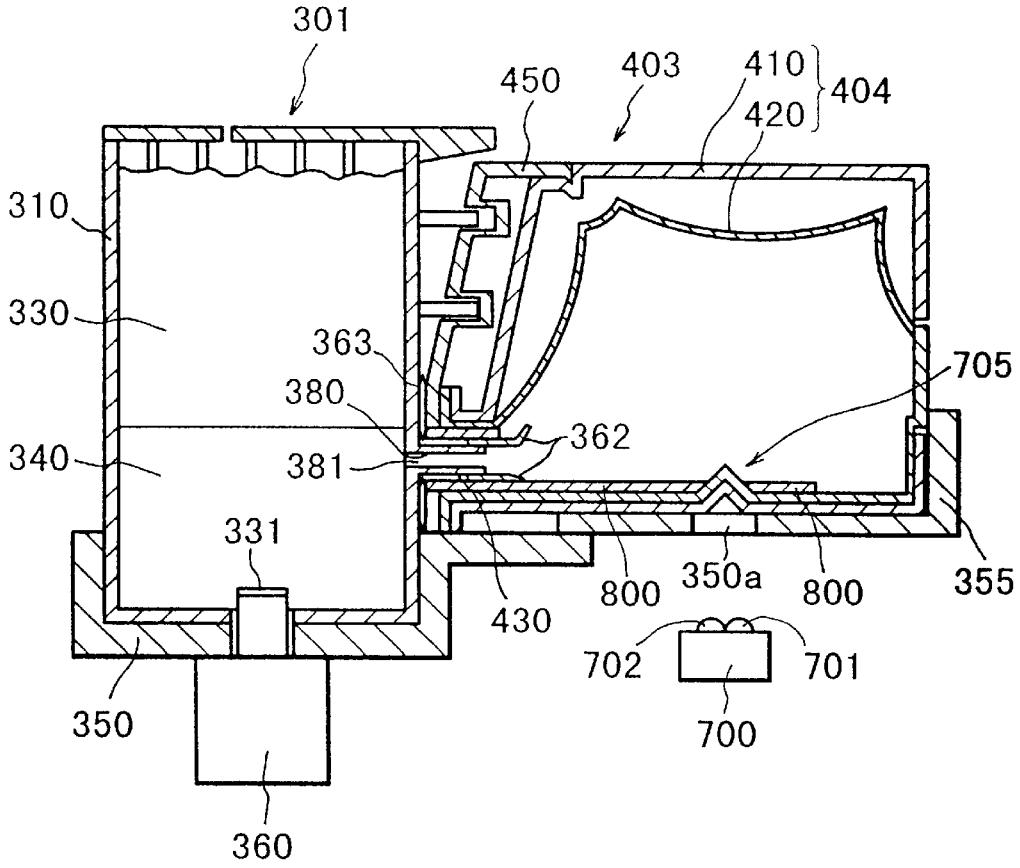
FIG. 31 is a sectional view of the inner bladder showing deformation with consumption of the ink therein in the ink jet head cartridge shown in FIG. 29.

The negative pressure control chamber unit 301 is the same as t negative pressure control chamber unit 100 in the first embodiment except for the portion relating to the joint pipe 380, and therefore, the detailed description is omitted for simplicity. When the ink in the inside of the ink accommodating container 404 is supplied into the negative pressure control chamber unit 301 through the joint pipe 380, the gas-liquid exchanging operation is carried out similarly to the first embodiment, and the description of the gas-liquid exchanging operation is the same as described hereinbefore, and the detailed description there of is omitted for simplicity. FIG. 31 is a sectional view illustrating an inner bladder 420 which has been deformed as a result of consumption of the; from the inner bladder 420 in the ink jet head cartridge shown in FIG. 29. As shown in FIG. 31, even if the inner bladder 420 is deformed with the consumption of the ink from the inner bladder 420, the deformation of bottom surface portion of the inner bladder 420 is regulated by the regulating member 800. More particularly, the separation (disengagement) of the casing 410 from the bottom surface portion is regulated by the regulating member 800 in the bottom surface portion of the inner bladder 420. Thus, the deformation of the portion of the ink remaining amount detection portion 705 in the inner bladder 420 is regulated, and therefore, even if the ink is consumed, no air layer is formed between the inclined surface portions 410*a* and 420*a* or between the inclined surface portions 410*b* and 420*b*. By this, such an erroneous detection as detecting absence of the ink despite the fact that ink is in the inner bladder 420, and therefore, accurate ink detection is accomplished.

In this embodiment, the regulating member 800 is inserted deeper into the inner bladder 420 than the ink remaining amount detection portion 705, but the regulating member 800 may be inserted to such an extent that free end is before the ink remaining amount detection portion 705 if deformation of the bottom surface portion of the inner bladder 420, particularly the deformation of the portion which is the ink remaining amount detection portion 705 in the inner bladder 420 can be regulated or limited. The detecting means for detecting the ink remaining amount in the inner bladder 420 may be incorporated in the regulating means for regulating the deformation of the bottom surface portion of the inner bladder 420.

A further embodiment of the present invention will be described.

Figure 32:
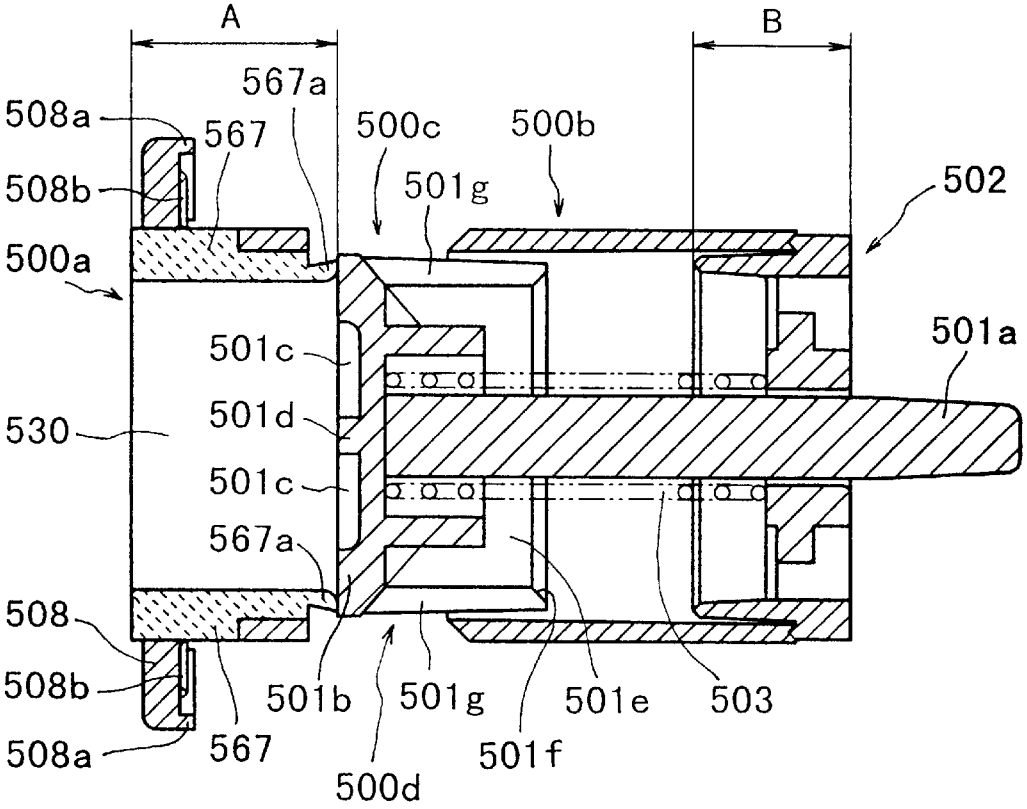
FIG. 32 is a schematic sectional view of a valve mechanism according to another embodiment of the present invention.

FIG. 32 is a sectional view of a valve mechanism according to a further embodiment of the present invention. The valve mechanism comprises a first valve frame 500*a* disposed a a supply port portion of the ink container, a second valve frame 500*b* including an upper valve frame opening 500*c* and a lower valve frame opening 500*d* and cooperative with the first valve frame 500*a* to constitute a valve frame in the ink container, a valve cap 502 for covering a rear end opening of the second valve frame 500*b*, valve member 501, an urging member 503 for urging the valve member 501 to the first valve frame 500*a*.

The first valve frame 500*a* includes a frame and an elastomer 567 therein, and it is desirable that length A of the entirety including the elastomer 567 is in a proper range. When the ink container is dismounted from the recording head, the ink may remain in the first valve frame 500*a*. If the first valve frame 500*a* is too long, the amount of the remaining ink is excessive with the result of a large amount of the ink leakage (drain). If it is too short, the regulation of the connecting operation with the recording head and the assuring of the connection state may be not easy. In this embodiment, A is approx. 5.3 mm. By selecting a proper range for the length of the first valve frame 500*a*, the amount of the ink leakage can be limited to an extent of practically acceptable, and the connection state can be easily maintained.

The contact portion between the elastomer 567 of the first valve frame 500*a* and the valve member 501 is in the form of a lip portion 567*a* extending all around to prevent the leakage of the ink. The lip portion 567*a* deforms (tilts) inwardly or outwardly when it is contacted to the valve member 501. If the orientation of the tilting is not uniform, that is, the lip tilts inwardly in a portion and outwardly in the other portion, the sealing property at the boundary portion is not assured with the result of ink leakage. In this embodiment, the lip portion 567*a* is slightly tilted outwardly. By doing so, the it is assured that lip portion 567*a* is entirely tilted outwardly upon contact to the valve member 501 (open), so that high sealing performance is assured. It is a possible alternative to make the lip tilt inwardly, but in that case, the lip portion has to deform in such a direction that circumferential length thereof is reduced with the possible result of wrinkle which may lead to ink leakage. When this can be avoided, the inward tilting structure is usable.

The first valve frame 500*a* is provided with a first valve frame flange portion 508 to be connected with the casing of the ink container. The outer diameter of the flange portion 508 is 16 mm in this embodiment. This is selected in order to provide a space for preventing the ink from going around the connecting portion between the casing and the flange portion 508.

The elastomer 567 of the first valve frame 500*a* has a portion of a different thickness. The frame is disposed at the thickness changing portion. The elastomer 567 receives a load to be deformed by connection with joint pipe. By the deformation of elastomer, the joint pipe receives the reaction force so that force required for the connection becomes large correspondingly. For the purpose of reducing the force required for the mounting, the thickness of the elastomer 567 is made different. By the portion having the different thickness, the force required for the mounting can be reduced. The free end portion of the elastomer 567 is slightly projected upward beyond the flange portion 508 of the first frame, and the end has an acute angle. By the projected structure beyond the flange portion, there is provided a space with which the ink is prevented from going around the connecting portion between casing and the flange portion 508.

A projected portion 508*a* is provided at each side of the connection between the flange portion 508 of the first frame and the casing. The projected portion 508*a* functions to protect the welded portion 508*b* provided at each side of the connection between the firstframe flange portion 508 and the casing. The projected portion 508*a* is effective to prevent damage of the parts (the first frame flange portion 508) during transportation before the firstframe flange portion 508 is assembled into the casing.

The description will be made as to the structure of valve member 501. The valve member comprises a seal portion 501*b* connecting with the elastomer and a sliding shaft 501*a* extended into the container therefrom. The sliding shaft 501*a* is extended out from the valve end more than the sliding shaft of the valve mechanism shown in FIG. 11, for example. By doing so, it can be utilized as a guide for assembling the urging member (valve spring) 503 and the valve cap 502 into the valve member, so that move assembling property of the valve mechanism can be improved. In this embodiment, it is 17.3 mm.

The diameter of the sliding shaft is larger than that in the FIG. 11. By doing so, the clearance among the valve member 501, the valve cap and the urging member 503 can be reduced. In place of using a large measured of the sliding shaft, the opening diameter of the valve cap 502 may be made smaller if the consideration is paid to the clearance between the valve spring and the shaft 501*a* of the valve member. The shaft diameter is 2.2 mm in this embodiment.

The seal portion 501*b* of the valve member 501 is provided at the end surface thereof with a recess 501*c*, and in the recess 501*c*, a rib 501*d* is formed. By this, it can be avoided that free end of the joint pipe shown in FIG. 10 for example is abutted to the rib 501*d*, and is fitted into the recess 501*c* of the seal portion 501*b*.

Behind the seal portion 501*b*, there is disposed a frame 501C, and the end of the frame 501C is beveled as indicated by 501*f*. By this, the urging member 503 can be swingably mounted to the sliding shaft 501*a*.

A slit is provided at a position in the part of the frame 501*e* of the seal portion 501*b* of the valve member 501 at a such a position as is faced to the lower valve frame opening 500*d* and the upper valve frame opening 500*c* provided between the first valve frame 500*a* and the second valve frame 500*b* Inside of the frame 501C of the valve member 501 is vacant, but the ink cannot be filled in the vacant portion in the case that valve unit is assembled into the container after the ink is injected into the ink accommodating container. This means that ink capacity is small correspondingly. By the provision of slit 501*g* in the frame 501C of the valve member 501, the air can escape through the slit, so that ink can be filled into the vacant portion enclosed by the frame 501C, thus increasing the ink capacity.

The frame 501C of the valve member 501 is provided therein with an annular rib 501*h* which is smaller the frame 501C.

In order to reduce the clearance among the valve member 501, the valve cap 502 and the urging member 503 in consideration of the sliding shaft 501*a*, the hole diameter of the valve cap 502 is 2.5 mm. In order to improved the assembling property, the length B of the valve cap 502 is 4.3 mm in this embodiment.

The load and the inclination of the spring constant of the urging member 503 are determined in consideration of assuring the sealing property of the valve member 501 and reducing the change of the mounting force in the mounting process of mounting the ink container. In addition, as to the material constituting the structure, it is desirably selected in consideration of the liquid contact property relative to the ink, and the surface treatment thereof is made in consideration of the elusion thereof into the ink. For example, when a Ni coating is used, the Ni elusion may occur into the ink, and therefore, the treatment is not desirable.

In addition, the upper valve frame opening 500*c* and the lower a valve frame opening 500*d* provided between the first valve frame 500*a* and the second valve frame 500*b*, have the same the opening areas in FIG. 32, but this is not limiting, and they may have different areas. However, the opening areas of the upper valve frame opening 500*c* and the lower valve frame opening 500*d* desirably satisfy the following:

Area of the upper valve frame opening 500*c*< lower valve frame opening 500*d*

The upper valve frame opening 500*c* is used mainly for movement of the air in the gas-liquid exchange. (However, it contributes to the movement of the ink when the air does not move.) The lower valve frame opening 500*d* side is used for the movement of ink in the gas-liquid exchange. Therefore, by making the area of the lower valve frame opening 500*d* larger, the amount of ink supply can be enough for a high speed printing. The upper valve frame opening 500*c* has enough opening area to prevent stagnation and/or deposition of the bubble with respect to the movement of the gas. The upper valve frame opening 500*c* and the lower valve frame opening 500*d* have inner opening areas not to produce unnecessarily large resistance against passes of the gas and the liquid (ink). As described in the foregoing, according to the present invention, the opening configuration of the ink supply port is elongated in one direction the valve mechanism using a valve member slidably supported, and therefore, the rotational angle of the valve member is regulated when the valve member slides, associate the sealing property of the valve mechanism when it is closed, and in addition, the opening area of the ink supply port can be assured due to sufficient even in the case that width of the ink container cannot be large because of the spaces allotted thereto is limited, and the ink supply port is formed in the widthwise side. Therefore, a large flow rate of ink is permitted with high sealing property of the valve mechanism.

Furthermore, the thickness of the elastomer is larger than the thickness required to simply seal the gap between the frame and then said pipe, so that sealing property is assured between the elastomer on the inner surface of the frame and the outer surface of the pipe, and simultaneously, the relative positional deviation hitting said pipe and the liquid container can be suppressed by the elastomer, so that highly reliable seal is accomplished.

Moreover, the rigidity of the frame intimate the pipe is inserted, is high than the rigidity of the pipe, by which the elastic force of the elastomer against the outer surface of the pipe is maintained even if the frame is deformed, and therefore, a highly reliable sealing property can be assured between the elastomer on the inner surface of the frame and the outer surface of the pipe.

Additionally, when such a valve mechanism is used for the liquid supply port of a liquid container, an assured sealing and a stabilized ink supply can be simultaneously accomplished irrespective of relative positional deviation between the joint pipe of the liquid receiving side and the liquid container which are connected with each other. Additionally, the valve member is provided with a taper providing smaller diameter toward the cap member, and therefore, the angle of clogging of the valve member in the frame can be made smaller the case without the tapered so that adhesiveness between the free end of the valve member and the contact member can be improved.

In addition, by providing the cap member with the guide portion engaging with one end of the frame, the positional deviation of the cap member is reduced when one end of the valve frame and the cap member are welded with each other by an ultrasonic welding, which generates vibration. Therefore, the accuracy of position of the center of the hole of the cap member can be improved. Even if a force is imparted to the cap member through the shaft portion of the valve member due to the clogging of the valve member, the proper connection state can be assured between the cap member and the like by the function of guide portion.

By the provision of rounded part of edge line of the hole of the cap member in the side opposite from the connecting side with the frame of the cap member, the resistance resulting from the contact between the cap member and the shaft portion of the valve member can be reduced when the valve member is sliding toward the contact member with the clogging. Moreover, the contact portion between the contact member and the free end of the valve member is in the form of a flat plane, and therefore, even if the valve member is contacted thereto with the clogging, the contact radius relative to the contact member of the rounded part of the valve member is constant, and therefore, the contact is complete. In addition, the portion of elastomer contacting to the valve member is in the form of a tongue-like projection, and therefore, the close contact is assured. When such a valve mechanism is used in a supply port of an ink accommodating container, the clogging of the valve member with the part for reacting against the valve member can be suppressed when the ink accommodating container is connected with or disconnected from the ink receiving portion or when the connecting and disconnected actions are repeated, and therefore, the assured sealing is accomplished. By providing the liquid containing portion with the regulating member for regulated the deformation of the portion adjacent the supply port in the liquid containing portion, the establishment of the liquid flow path adjacent the supply port in the liquid containing portion and the establishment of passage for the bubble to be introduced into the liquid containing portion, are assured, so that flowability of the liquid in the liquid containing portion is not decreased even by the narrowing of the portion adjacent the supply port in the liquid containing portion, so that high speed liquid supply is always assured. When such a liquid supply container is used with a combination of an accommodating container for accommodating a capillary force generating member, which can retain the liquid supplied from a liquid supply container, the buffer space in the inner due to large deformation of the liquid containing portion and the high speed liquid supply can both be assured.

While the invention has been described with reference to the structures disclosed herein, it is not confined to the details set forth and this application is intended to cover such modifications or changes as may come within the purpose of the improvements or the scope of the following claims.

Additionally, by further regulating the bottom surface portion of the liquid containing portion in the state of use by the regulating member, the following advantage is provided; when the liquid containing portion and therefore inner bladder are made larger for the purpose of assuring the buffer space, and the presence or absence of the liquid in the liquid containing portion, for example, the possible erroneous detection attributable to the increase of the deformation of the bottom surface portion of the liquid containing portion resulting from a large deformation of the inner bladder, so that correct detection of the liquid remaining amount is accomplished.

While the invention has been described with reference to the structures disclosed herein, it is not confined to the details set forth and this application is intended to cover such modifications or changes as may come within the purposes of the improvements or the scope of the following claims.

What is claimed is:

1. A recording liquid container for containing recording liquid to be supplied to an ink jet recording head, said recording liquid container being detachably connectable with a recording liquid receiving portion of a recording liquid absorbing material accommodating chamber which in turn is connectable to the ink jet recording head and which contains a recording liquid absorbing material for retaining the recording liquid to be supplied to the recording liquid jet recording head, said recording liquid absorbing material accommodating chamber being provided with an air vent, said recording liquid container comprising:

a main body; and a cylindrical liquid supply portion having an opening formed in said main body and connectable with the receiving portion of the recording liquid absorbing material accommodating chamber to supply the recording liquid out;

wherein said recording liquid container is substantially isolated from ambient air except for said opening, and said opening has a circular shape which is elongated more in a vertical direction than a horizontal direction.

2. A liquid container according to claim 1, wherein said liquid container has a flat configuration.

3. A liquid container according to claim 1, wherein said liquid container has a flat configuration with a major side thereof vertical in use, and wherein said liquid supply opening is disposed at a lower position in the major side, and said liquid supply opening is elongated in the vertical direction.

4. A liquid container according to claim 1, wherein said elongated circle configuration is an ellipse configuration.

5. A liquid container according to claim 1, wherein said elongated circle configuration is a configuration having semispherical parts and rectilinear parts therebetween.

6. A liquid container according to claim 1, wherein a length x measured in a longitudinal direction of the elongated circle configuration and a length y measured in a direction perpendicular to the longitudinal connection, satisfy:

$$y/x<2/3.$$

7. A liquid container according to claim 1, wherein said liquid supply opening is provided with a valve mechanism, which includes:

a cylindrical frame;

a valve member slidable in said frame;

a shaft portion provided in said valve member and extended in a direction of a sliding motion of said valve member;

a cap member connected to one end of said frame and having an opening for receiving said shaft portion;

an urging member for urging said valve member away from said cap member;

a contact member provided along an inner surface of said frame contactable to a free end of said valve member urged by said urging member;

an opening, formed in a side of said frame, for disabling, when a free end of said valve member is contacted to said contact member, fluid communication with an opening provided at the other end of said frame, and for enabling, when the free end is away therefrom, fluid communication with the opening provided at the other end.

8. A valve mechanism for a cylindrical ink supply portion having an opening with a cross-section elongated more in a vertical direction than a horizontal direction, said valve mechanism comprising:

a cylindrical casing having a valve opening;

a valve member which is slidable in said casing;

a shaft portion provided in said valve member and extended in a slide direction of said valve member;

a cap member connecting with one end of said casing and having a bearing opening for slidably supporting said shaft portion;

an urging member for urging said valve member away from said cap member;

a contact member provided along an inner surface of said casing contactable to an end of said valve member urged by said urging member;

an opening, formed in a side of said casing, for disabling, when said end of said valve member is contacted to said contact member, fluid communication with a valve opening provided at the other end of said casing and enabling, when the free end is away therefrom, fluid communication with the valve opening provided at the other end;

wherein a configuration of said opening of said valve mechanism has a circular shape elongated in conformity with said opening of said ink supply portion.

9. A valve mechanism according to claim 8, wherein said opening is formed at each of upper and lower positions of said frame, and wherein the lower opening is larger than the upper opening.

10. A valve mechanism according to claim 8, wherein said valve member has a width in the sliding direction, and a diameter that decreases toward said shaft portion.

11. A valve mechanism according to claim 8, wherein an entirety of an inner surface of said frame from another end opening to said contact portion is made of elastomer.

12. A valve mechanism according to claim 11, wherein said contact portion has a tongue shape.

13. A valve mechanism according to claim 12, wherein said tongue-shaped contact portion is inclined outwardly.

14. A valve mechanism according to claim 11, wherein a thickness of said elastomer is relatively thicker at an outer side opening of said frame and is relatively thinner at a contact portion side.

15. A recording liquid container for containing recording liquid to be supplied to an ink jet recording head, said recording liquid container being detachably connectable with a recording liquid receiving portion of a recording liquid absorbing material accommodating chamber which in turn is connectable to the ink jet recording head and which contains a recording liquid absorbing material for retaining the recording liquid to be supplied to the ink jet recording head, said recording liquid absorbing material accommodating chamber being provided with an air vent, said recording liquid container comprising:

a liquid supply portion constituting a connecting portion for supplying the recording liquid to the recording liquid absorbing material accommodating chamber; and a valve mechanism, provided in said liquid supply portion, for permitting supply of the recording liquid by insertion of a hollow pipe provided in the receiving portion, and for preventing supply of the recording liquid by removing said hollow pipe;

wherein said liquid supply portion is cylindrical and has a circular cross-section which is elongated more in a vertical direction than a horizontal direction.

16. A liquid container according to claim 15, wherein said liquid container has a flat configuration.

17. A liquid container according to claim 15, wherein said liquid container has a flat configuration with a major side thereof oriented vertically in use, and wherein said liquid supply portion is disposed at a lower position in the major side, and said liquid supply opening is elongated in the vertical direction.

18. A liquid container according to claim 15, wherein said elongated circle configuration is an ellipse configuration.

19. A liquid container according to claim 15, wherein said elongated circle configuration is a configuration having semispherical parts and rectilinear parts therebetween.

20. A liquid container according to claim 15, wherein wherein a length x measured in a longitudinal direction of the elongated circle configuration and a length y measured in a direction perpendicular to the longitudinal connection, satisfy:

$$y/x<2/3.$$

21. A liquid container according to claim 15, wherein the recording liquid contained in said liquid container is yellow, cyan, magenta or black ink.

22. A liquid container according to claim 15, wherein said liquid container includes an outer casing and an inner bladder, which are produced by a blow molding process, and the recording liquid is directly accommodated in said inner bladder.

23. A liquid container according to claim 15, wherein said valve mechanism includes:

a cylindrical frame;

a slidable valve member in said frame;

a shaft portion provided in said valve member and extended in a sliding direction of said valve member;

a cap member connecting to one end of said frame and having a bearing opening for receiving said shaft portion;

an urging member for urging said valve member away from said cap member;

a contact member provided along an inner surface of said frame contactable to a free end of said valve member urged by said urging member;

an opening, formed in a side of said frame, for disabling, when a free end of said valve member is contacted to said contact member, fluid communication with an opening provided at the other end of said frame, and for enabling, when the free end is away therefrom, fluid communication with the opening provided at the other end.

24. A liquid container according to claim 23, wherein said opening is formed at each of upper and lower positions of said frame, and wherein the lower opening is larger than the upper opening.

25. A liquid container according to claim 23, wherein said valve member has a width in the sliding direction, and a diameter that decreases toward said shaft portion.

26. A liquid container according to claim 23, wherein an entirety of an inner surface of said frame from another end opening to said contact portion is made of elastomer.

27. A liquid container according to claim 26, wherein said contact portion has a tongue shape.

28. A liquid container according to claim 27, wherein said tongue-shaped contact portion is inclined outwardly.

29. A liquid container according to claim 26, wherein a thickness of said elastomer is relatively thicker at an outer side opening of said frame and is relatively thinner at a contact portion side.

* * * * *

UNITED STATES PATENT AND TRADEMARK OFFICE

CERTIFICATE OF CORRECTION

PATENT NO. : 6,530,654 B2
APPLICATION NO. : 09/559390
DATED : March 11, 2003
INVENTOR(S) : Kenji Kitabatake et al.

It is certified that error appears in the above-identified patent and that said Letters Patent is hereby corrected as shown below:

ON THE COVER PAGE

Under "Foreign Patent Documents", "EP 8220853" should read --EP 822085--; and

Under "Other Publications", "U.S. Application No. 09/599,754" should read --U.S. Application No. 09/559,754--.

COLUMN 2

Line 9, "them" should read --a--;
Line 13, "pieces" should read --pierces--; and
Line 46, "productive of" should read --productive--.

COLUMN 3

Line 13, "compact" should read --contact--;
Line 40, "small with)" should read --small width--; and
Line 64, "that" should read --that the--.

COLUMN 4

Line 38, "accumulated" should read --accumulate--;
Line 55, "from the" should be deleted; and
Line 56, "from" should be deleted.

COLUMN 5

Line 14, "to the" should read --from the--;
Line 29, "the" should read --be--;
Line 43, "urged" should read --urging--;
Line 45, "urged" should read --urged by--; and
Line 51, "mittees" should read --munication--.

COLUMN 17

Line 52, "is in use," should read --is when in use--.

COLUMN 19

Line 2, "a" should read --α--;
Line 7, "21 tips" should read --tips 21--; and
Line 57, "posses" should read --possess--.

COLUMN 21

Line 44, "occurs" should read --occur--.

UNITED STATES PATENT AND TRADEMARK OFFICE

CERTIFICATE OF CORRECTION

PATENT NO. : 6,530,654 B2
APPLICATION NO. : 09/559390
DATED : March 11, 2003
INVENTOR(S) : Kenji Kitabatake et al.

It is certified that error appears in the above-identified patent and that said Letters Patent is hereby corrected as shown below:

COLUMN 24
Line 38, “projecting” should read --projection--.

COLUMN 33
Line 8, “flows” should read --flow--.

COLUMN 35
Line 41, “occupies” should read --occupy--.

COLUMN 37
Line 34, “that is” should be deleted.

COLUMN 46
Line 41, “to,” should read --to--.

COLUMN 51
Line 52, “assure” should read --assured--;
Line 60, “ink inner” should read --ink inside--; and
Line 61, “third inside” should read --the inside--.

COLUMN 52
Line 32, “duty” should read --during--; and
Line 35, “highland (the” should read --high altitude (where the--.

COLUMN 53
Line 10, “first the” should read --of the first--.
Line 13, “261 is” should read --261--;
Line 15, “are valve” should read --are engaged--;
Line 16, “member 261 with each other,” should read --with each other, at least--, and “ratio” should read --the ratio--;
Line 17, “”width” should read --width of valve member 261--;
Line 24, “261 is” should read --261--;
Line 25, “the om restoration and” should be deleted, and “clog with” should read --clogs--; and
Line 26, “each other” should be deleted.

UNITED STATES PATENT AND TRADEMARK OFFICE

CERTIFICATE OF CORRECTION

PATENT NO. : 6,530,654 B2
APPLICATION NO. : 09/559390
DATED : March 11, 2003
INVENTOR(S) : Kenji Kitabatake et al.

It is certified that error appears in the above-identified patent and that said Letters Patent is hereby corrected as shown below:

COLUMN 55

Line 20, “be” should read --being--;
Line 24, “perspective perspective” should read --perspective--;
Line 27, “lining” should read --line--;
Line 48, “be” should read --the--;
Line 57, “motion” should read --portion--; and
Line 67, “deed” should read --deep--.

COLUMN 57

Line 46, “a” should be deleted; and
Line 55, “inner” should read --inner bladder--.

COLUMN 59

Line 19, “the it” should read --the ink--;
Line 21, “903b” should read --420b--;
Line 39; “arrow 1” should read --arrow i--;
Line 41; “arrow 1” should read --arrow i--; and
Line 62, “ended” should read --and the--.

COLUMN 60

Line 22, “generation” should be deleted;
Line 28, “t” should read --the--; and
Line 39, “the;” should read --the ink--.

COLUMN 61

Line 8, “a a” should read --at a--; and
Line 41, “so the” should read --so,--.

COLUMN 62

Line 58, “smaller” should read --smaller than--.

COLUMN 63

Line 11, “a” should be deleted;
Line 34, “direction the” should read --direction, the--;
Line 40, “sufficient” should read --sufficient ink--;
Line 48, “then” should be deleted;
Line 54, “intimate” should read --into which--; and
Line 55, “high” should read --higher--.

UNITED STATES PATENT AND TRADEMARK OFFICE

CERTIFICATE OF CORRECTION

PATENT NO. : 6,530,654 B2
APPLICATION NO. : 09/559390
DATED : March 11, 2003
INVENTOR(S) : Kenji Kitabatake et al.

It is certified that error appears in the above-identified patent and that said Letters Patent is hereby corrected as shown below:

COLUMN 64

Line 3, "smaller" should read --smaller than--; and
Line 37, "disconnected" should read --disconnecting--.

COLUMN 67

Line 22, "wherein" should be deleted.

Signed and Sealed this

Twenty-eighth Day of November, 2006

JON W. DUDAS
*Director of the United States Patent and Trademark Office*